United States Patent [19]

Ichijima et al.

[11] Patent Number: 5,049,474

[45] **Date of Patent: * Sep. 17, 1991**

[54] COLOR LIGHT-SENSITIVE MATERIAL

[75] Inventors: Seiji Ichijima; Kei Sakanoue, both of Kanagawa, Japan

[73] Assignee: Fuji Photo Film Co., Ltd, Kanagawa, Japan

[ * ] Notice: The portion of the term of this patent subsequent to Jan. 8, 2005 has been disclaimed.

[21] Appl. No.: 196,392

[22] Filed: May 20, 1988

[30] Foreign Application Priority Data

May 20, 1987 [JP] Japan ..... 62-123497

[51] Int. Cl.[5] ..... G03C 8/22; G03C 7/392

[52] U.S. Cl. ..... 430/223; 430/359; 430/504; 430/543; 430/559; 430/958

[58] Field of Search ..... 430/504, 549, 359, 223, 430/543, 559, 958

[56] References Cited

U.S. PATENT DOCUMENTS

| | | | |
|---|---|---|---|
| 4,450,223 | 5/1984 | Van Poucke et al. | 430/223 |
| 4,489,155 | 12/1984 | Sakanoue et al. | 430/504 |
| 4,705,743 | 11/1987 | Mihaymshi et al. | 430/505 |
| 4,729,944 | 3/1988 | Mihayashi et al. | 430/505 |
| 4,783,396 | 11/1988 | Nakamura et al. | 430/569 |
| 4,886,736 | 12/1989 | Nakamura et al. | 430/359 |

FOREIGN PATENT DOCUMENTS

| | | | |
|---|---|---|---|
| 1088257 | 5/1986 | Japan | 430/955 |

*Primary Examiner*—Charles L. Bowers, Jr.
*Assistant Examiner*—Lee C. Wright
*Attorney, Agent, or Firm*—Sughrue, Mion, Zinn, Macpeak & Seas

[57] ABSTRACT

A novel color light-sensitive material is provided, which comprises a support having theron at least a light-sensitive silver halide, an image-forming coupler, and a compound represented by formula (I):

$$PWR\text{-}(Time)_t\text{-}Z \qquad [I]$$

wherein PWR represents a group which undergoes reduction to release $\text{-}(Time)_t\text{-}Z$; Time represents a group which releases Z through a reaction after being released as $\text{-}(Time)_t\text{-}Z$; t represents an integer of 0 or 1; and Z represents a group which becomes a slightly mobile dye or a precursor thereof after being released from $\text{-}(Time)_t\text{-}Z$.

14 Claims, No Drawings

COLOR LIGHT-SENSITIVE MATERIAL

FIELD OF THE INVENTION

The present invention relates to a color photographic light-sensitive material excellent in sharpness. More particularly, the present invention relates to a color photographic light-sensitive material comprising a novel compound for forming an unsharp mask.

BACKGROUND OF THE INVENTION

As a means of providing a color image excellent in sharpness a photographic light-sensitive material for forming an unsharp mask is proposed in French Patent No. 2,260,124, and Japanese Patent Application (OPI) No. 201,246/86. Such a photographic light-sensitive material consists of at least three layers. Particularly, such a photographic light-sensitive material has an essential layer structure comprising a lamination of a physically-developable nucleus-containing layer containing a nondiffusible coupler, a layer containing a scavenger of an oxidation product of a color developing agent, and a light-sensitive silver halide emulsion layer containing a nondiffusible coupler in this order. In this process, the photographic light-sensitive material which has been exposed to light is color-developed with a first color developing solution free of silver halide solvent to obtain a color negative image. The photographic light-sensitive material thus processed is then physically color-developed with a second color developing solution containing a silver halide solvent to obtain an unsharp positive image. However, it was found that this process has some unavoidable disadvantages. That is, it was found that since at least three layers are essential, it is difficult to provide a thin lamination of such a photographic light-sensitive material, reducing the effect of improving sharpness. Such a photographic light-sensitive material is also disadvantageous in that the requirement of two color developing steps complicates the development processing, increasing the cost and prolonging the processing time.

Furthermore, another technique for forming an unsharp mask is proposed in Japanese Patent Application (OPI) No. 169,843/76 (the term "OPI" as used herein means an "unexamined published application"). That is, a photographic light-sensitive material is proposed comprising at least two layers, i.e., as a first layer, a light-sensitive silver halide emulsion layer containing a nondiffusible coupler and, as a second layer, a layer containing a nondiffusible colored compound having the same series color as the hue of said coupler which undergoes reaction with an oxidation product of a developing agent so that the reaction product is eluted from the photographic layer upon development. In this process, when an oxidation product of a developing agent is formed in the light-sensitive silver halide emulsion layer containing a coupler, a part of the oxidation product diffuses into the second layer where it reacts with said nondiffusible colored compound present therein so that said nondiffusible colored compound is decolored to obtain an unsharp positive image. In this process, the degree of improvement in sharpness is related to the density and gradation of the unsharp positive image, and hence to the amount of the oxidation product of the developing agent diffused into the second layer. In order to increase the amount of the oxidation product of the developing agent diffused into the second layer, it is necessary to increase the amount of the oxidation product of the developing agent formed in the light-sensitive silver halide emulsion layer. However, it was found that the horizontal diffusion of the oxidation product of the developing agent cannot be ignored. That is, such a photographic light-sensitive material was found disadvantageous in that the more the amount is of the horizontal diffusion of the oxidation product of a developing agent, the more the expansion is of dye clouds formed by the coloring of the coupler present in the layer, thereby reducing the effect of the improving sharpness and deteriorating graininess.

Moreover, a further technique for forming an unsharp mask is proposed in Japanese Patent Application (OPI) Nos. 25,756/87 and 35,355/87. In this process, a dye which shows a proper diffusion during processing or an alkaline unstable precursor thereof and a nondiffusible coupler are used in combination. However, this process was found disadvantageous in that the dye diffuses not only during development but also during storage at a high temperature and humidity after formation of images, causing color stain.

Thus, all the conventional techniques for forming an unsharp mask leave much to be desired in practical sense. Thus, a perfect resolution has long been desired

SUMMARY OF THE INVENTION

It is therefore an object of the present invention to provide a color photographic light-sensitive material excellent in sharpness comprising a novel compound for forming an unsharp mask.

The above and other objects of the present invention will become more apparent from the following detailed description and examples.

These objects of the present invention are accomplished with a color light sensitive material, which comprises a support having thereon at least a light-sensitive silver halide, an image-forming coupler, and a compound represented by formula (I):

$$\mathrm{PWR}\text{-}(\mathrm{Time})_t\text{-}Z \qquad (I)$$

wherein PWR represents a group which undergoes reduction to release $\text{-}(\mathrm{Time})_t\text{-}Z$; Time represents a group which releases Z through a reaction after being released as $\text{-}(\mathrm{Time})_t\text{-}Z$; t represents an integer of 0 or 1; and Z represents a group which becomes a slightly mobile dye or a precursor thereof after being released from $\text{-}(\mathrm{Time})_t\text{-}Z$.

DETAILED DESCRIPTION OF THE INVENTION

The group represented by PWR may be any of: (1) the group that corresponds to a moiety containing an electron accepting center and an intramolecular nucleophilic displacement center in a compound capable of releasing a photographic reagent through reduction followed by intramolecular nucleophilic displacement as disclosed in U.S. Pat. Nos. 4,139,379, 4,139,389 and 4,564,577 and Japanese Patent Application (OPI) No. 185333/84 and 84453/82; (2) the group that corresponds to a moiety containing an electron accepting quinoid center and a carbon atom connecting the quinoid center to a photographic reagent in a compound capable of releasing a photographic reagent through reduction followed by intramolecular electron transfer as disclosed in U.S. Pat. No. 4,232,107, Japanese Patent Application (OPI) No. 101649/84, Research Disclosure, No. 24025, IV (1984), and Japanese Patent Application (OPI) No. 88257/86; (3) the group that corresponds to a moiety containing an aryl group substituted with an electron attractive group and an atom (a sulfur, carbon or nitrogen atom) connecting the substituted aryl group to a photographic reagent in a compound capable of releasing a photographic reagent through reduction followed by cleavage of its single bond as disclosed in West German Patent Application (OLS) No. 3,008,588, Japanese Patent Application (OPI) No. 142530/81, and U.S. Pat. Nos. 4,343,893 and 4,619,884; (4) the group that corresponds to a moiety containing a nitro group and a carbon atom connecting the nitro group to a photographic reagent in a nitro compound capable of releasing a photographic reagent after electron acceptance as disclosed in U.S. Pat. No. 4,450,223; and (5) the group that corresponds to a moiety containing a gem-dinitro group and a carbon atom connecting the dinitro group to a photographic reagent in a dinitro compound capable of $\beta$-eliminating a photographic reagent after electron acceptance as disclosed in U.S. Pat. No. 4,609,610.

The groups represented by $\text{-(Time)}_t$- will be described later.

Of the compounds represented by formula (I), preferred are those represented by formula (II):

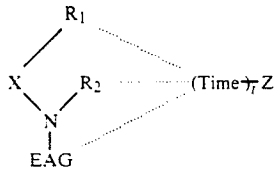

(II)

wherein X represents an oxygen atom, a sulfur atom or a nitrogen-containing group of formula —N($R_3$)—; $R_1$, $R_2$, and $R_3$ each represents a mere bond or a group other than a hydrogen atom; EAG represents an electron accepting group; or $R_1$, $R_2$, $R_3$ and EAG are connected to each other to form a ring; Time represents a group capable of releasing Z upon cleavage of the N—X bond through a reaction subsequent to the release from the rest of the compound in the form of $\text{-(Time)}_t$-; Z and t are as defined above; and the dotted lines represent possible bonds, provided that at least one dotted line is a bond.

In formula (II),

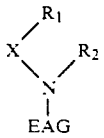

corresponds to PWR of formula (I). $\text{-(Time)}_t$-Z is bonded to at least one of $R_1R_2$, and EAG.

The group other than a hydrogen atom as represented by $R_1$, $R_2$, and $R_3$ includes a substituted or unsubstituted alkyl or aralkyl group (e.g., methyl, trifluoromethyl, benzyl, chloromethyl, dimethylaminomethyl, ethoxycarbonylmethyl, aminomethyl, acetylaminomethyl, ethyl, 2-(4-dodecanoylaminophenyl)ethyl, carboxyethyl, allyl, 3,3,3-trichloropropyl, n-propyl, isopropyl, n-butyl, isobutyl, sec-butyl, t-butyl, n-pentyl, sec-pentyl, t-pentyl, cyclopentyl, n-hexyl, sec-hexyl, t-hexyl, cyclohexyl, n-octyl, sec-octyl, t-octyl, n-decyl, n-undecyl, n-dodecyl, n-tetradecyl, n-pentadecyl, n-hexadecyl, sec-hexadecyl, t hexadecyl, n-octadecyl, and t-octadecyl groups), a substituted or unsubstituted alkenyl group (e.g., vinyl, 2-chlorovinyl, 1-methylvinyl, 2-cyanovinyl, and cyclohexen-1-yl groups), a substituted or unsubstituted alkynyl group (e.g., ethynyl, 1-propynyl, and 2-ethoxycarbonylethynyl groups), a substituted or unsubstituted aryl group (e.g., phenyl, naphthyl, 3-hydroxyphenyl 3-chlorophenyl, 4-acetylaminophenyl, 4-hexadecanesulfonylaminophenyl, 2-methanesulfonyl-4-nitrophenyl 3-nitrophenyl, 4-methoxyphenyl, 4-acetylaminophenyl, 4-methanesulfonylphenyl, 2,4-dimethylphenyl, and 4-tetradecyloxyphenyl groups), a substituted or unsubstituted heterocyclic group (e.g., 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzothiazolyl, 2-benzimidazolyl, 2-benzoxazolyl, 2-oxazolin-2-yl, and morpholino groups), a substituted or unsubstituted acyl group (e.g., acetyl, propionyl, butyroyl, isobutyroyl, 2,2 dimethylpropionyl, benzoyl, 3,4-dichlorobenzoyl, 3-acetylamino-4-methoxybenzoyl, 4-methylbenzoyl, and 4-methoxy-3-sulfobenzoyl groups), a substituted or unsubstituted sulfonyl group (e.g., methanesulfonyl, ethanesulfonyl, chloromethanesulfonyl, propanesulfonyl, butanesulfonyl, n-octanesulfonyl, n-dodecanesulfonyl, n-hexadecanesulfonyl, benzenesulfonyl, 4-toluenesulfonyl, and 4-n-dodecyloxybenzenesulfonyl groups), a substituted or unsubstituted carbamoyl group (e.g., carbamoyl, methylcarbamoyl, dimethylcarbamoyl, bis(2-methoxyethyl)carbamoyl, diethylcarbamoyl, cyclohexylcarbamoyl, di-n-octylcarbamoyl, 3-dodecyloxypropylcarbamoyl, hexadecylcarbamoyl, 3-(2,4-di-t-pentylphenoxy)propylcarbamoyl, 3-octanesulfonylaminophenycarbamoyl, and di-n-octadecylcarbamoyl groups), a substituted or unsubstituted sulfamoyl group (e.g., sulfamoyl, methylsulfamoyl, dimethylsulfamoyl, diethylsulfamoyl, bis(2-methoxyethyl)sulfamoyl, di-n-butylsulfamoyl, methyl-n-octylsulfamoyl, n-hexadecylmethylsulfamoyl, 3-ethoxypropylmethylsulfamoyl, N-phenyl-N-methylsulfamoyl, 4-decyloxyphenylsulfamoyl, and methyloctadecylsulfamoyl group), and the like.

$R_1$ and $R_3$ each preferably represents a substituted or unsubstituted alkyl, alkenyl, alkynyl, aryl, heterocyclic, acyl or sulfonyl group, etc. $R_1$ and $R_3$ each preferably contains 1 to 40 carbon atoms.

$R_2$ preferably represents a substituted or unsubstituted acyl or sulfonyl group (specific examples include those listed above for $R_1$and $R_3$) and preferably contains 1 to 40 carbon atoms.

$R_1$, $R_2$, $R_3$, and EAG may be taken together to form a ring.

EAG will be described later.

More preferred among the compounds represented by formula (II) are those represented by formula (III):

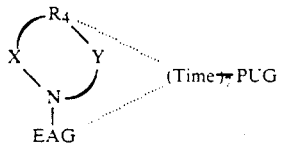

(III)

wherein Y represents a divalent linking group, and preferably

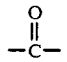

or —$SO_2$—; $R_4$ represents an atom group forming a 5- to 8- membered nitrogen-containing monocyclic or condensed heterocyclic ring together with X and Y; X, t, EAG, Time, PUG, and the dotted lines are as defined above.

In formula (III),

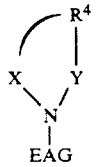

corresponds to PWR in formula (I), and $\leftarrow$Time$\rightarrow_t$PUG is bonded to at least one of $R_4$ and EAG.

Specific and preferred examples of the heterocyclic ring formed by X, Y, $R_4$, and N are shown below.

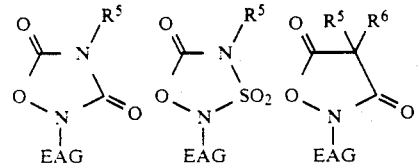

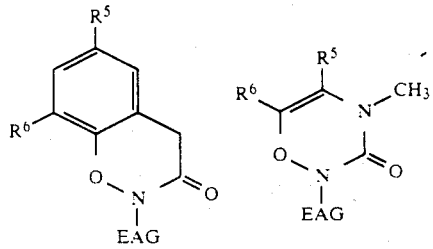

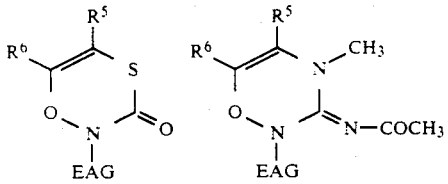

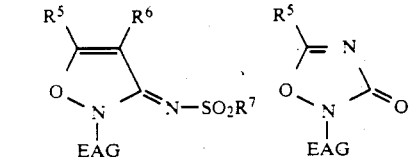

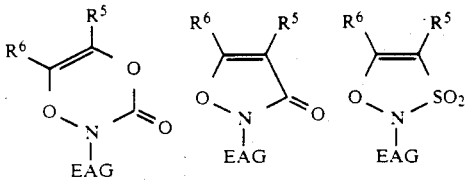

-continued

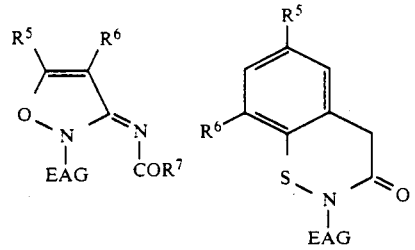

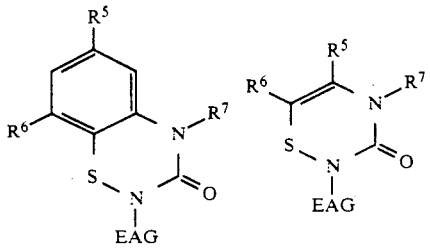

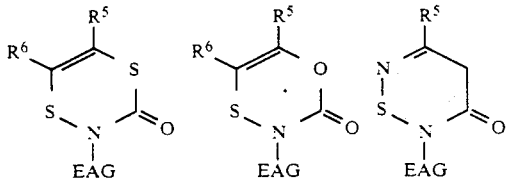

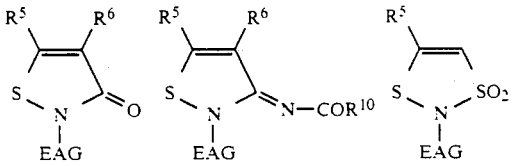

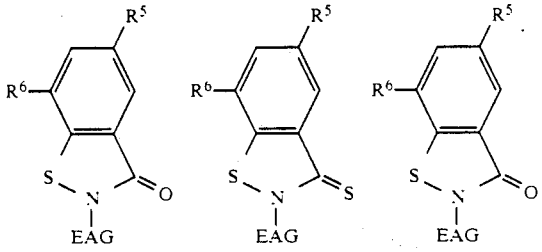

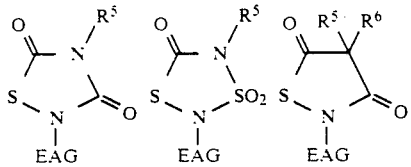

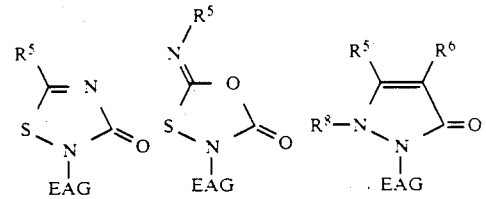

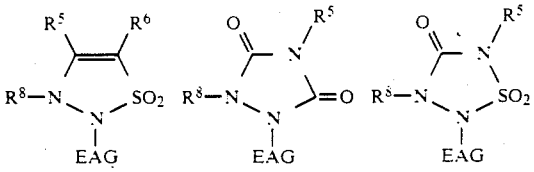

-continued

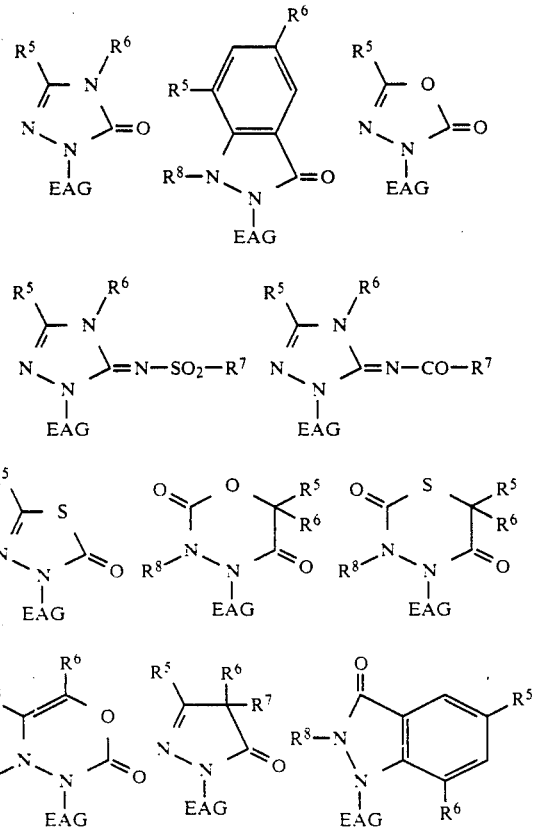

In these formulae, $R^5$, $R^6$, and $R^7$ each is preferably a hydrogen atom, alkyl group, aryl group, or heterocyclic group. $R^8$ is preferably an acyl group or sulfonyl group. Specific examples of these groups include those described with reference to $R^1$ and $R^3$.

Further preferred examples of these groups will be shown below, including the position at which $\text{-(Time)}_t\text{-Z}$ is connected thereto. However, the present compounds should not be construed as being limited to these examples.

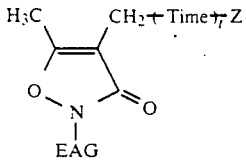

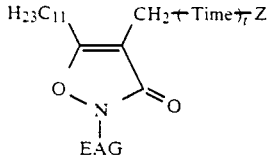

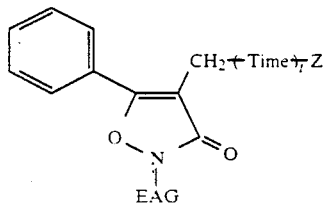

-continued

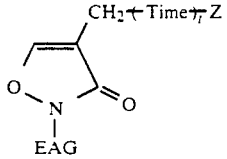

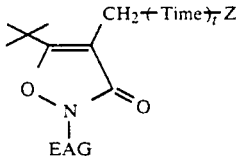

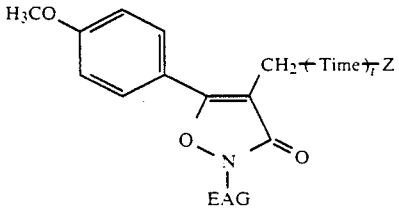

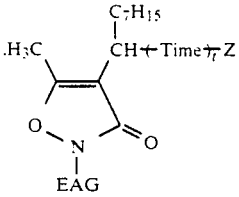

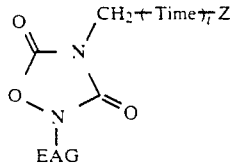

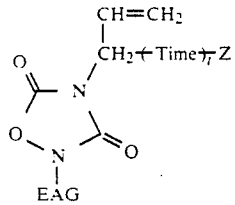

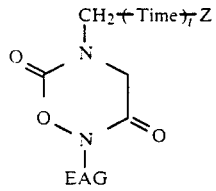

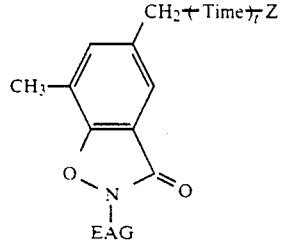

-continued

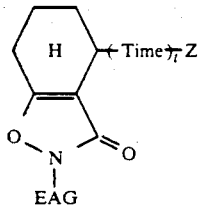

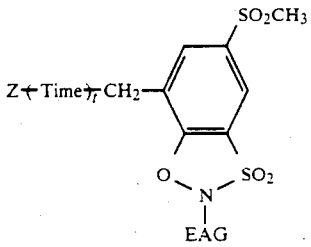

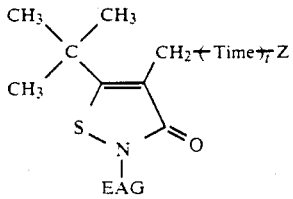

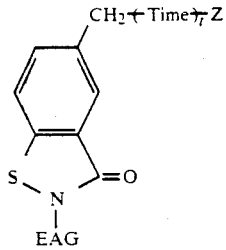

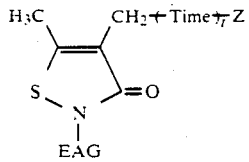

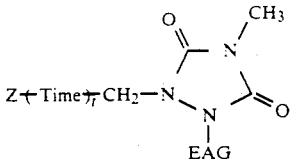

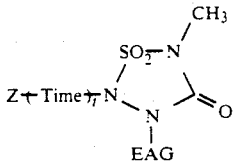

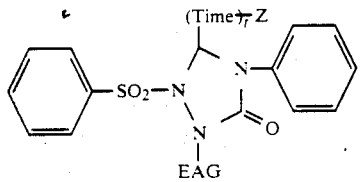

-continued

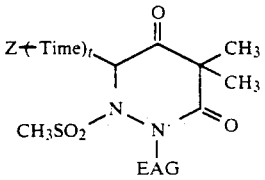

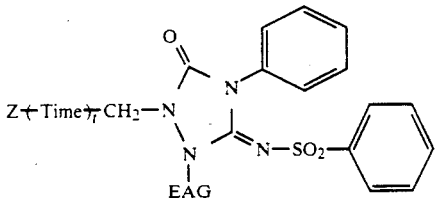

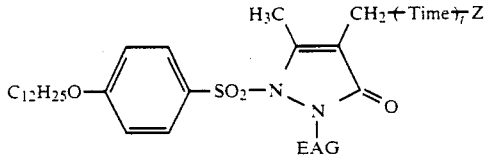

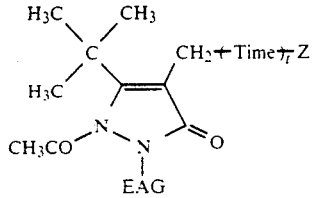

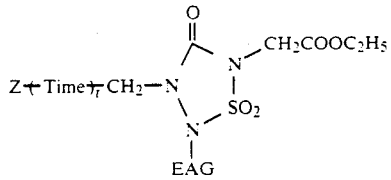

These groups will be further described later with reference to specific examples thereof.

EAG is preferably a group represented by formula (A) or (B):

(A)

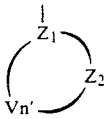

(B)

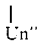

In formula (A), $Z_1$ represents

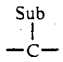

or —N<.

Vn′ represents an atomic group which forms a 3- to 8-membered ring with $Z_1$ and $Z_2$. The suffix n′ represents an integer of 3 to 8.

When n′ is 3, 4, 5, 6, 7, or 8, Vn′ is $—Z_3—$, $—Z_3—Z_4—$, $—Z_3—Z_4—Z_5—$, $—Z_3—Z_4—Z_5—Z_6—$, $Z_3—Z_4—Z_5—Z_6—Z_7—$, and $—Z_3—Z_4—Z_5—6—Z_7—Z_8—$, respectively. $Z_2$ to $Z_8$ each represents

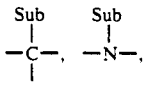

—O—, —S—, or Sub-$SO_2$—. Sub represents a mere bond ($\pi$ bond), hydrogen atom, or substituent as described hereinafter. These Sub's may be the same or different. If there are plural Sub's, they may be connected to each other to form a 3- to 8-membered saturated or unsaturated carbon ring or heterocycle. In formula (A), Sub is selected such that the sum of Hammett's constant op of substituents is +0.09 or more, preferably +0.3 or more, particularly +0.45 or more.

In formula (B), n'' represents an integer of 1 to 6. When n'' is 1, 2, 3, 4, 5, or 6, Un'' is $—Y_1$, $—Y_1—Y_2$, $—Y_1—Y_2—Y_3$, $—Y_1—Y_2—Y_3—Y_4$, $—Y_1—Y_2—Y_3—Y_4$ $—Y_5$, or $Y_1—Y_2—Y_3—Y_4—Y_5—Y_6$, respectively. $Y_1$to $Y_6$ each represents

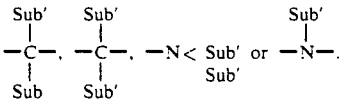

Sub' represents a mere bond ($\sigma$ bond or $\pi$ bond), hydrogen atom, or substituent described later. In formula (B), Sub' is selected such that the sum of Hammett's constant $\sigma p$ of substituents is +0.09 or more, preferably +0.3 or more, particular +0.45 or more.

Examples of substituents represented by Sub and Sub' include substituted or unsubstituted alkyl groups such as methyl group, ethyl group, sec-butyl group, t-octyl group, benzyl group, clyclohexyl group, chloromethyl group, dimethylaminomethyl group, n-hexadecyl group, trifluoromethyl group, 3,3,3-trichloropropyl group, and methoxycarbonymethyl group; substituted or unsubstituted alkenyl groups such as vinyl group, 2-chlorovinyl group, and 1-methylvinyl group; substituted or unsubstituted alkynyl groups such as ethynyl group and 1-propynyl group; cyano group; nitro group; halogen atoms such as fluorine, chlorine, bromine, and iodine; substituted or unsubstituted heterocyclic residues such as 2-pyridyl group, 1-imidazolyl group, benzothiazol-2-yl group, morpholino group, and benzoxazol-2-yl group; sulfo group; carboxyl group; substituted or unsubstituted aryloxycarbonyl or alkoxycarbonyl groups such as methoxycarbonyl group, ethoxycarbonyl group, tetradecyloxycarbonyl group, 2-methoxyethylocarbonyl group, phenoxycarbonyl group, 4-cyanophenylcarbonyl group, and 2-chlorophenoxycarbonyl group; substituted or unsubstituted carbamoyl groups such as carbamoyl group, methylcarbamoyl group, diethylcarbamoyl group, methylhexadecylcarbamoyl group, methyloctadecylcarbamoyl group; phenylcarbamoyl group, 2,4,6-trichlorocarbamoyl group, N-ethyl-N-phenylcarbamoyl group, and 3-hexadecylsulfamoylphenylcarbamoyl group; hydroxyl group, substituted or unsubstituted azo groups such as phenylazo group, p-methoxyphenylazo group, and 2-cyano-4-methanesulfonylazo group; substituted or unsubstituted aryloxy or alkoxy group such as methoxy group, ethoxy group, dodecyloxy group, benzyloxy group, phenoxy group, 4-methoxyphenoxy group, 3-acetylaminophenoxy group, 3-methoxycarbonylpropyloxy group, and 2-trimethylammonioethoxy group; sulfino group; sulfeno group; mercapto group; substituted or unsubstituted acyl groups such as acetyl group, trifuoroacetyl group, n-butyloyl group, t-butyloyl group, benzoyl group, 2-carboxybenzoyl group, 3-nitrobenzoyl group, and formyl group; substituted or unsubstituted aryl- or alkylthio groups such as methylthio group, ethylthio group, t-octylthio group, hexadecylthio group, phenylthio group, 2,4,5-trichlorothio group, 2-methoxy-5-t-octylphenylthio group, and 2-acetylaminophenylthio group;, substituted or unsubstituted aryl groups such as phenyl group, naphthyl group, 3-sulfophenyl group, 4-methoxyphenyl group, and 3-laurylaminophenyl group; substituted or unsubstituted sulfonyl groups such as methylsulfonyl group, chloromethylsulfonyl group, n-octylsulfonyl group, n-hexadecylsulfonyl group, sec-octylsulfonyl group, p-toluenesulfonyl group, 4-chlorophenylsulfonyl group, 4-dodecylphenylsulfonyl group, 4-dodecyloxyphenylsulfonyl group, and 4-nitrophenylsulfonyl group; substituted or unsubstituted sulfinyl groups such as methylsulfinyl group, dodecylsulfinyl group, phenylsulfinyl group, and 4-nitrophenylsulfinyl group; substituted or unsubstituted amino group such as methylamino group, diethylamino group, methyloctadecylamino group, phenylamino group, ethylphenylamino group, 3-tetradecylsulfamoylphenylamino group, acetylamino group, trifluoroacetylamino group, N-hexadecylacetylamino group, N-methylbenzoylamino group, methoxycarbonylamino group, phenoxycarbonylmethyl group, N-methoxyacetylamino group, amidiamino group, phenylaminocarbonylamino group, 4-cyanophenylaminocarbonylamino group, N-ethylethoxycarbonylamino group, N-methyldodecylsulfonylamino group, N-(2-cyanoethyl)-p-toluenesulfonylamino group, and hexadecylsulfonylamino group; substituted or unsubstituted sulfamoyl groups such as dimethylsulfamoyl group, hexadecylsulfamoyl group, sulfamoyl group, methyloctadecylsulfamoyl group, methylhexadecylsulfamoyl group, 2-cyanoethylhexadecylsulfamoyl group, phenylsulfamoyl group, N-(3,4-dimethylphenyl)-N-octylsulfamoyl group, dibutylsulfamoyl group, dioctadecylsulfamoyl group, and bis(2-methoxycarbonylethyl)sulfamoyl group; substituted or unsubstituted acyloxy groups such as acetoxy group, benzoyloxy group, decyloyloxy group, and chloroacetoxy group; and substituted or unsubstituted sulfonyloxy groups such as methylsulfonyloxy group, p-toluenesulfonyloxy group, and p-chlorophenylsulfonyloxy group. These groups each preferably contains up to 40 carbon atoms.

Specific examples of EAG include aryl groups substituted by at least one electron attractive group, such as 4-nitrophenyl group, 2 nitro-4-N methyl-N-octadecylsulfamoylphenyl group, 2-N,N-dimethylsulfamoyl-4-nitrophenyl group, 2-cyano-4-octadecylsulfonylphenyl group, 2,4-dinitrophenyl group, 2,4,6-tricyanophenyl group, 2-nitro-4-N-methyl-N-octadecylcarbamoylphenyl group, 2-nitro-5-octylthiophenyl group, 2,4-dimethanesulfonylphenyl group, 3,5-dinitrophenyl group, 2-chloro-4-nitro-5 methylphenyl group, 2-nitro-3,5-dimethyl-4-tetradecylsulfonylphenyl group, 2,4-dinitronaphthyl group, 2-ethylcarbamoyl-4-nitrophenyl group, 2,4-bis-dodecylsulfonyl-5-trifluoromethylphenyl group, 2,3,4,5,6-pentafluorophenyl group, 2-acetyl-4-nitrophenyl group, 2,4-diacetylphenyl group, and 2 nitro-4-trifluoromethylphenyl group; substituted or unsubstituted heterocyclic groups such as 2-pyridyl group, 2-pyrazyl group, 5-nitro-2-pyridyl group, 5-N-hexadecylcarbamoyl-2-pyridyl group, 4-pyridyl group, 3,5-dicyano-2-pyridyl group, 5-dodecylsulfonyl-2-pyridyl group, 5-cyano-2-pyrazyl group, 4-nitrothiophen-2-yl group, 5-nitro-1,2-dimethylimidazol-4-group, 3,5-diacetyl-2-pyridyl group, and 1-dodecyl-5-carbamoylpyridinium-2-yl group; and substituted or unsubstituted quinones such as 1,4-benzoquinon-2-yl group, 3,5,6-trimethyl-1,4-benzoquinon-2-yl group, 3-methyl-1,4-naphthoquinon-2-yl group, 3,6-dimethyl-5-hexadecylthio-1,4-benzoquinon-2-yl group, and 5-pentadecyl-1,2-benzoquinon-4-yl group. Besides these vinylogs, examples of EAG include nitroalkanes and α-diketo compounds.

$\text{-}(\text{Time})_t\text{-}Z$ will be further described hereinafter.

Time represents a group which releases Z through a reaction triggered by nitrogen-oxygen single bond cleavage. The suffix t represents an integer of 0 or 1.

Examples of the group represented by Time include known groups as described in Japanese Patent Application (OPI) Nos. 147,244/86, 236,549/86 and 215270/87.

Examples of the dye represented by Z include azo dyes, azomethine dyes, indoaniline dyes, indophenol dyes, anthraquinone dyes, triarylmethane dyes, alizarin dyes, nitro dyes, quinoline dyes, indigoid dyes, and phthalocyanine dyes. Other examples of such dyes include leuco compounds of these dyes, dyes whose adsorption wavelength has been temporarily shifted, and dye precursors. Further examples of such dyes include chelatable dyes.

Examples of the above described dyes are described in U.S. Pat. Nos. 3,880,658, 3,931,144, 3,932,380, 3,932,381, and 3,942,987, and J. Fabian and H. Hartmann, *Light Absorption of Organic Colorants*, Springer-Verlag. Dyes analogous to these dyes which have been rendered nondiffusible may be used. However, the present invention should not be construed as being limited to the above described dyes.

The group represented by Z is a group which becomes a slightly mobile dye after being cleaved from $\text{-}(\text{Time})_t\text{-}$. The term "slightly mobile" as used herein means that the dye moves so as to slightly smear. The degree of movement greatly varies with the development conditions, e.g., pH of the processing solution and processing time. However, the degree of movement of the dye can be properly controlled by the selection of substituents to be contained in Z and adjustment of the molecular weight of such substituents.

A technique employing the slight movement of a dye is described in U.S. Pat. No. 4,420,556, though this departs from the objects of the present invention.

A preferred example of the dye represented by Z is a dye which has been temporarily shifted to a shorter wavelength by blocking its chromophore by a cleavable group. That is, when the compound of formula (I) reacts with a reducing agent to cause cleavage of Z after a series of reactions, it preferably recovers its original dye to produce the original dye. For example, an azo dye may be temporarily shifted to a shorter wavelength by blocking a chromophore such as hydroxyl group, mercapto group, or amino group. Examples of a dye which can be temporarily shifted to a shorter wavelength by blocking a chromophore include compounds as described in U.S. Pat. Nos. 4,234,672, 4,310,612, 3,579,334, 3,999,991, 3,994,731, and 3,230,085.

In the present invention, a compound of formula (I) containing a dye (cyan dye) which has been temporarily shifted to a shorter wavelength and shows a maximum absorption between 600 nm and 700 nm when it recovers its original color may be preferably used in combination with a cyan coupler. Alternatively, a compound of formula (I) containing as Z a dye (magenta dye) which has been temporarily shifted to a shorter wavelength and shows a maximum absorption between 500 nm and 600 nm when it recovers its original color may be used in combination with a magenta coupler.

Similarly, a dye which shows a maximum absorption between 400 nm and 500 nm when it recovers its original color may be used in combination with a yellow coupler.

Particularly preferred examples of Z as a dye which has been temporarily shifted to a shorter wavelength will be shown below.

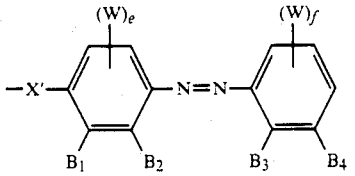

(D-1)

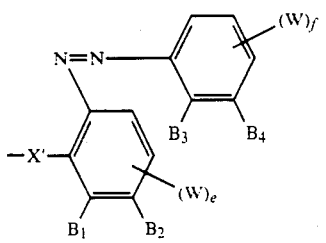

(D-2)

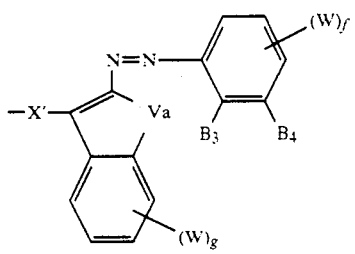

(D-3)

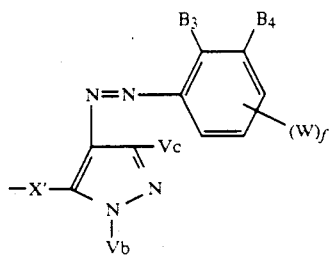

(D-4)

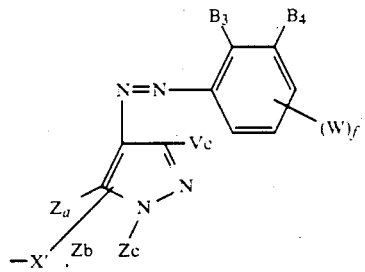

(D-5)

-continued (D-6)

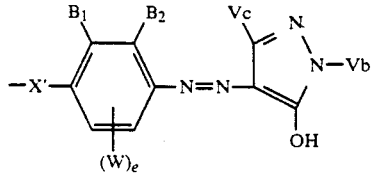

(D-7)

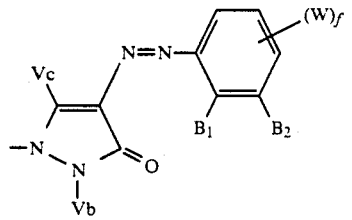

In the above formulae, X' represents —0—, —S— or —NH— and is connected to $\leftarrow$Time$\rightarrow_t$ in formula (I) via a free bond.

Va represents an imino group which may contain substitutents such as sulfur atom, oxygen atom, or aliphatic groups.

W represents aliphatic groups (such as methyl group and butyl group), aromatic groups (such as phenyl group and naphthyl group), acyl groups (such as acetyl group and benzoyl group), alkoxycarbonyl groups (such as methoxycarbonyl group and octyloxycarbonyl group), aryloxycarbonyl groups (such as phenoxycarbonyl group and naphthyloxycarbonyl group), acylamino groups (such as tetradecaneamide group, benzamide group, and 2,2-dimethylpropaneamide group), alkylthio groups (such as methylthio group and octylthio group), arylthio groups (such as phenylthio group and p-t-butylphenylthio group), sulfonyl groups (such as methanesulfonyl group and benzenesulfonyl group), halogen atoms (such as chlorine atom, fluorine atom, and bromine atom), nitro group, nitroso group, cyano group, carboxyl group, hydroxyl group, sulfonamide groups (such as methanesulfonamide group, benzenesulfonamide group, and octanesulfonamide group), alkoxy groups (such as methoxy group and dodecyloxy group), aryloxy groups (such as phenoxy group and p-nonylphenoxy group), acyloxy groups (such as acetoxy group and benzoyloxy group), carbamoyl groups (such as butylcarbamoyl group and N,N-diethylcarbamoyl group), amino groups (such as N,N-dioctylamino group and pyrrolidino group), ureide groups (such as 3-phenylureide group and 3-ethylureide group), sulfamoyl groups (such as N-methyl-N-butylsulfamoyl group and N-propylsulfamoyl group), or 3- to 7-membered heterocyclic groups containing hetero atoms selected from nitrogen atom, oxygen atom and sulfur atom (such as pyridyl group, imidazoyl group, and furyl group).

If Z contains a plurality of substituents represented by W in one molecule thereof, the plurality of W's may be the same or different.

e represents an integer of 0 to 2; f represents an integer of 0 to 3; and g represents an integer of 0 to 4. If e, f or g represents an integer of 2 or more, the plurality of W's may be the same or different.

$B_1$, $B_2$, $B_3$ and $B_4$ each represents hydrogen atom or a substituent as described with reference to W or may be connected to each other to form a benzene condensed ring. If $B_1$, $B_2$, $B_3$ and $B_4$ together form a benzene condensed ring, it may be substituted by a substituent represented by W.

Vb represents an aliphatic hydrocarbon residue, aryl group, or heterocyclic residue. If Vb represents an aliphatic hydrocarbon residue, it may be a saturated or unsaturated, straight-chain, branched, or cyclic group. Vb is preferably a $C_{1-22}$, more preferably $C_{1-12}$ alkyl group (such as methyl group, ethyl group, isopropyl group, butyl group, dodecyl group, octadecyl group, and cyclohexyl group) or alkenyl group (such as allyl group and octynyl group).

Preferred examples of such an aryl group include phenyl group and naphthyl group. Preferred examples of such a heterocyclic residue include pyridinyl, quinolinyl, thienyl, piperidyl, and imidazolyl.

Examples of substituents to be contained in these aliphatic hydrocarbon residues, aryl groups, and heterocyclic residues include those described with reference to W.

Vc represents a $C_{1-22}$, preferably $C_{1-12}$ straight-chain or branched alkyl group, alkenyl group, cyclic alkyl group, aralykyl group, cyclic alkenyl group, aryl group, heterocyclic group, alkoxycarbonyl group (such as methoxycarbonyl group and decyloxycarbonyl group), aryloxycarbonyl group (such as phenoxycarbonyl group and naphthoxycarbonyl group,) aralkyloxycarbonyl group (such as benzyloxycarbonyl group), alkoxy group (such as methoxy group, ethoxy group, and octyloxy group), arylamino group (such as anilino group and 2 chloroanilino group), aryloxy group (such as phenoxy group and tolyloxy group), acylamino group (such as acetylamino group and 3-acetoxyamidobenzamide group), diacylamino group, N-alkylacylamino group (such as N-methylpropionamide group), N-arylacylamino group (such as N-phenylacetamide group), ureide group (such as ureide group, N-arylureide group, and N-alkylureide group), alkylamino group (such as n-butylamino group, methylamino group, and cyclohexylamino group), cycloamino group (such as piperidino group and pyridino group), or sulfonamide group (such as alkylsulfonamide groups and arylsulfonamide groups). These groups may contain substituents as described with reference to W.

Vc also may represent a halogen atom (such as chlorine atom and bromine atom) or cyano group.

Za, Zb and Zc each represents methine group, substituted methine group, =N—, or —NH—. One of Za—Zb bond and Zb—Zc bond is a double bond, and the other is a single bond. However, Za, Zb and Zc are not nitrogen atoms at the same time. If Zb—Zc is a carbon-carbon double bond, it may form a part of an aromatic ring. This aromatic ring may contain substituents as described with reference to W.

Any one of Za, Zb and Zc may be connected to X' to form —X'—C=.

The dye represented by Z may be a group which becomes a colored coupler after being cleaved from $(\text{Time})_t$. Such a colored coupler is used for color negative in the conventional color photographic system and is normally used for color correction by masking. In the present invention, when Z becomes a colored coupler after being cleaved from $\leftarrow$Time$\rightarrow_t$, it may react with an oxidation product of a developing agent produced at developed silver halide portions. The resulting azomethine dye may preferably not substantially form a color or may preferably be eluted into the developing solution in the present invention. The colored coupler produced at undeveloped portions, i.e., positive working forms unsharp positive images. That is, the amount of cleavage of Z from $\leftarrow$Time$\rightarrow_t$ and the amount of reaction of Z in the form of a colored coupler with an oxidation product of a developing agent vary in proportion to the degree of exposure, i.e., the produced amount of the oxidation product of a developing agent and the amount of reducing substances. These reactions adjust the contrast of the unsharp positive images.

Examples of the group represented by Z which becomes a colored coupler include those represented by the foregoing formulae (D-1) to (D-7).

Specific examples of the compound represented by formula (I) to be used in the present invention will be shown hereinafter, but the present invention should not be construed as being limited thereto.

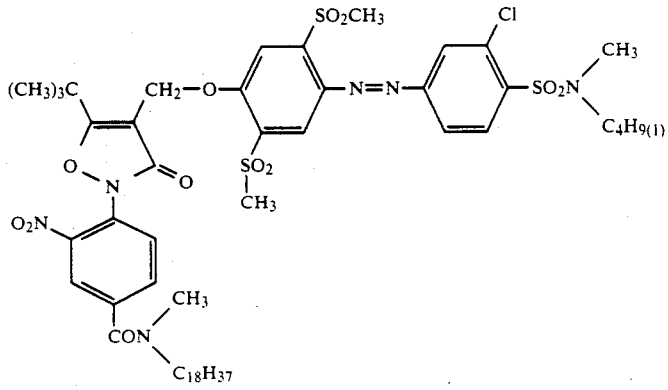

(2)

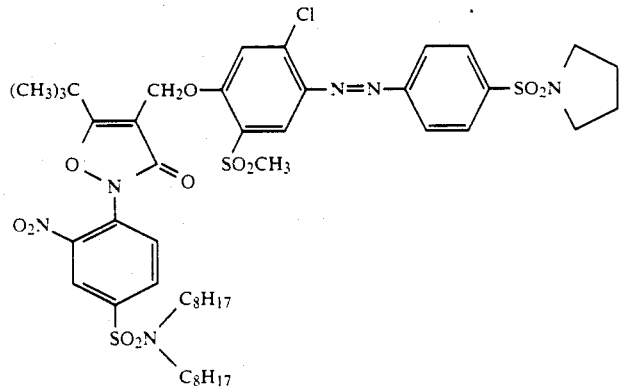

(3)

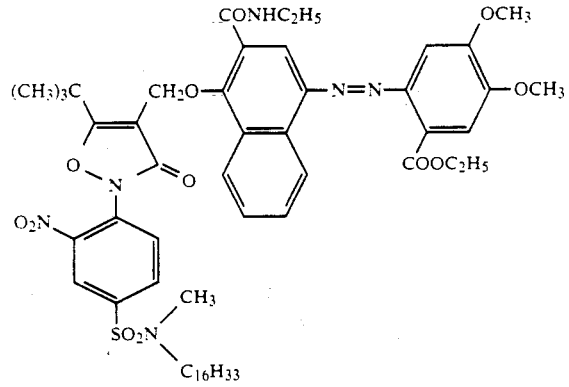

(4)

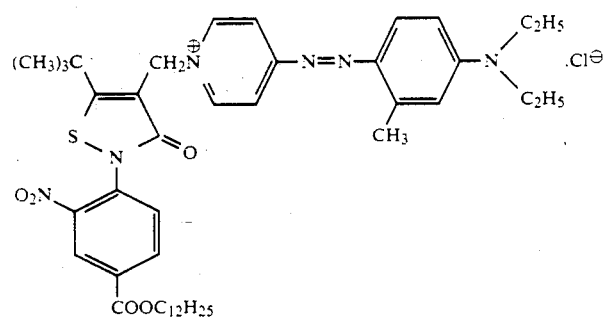

-continued
(5)
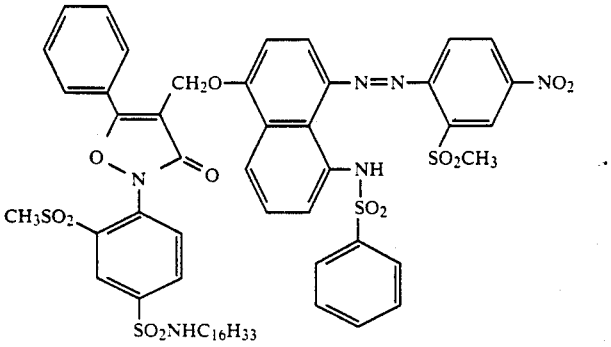
(6)
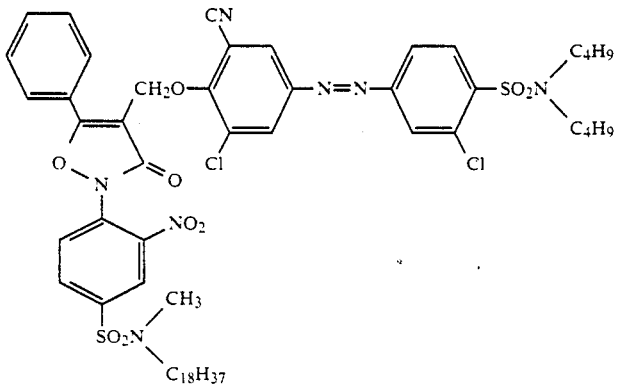
(7)
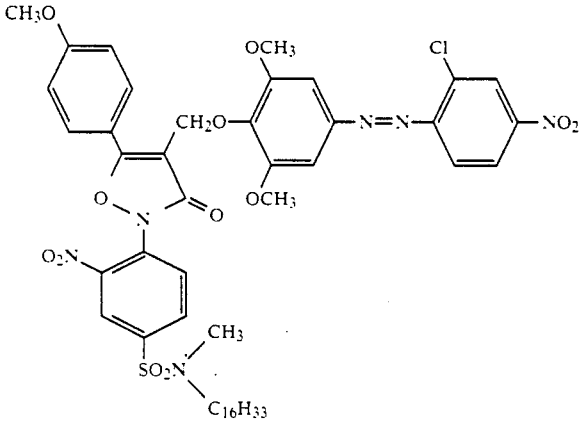
(8)
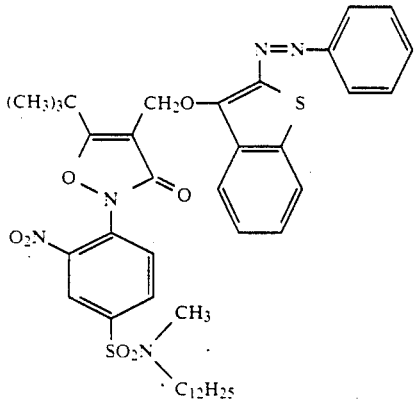

-continued
(9)
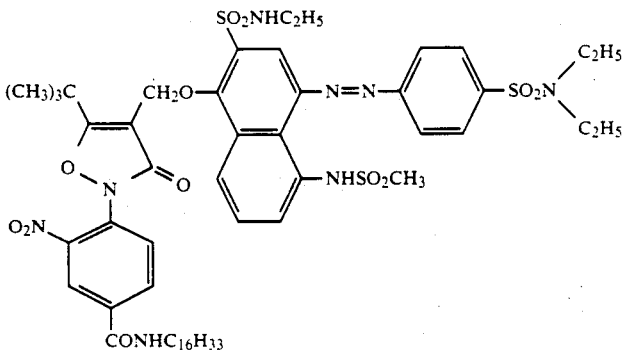
(10)
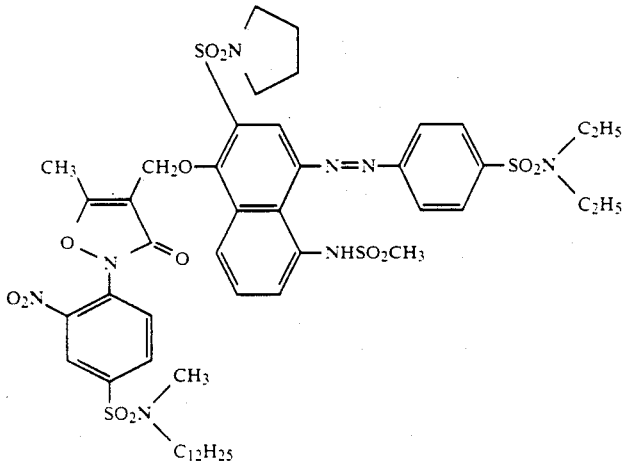
(11)
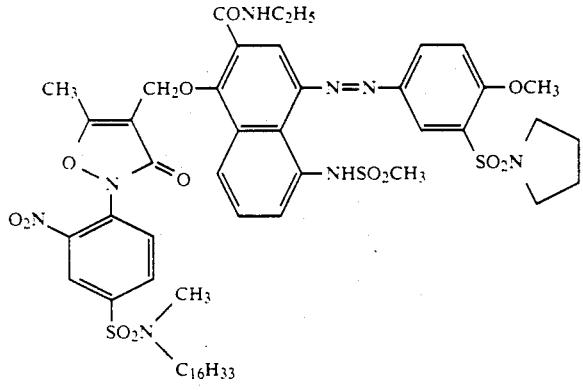
(12)
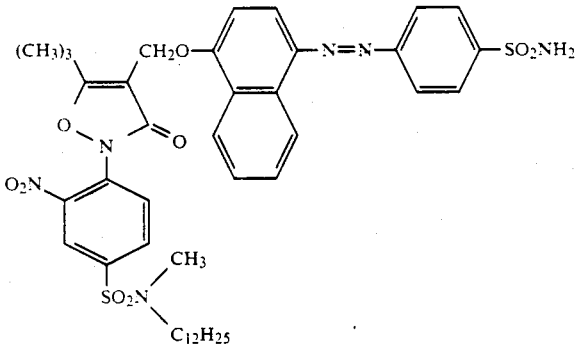

-continued
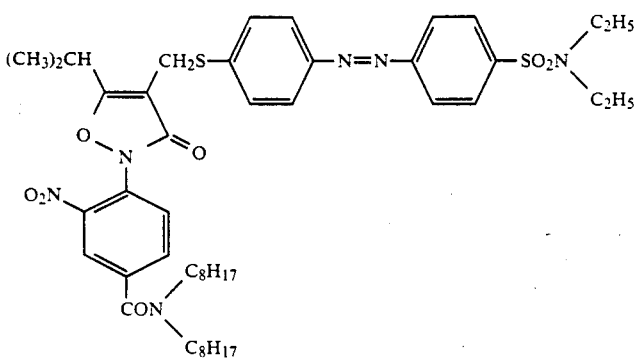
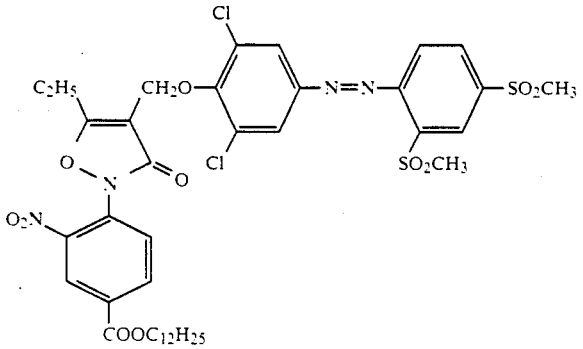
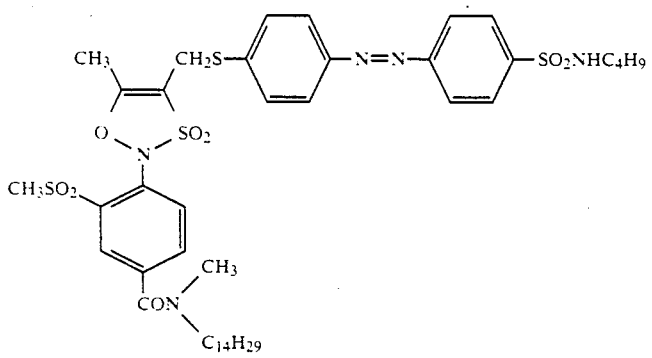
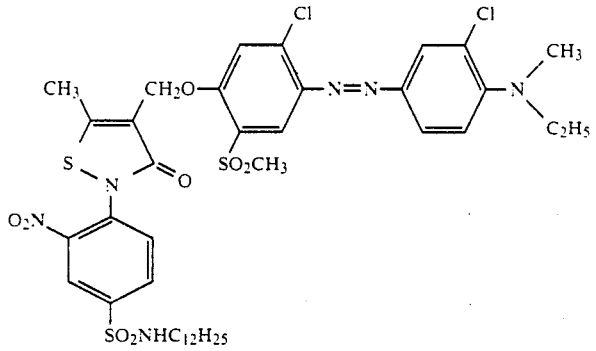

-continued
(17)
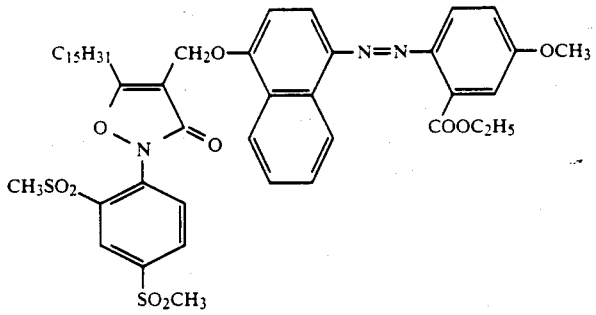
(18)
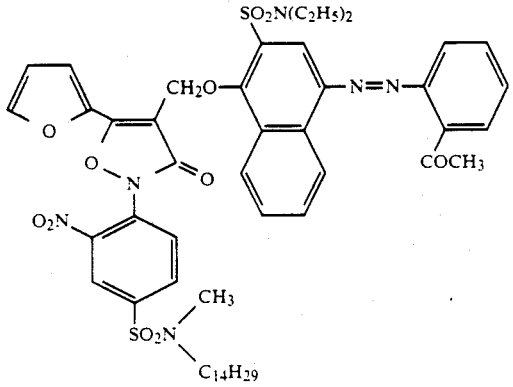
(19)
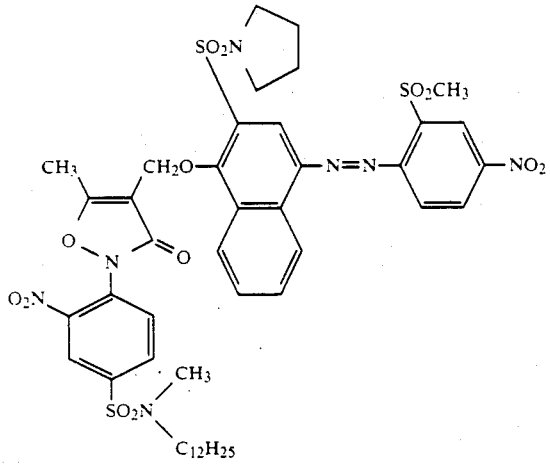
(20)
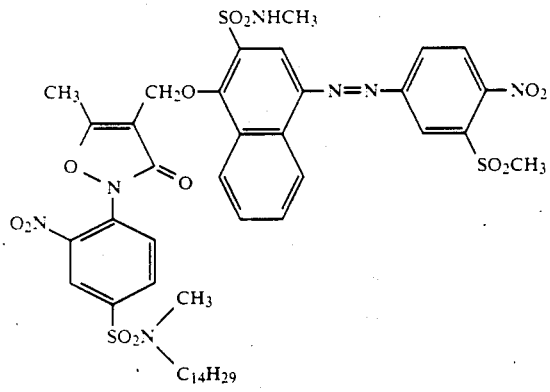

-continued (21)

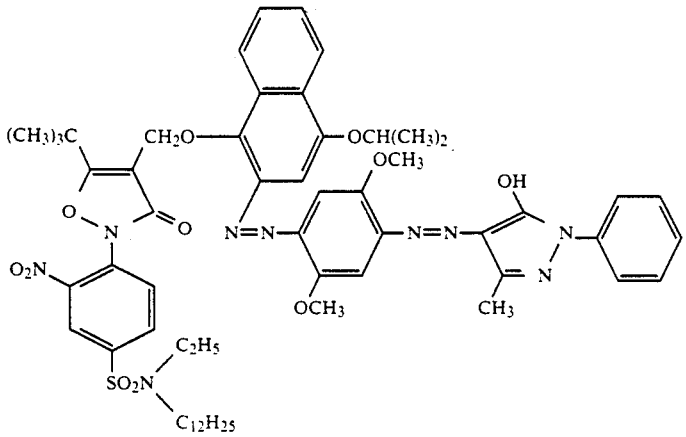

(22)

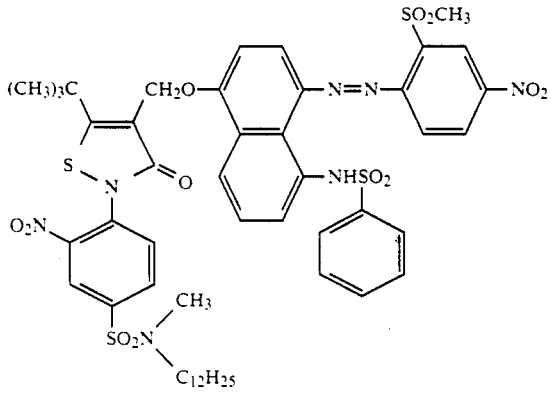

(23)

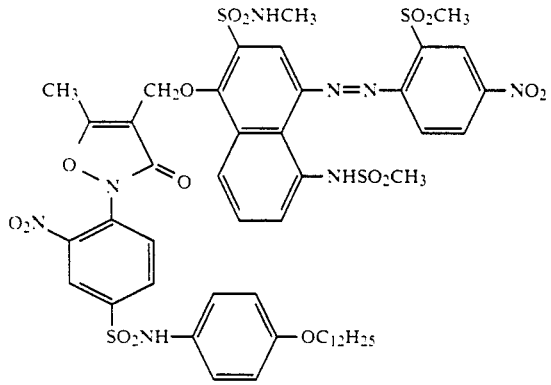

The process for the synthesis of the compound of the present invention will be further described hereinafter.

The synthesis of the portion represented by PWR in the compound represented by formula (I) can be accomplished by any suitable method as described in patents cited with reference to PWR, such as U.S. Pat. Nos. 4,139,389, 4,139,379, 4,564,577, 4,232,107, 4,343,893, 4,619,884, 4,450,223, and 4,609,610, Japanese Patent Application (OPI) Nos. 185,333/84, 84,453/82, 101,649/84, 88,257/86, and 142,530/81, *Research Disclosure* No. 24,025 (Vol. IV, 1984), and German Patent Application (OLS) No. 3,008,588.

The connection of PWR to $\text{-(Time)}_t\text{-Z}$ can be accomplished by any suitable method as described in the above described patents or described later.

The process for the synthesis of the compound represented by formula (II) will be further described hereinafter.

The general process for the synthesis of a compound represented by formula (II) will be described hereinafter by the kind of an X atom (oxygen, sulfur, or nitrogen) connected to the nitrogen atom.

First, a general method for production of the compounds of the formula (II), in which X is an oxygen atom, is described below.

For the production of the compounds of this kind, the most significant point resides in the process of binding the nitrogen-oxygen group moiety and the electron-accepting group moiety. The binding process includes two different methods which are (1) a method in which a nitro group is introduced into the electron-accepting moiety and then reduced with a zinc ammonium chloride series reagent to give a hydroxylamine and the resulting hydroxylamine is bound with the $\text{—(Time)}_t\text{—Z}$ moiety; and (2) a method in which a group which is easily substitutable (such as a halogen atom) is introduced into the electron-accepting group moiety and the group is substituted by a hydroxylamine or an equivalent group thereof by nucleophilic displacement. Regarding the method (1), the compounds of the formula (II) can be produced in accordance with the method described in S. P. Sandler & W. Karo, *Organic Functional Group Preparations.* Regarding the method (2), the production of the compounds of the formula (II) can be attained by reaction of the starting compounds in ethanol, dimethylformamide or dimethyl sulfoxide under a neutral or basic condition.

Next, a general method for the production of the compounds of formula (II), in which X is a sulfur atom and the nitrogen-sulfur bond is not contained in the hetero ring structure, is set forth below. The method includes the following two process routes (A) and (B).

The (A) route comprises producing a sulfenamide from a sulfenyl chloride and an amine and converting the thus produced sulfenamide into an N-acyl or N-sulfonylsulfenamide by utilizing the nucleophilic property of the remaining amine.

The (B) route comprises first producing an N-acylated or N-sulfonylated compound forming an anion on the nitrogen atom of the resulting compound for nucleophilic displacement reaction with a sulfenyl chloride.

Production of the sulfenyl chloride may be attained by reaction of the corresponding disulfide or thiol and chlorine or sulfuryl chloride. The disulfide can be produced mainly by displacement reaction of an alkali disulfide and a compound of $R_1$—Cl (or $R_1$—$N_2^{61}X^{63}$). For the production of the thiol, see the general production method described in Saul Patai, *The Chemistry of the Thiol Group Part I* (published by John Wiley & Sons), Chap. 4.

On the other hand, the general method for production of the compounds of the formula (II) in which the nitrogen-sulfur bond is contained in a part of the hetero ring structure includes the following two processes.

The first process comprises producing a hetero ring containing a nitrogen-sulfur bond and then binding the nitrogen atom with the electron-accepting group moiety. The production of the hetero ring is described in the known literatures, for example, *Comprehensive Heterocyclic Chemistry,* which mentions much of the production of the ring. The reaction of the resulting hetero ring with the electron-accepting group moiety can be carried out in a solvent such as ethanol, dimethylformamide or dimethyl sulfoxide under neutral or basic conditions. The other comprises ring-closure with nitrogen as bonded at the electron-accepting group moiety.

Next, a general method for production of the compounds of formula (II), in which X represents a nitrogen atom, is set forth below. This comprises the following two processes.

Method (A):

A compound having an aromatic nucleophilic displaceable electron-accepting group (such as 4-halo-3-nitrobenzenesulfonamides) is reacted with a hydrazide or sulfonylhydrazine in an aprotic polar solvent such as dimethyl sulfoxide or dimethylformamide in the presence of a base and then halomethylated, and the resulting product is bonded with Z by displacement reaction. Alternatively, if Z is reactive to hydrazine or sulfonylhydrazine, this may directly be reacted with hydrazine or sulfonylhydrazine. Thus, the compounds of the noted type can be produced.

Method (B):

A compound having an aromatic nucleophilic displaceable electron-accepting group (such as 4-halo-3-nitrobenzenesulfonamides) is reacted with a heterocyclic compound having an N-N single bond in which any one of the nitrogen atoms of the bond is dissociative in an aprotic polar solvent in the same manner as Method (A), so as to bond the electron-accepting group to the nitrogen atom of the hetero ring. Selection of the above-mentioned heterocyclic compounds by utilizing the reaction can be associated with the release of Z, as shown in some examples of the aforesaid compounds for use in the present invention.

In order to give better understanding of the above described general synthesis, specific examples of such synthesis will be described hereinafter.

SYNTHESIS EXAMPLE (1)

Synthesis of Exemplary Compound (1)

(1-1) Synthesis of 3-t-butyl-5-pyrazolidone 1.0 kg of ethyl pivaloylacetate was dissolved in 2.5 l of ethanol. 320 g of hydrated hydrazine was added dropwise to the solution while being cooled with ice. After the dropwise addition was completed, the reaction mixture was allowed to undergo reaction overnight at room temperature. 5.0 l of water was added to the reaction system with stirring. The resulting crystals were filtered off under reduced pressure, washed thoroughly with water, washed with a small amount of methanol, and then air-dried. Yield: 812 g

(1-2) Synthesis of 4,4-dibromo-3-t-butyl-5-pyrazolidone 658 g of 3-t-butyl-5-pyrazolidone was dissolved in 2.0 l of acetic acid. 1.5 kg of bromine was added dropwise to the solution with stirring while being cooled with ice. After the dropwise addition was completed, the reaction system was allowed to undergo reaction overnight. 5.0 l of water was then added to the reaction system. The resulting crystals were filtered off under reduced pressure, washed thoroughly with water, washed with a small amount of methanol, and then air-dried. Yield: 1.36 kg

(1-3) Synthesis of 4,4-dimethyl-2-penthiolic acid 552 g of sodium hydroxide was dissolved in 3.0 l of water. Ice was then added to the solution to keep the temperature thereof at 5° C or lower. Dibromo-3-t-butyl-5-pyrazolidone was then gradually added to the reaction system with stirring while the temperature thereof was kept at 5° C. or lower. After the reaction was completed, the reaction system was acidified with 6 N hydrochloric acid, and then extracted twice with ethyl acetate.

The solution thus extracted was dried with anhydrous sodium sulfate. The ethyl sulfate was removed under reduced pressure. The residual oil was 4,4-dimethyl-2-penthiolic acid. The oil thus produced was not purified before being used for the subsequent reaction.

(1-4) Synthesis of 4,4-dimethyl-2-penthiolic chloride 466 g of 4,4-dimethyl-2-penthiolic acid was admixed with 3.5 l of methylene chloride with stirring. 483 g of thionyl chloride was then added to the solution. After the reaction mixture was allowed to undergo reaction for 1 hour, the reaction system was heated under reflux.

As a result, hydrogen chloride gas was vigorously produced. The heating under reflux continued for 2 hours. The solvent was then removed. The residual material was distillated under reduced pressure. The desired product was a colorless liquid having a boiling point of about 70° C./20 mmHg. Yield: 290 g (1-5) Synthesis of 5-t-butyl-3-hydroxyisoxazole 308 g of hydroxylamine hydrochloride was dissolved in 2.5 l of water. 176 g of sodium hydrogencarbonate was added to the solution. 290 g of 4,4-dimethyl-2-penthiolic chloride was added dropwise to the mixture with vigorous stirring while being cooled with ice to keep the temperature thereof at 5° C. or lower.

The desired product was precipitated as colorless crystals. The resulting crystals were then filtered off under reduced pressure, and washed with water. The crystals were then dissolved in 2.5 l of 2-N sodium hydroxide solution. The solution was allowed to stand at room temperature overnight. The reaction solution was then neutralized. As a result, 5-t-butyl-3-hydroxyisoxazole was precipitated as colorless crystals. Yield: 190 g (1-6) Synthesis of N-methyl-N-octadecyl-3-nitro-4-chlorobenzamide 105.7 g of 3-nitro-4-chlorobenzoic acid and 800 ml of acetonitrile were mixed. 68.6 g of thionyl chloride was added to the mixture. The reaction mixture was then heated under reflux for 4 hours. After being cooled, the solvent was removed. The residue was then dissolved in chloroform. 63.5 g of triethylamine was added to the solution. The temperature of the solution was kept at 5° C. A chloroform solution of 148.6 g of N-methyloctadecylamine was added dropwise to the solution. After the reaction was completed, the reaction system was then mixed with water for separation. The organic phase was dried over anhydrous sodium sulfate. The inorganic substances were filtered out. The solvent was then removed. The residue was recrystallized from a 1:3 mixture of acetonitrile and methanol. Yield: 186 g (1-7) Synthesis of 5-t-butyl-2-(4-N-methyl-N-octadecylcarbamoyl-2-nitrophenyl)-3-isoxazonone 300 ml of dimethylformamide was added to 68.2 g of N-methyl-N-octadecyl-3-nitro-4-chlorobenzamide, 24.8 g of 5-t-butyl-3-hydroxyisoxazole, and 24.8 g of potassium carbonate. The reaction mixture was then allowed to undergo reaction at a temperature of 100° C. for 5 hours. The solvent was removed under reduced pressure. The residue was then mixed with ethyl acetate and water with stirring. The organic phase was extracted and subjected to silica gel chromatography to separate the main product therefrom. The main product was then recrystallized from a mixture of n-hexane and ethyl acetate. Yield: 36.0 g (1-8) Synthesis of 4-chloromethyl-t-butyl-2-(4-N-methyl-N-octadecylcarbamoyl-2-nitrophenyl)-3-isoxazolone 36 g of 5-t-butyl-2-(4-N-methyl-N-octadecylcarbamoyl-2-nitrophenyl)-3-isoxazolone, 5.7 g of paraformaldehyde, and 10.3 g of zinc chloride were mixed with 250 ml of acetic acid. The reaction mixture was then allowed to undergo reaction with hydrogen chloride gas bubbled thereinto at a temperature of 100° C. for 20 hours. After the reaction was completed, the reaction system was cooled. The reaction mixture was then poured into ice water. The resulting solid was then filtered off, dissolved in chloroform, and purified by column chromatography. Yield: 22.6 g (1-9) Synthesis of Exemplary Compound (1)

4 g of 4-chloromethyl-5-t-butyl-2-(4-N-methyl-N-octadecylcarbamoyl-2-nitrophenyl)-3-isoxazolone prepared in (1-8), and 4.0 g of 4-(3-chloro-4-N-methyl-N-butylsulfamoyl)phenylazo-2,5-dimethanesulfonylphenol were dissolved in acetone. 1.4 g of potassium carbonate was added to the solution. The reaction mixture was then stirred at room temperature for 3 hours. The inorganic substances were filtered out. The residue was then recrystallized from methanol to obtain 1.2 g of a colorless crystal.

SYNTHESIS EXAMPLE (2)

Synthesis of Exemplary Compound (6)

(2-1) Synthesis of 5-phenyl-3-hydroxyisoxazole

The desired product was prepared in accordance with the method described in *Chemical and Pharmaceutical Bulletin*, Vol. 14, No. 11, pp. 1,277–1,286 (1966).

(2-2) Synthesis of 5-phenyl-2-(4-N-methyl-N-octadecylsulfamoyl-2-nitrophenyl)-3-isoxazolone 50.3 g of 2-nitro-4-N-methyl-N-octadecylsulfamoyl-1-chlorobenzene and 19.3 g of 5-phenyl-3-hydroxyisooxazole prepared in Synthesis Example 2-1 were dissolved in dimethylformamide. 16.8 g of potassium carbonate was then added to the solution. The reaction mixture was then allowed to undergo reaction at a temperature of 80° C. for 5 hours. The inorganic substances were then filtered out. The solvent was removed under reduced pressure. The residue was recrystallized from methanol. Yield: 52.2 g (2-3) Synthesis of 5-phenyl-4-chloromethyl-2-(4-N-methyl-N-octadecylsulfamoyl-2-nitrophenyl)-3-isoxazolone The synthesis of the desired product was conducted in the same manner as described in (1-8) except that 36 g of 5-t-butyl-2-(4-N-methyl-N-octadecylcarbamoyl-2-nitrophenyl)-3-isoxazolone was replaced by 39.5 g of 5-phenyl-2-(4-N-ethyl-N-octadecylsulfamoyl-2-nitrophenyl)-3-isoxazolone. Yield: 12.3 g (2-4) Synthesis of Exemplary Compound (6)

5.2 g of 2-chloro-6-cyano-4-(3-chloro-4-N,N-dibutylsulfamoyl)phenylazophenol was dissolved in 200 ml of dried tetrahydrofuran. 0.6 g of t-butoxy potassium was added to the solution. The mixture was then stirred at room temperature for 30 minutes. 50 ml of tetrahydrofuran solution containing 6.8 g of 5-phenyl-4-chloromethyl-2-(4-N-methyl-N-octadecylsulfamoyl-2-nitrophenyl)-3-isoxazolone prepared in (2-3) was added dropwise to the solution. The reaction system was then allowed to undergo reaction for 30 minutes and then for 15 minutes under heating at a temperature of 60° C. The reaction system was subjected to an ordinary after-treatment. The reaction solution was then purified by column chromatography to obtain 2.9 g of the desired product (Exemplary Compound (6)).

The synthesis of the coupler to be used in the present invention can be accomplished by any suitable method as described in the following patents or analogous methods. Such synthesis methods are described in U.S. Pat. Nos. 4,022,620, 3,973,968, 4,314,023, 4,046,575, 4,182,630, 4,146,396, 4,248,961, 3,894,875, 3,933,501, 3,615,506, 3,935,015, 4,241,168, 3,772,002, 3,227,554, 3,958,993, 3,933,500, and 4,149,886, and *Research Disclosure*, No. 180,531.

The image-forming coupler to be used in the present invention will be further described hereinafter.

The image-forming coupler to be used in the present invention is a compound which undergoes a coupling reaction with an oxidation product of a developing agent to form a dye. This dye is preferably any one of yellow, magenta and cyan. The image-forming coupler may form other dyes such as black. In order to reproduce full color, a yellow coupler, a magenta coupler, and a cyan coupler are used in combination.

The image-forming coupler to be used in the present invention is preferably nondiffusible itself. The dye produced by the image-forming coupler is preferably nondiffusible, too. Examples of such a coupler include dyes which form a slightly diffusible dye as described in U.S. Pat. Nos. 4,522,915 and 4,420,556.

Examples of nondiffusible yellow couplers include acylacetamide type couplers and malondiamide type couplers. Examples of nondiffusible magenta couplers include 5-pyrazolone type couplers, pyrazoloimidazole type couplers, and pyrazolotriazole type couplers. Examples of nondiffusible cyan couplers include phenol type couplers and naphthol type couplers. These couplers may be two-equivalent or four-equivalent.

Preferred examples of couplers to be used in the present invention include couplers represented by formulae (Cp-1), (Cp-2), (Cp-3), (Cp-4), (Cp-5), (Cp-6), (Cp-7), and (Cp-8) shown below.

(Cp-1)

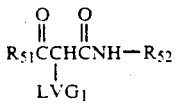

(Cp-2)

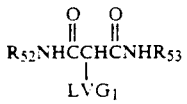

(Cp-3)

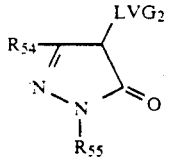

(Cp-4)

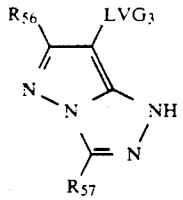

(Cp-5)

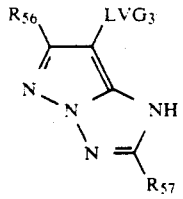

-continued (Cp-6)

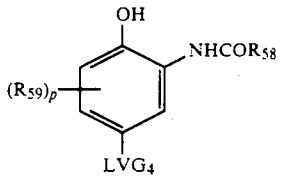

(Cp-7)

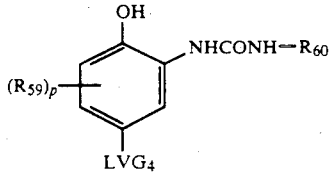

(Cp-8)

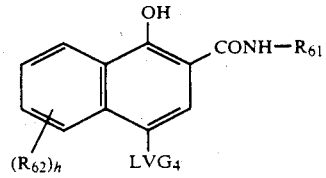

$R_{51}$ to $R_{62}$, $LVG_1$ to $LVG_4$, p and h wyll be further described hereinafter.

In the above described formulae, if $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $LVG_1$, $LVG_2$, $LVG_3$, or $LVG_4$ contains a nondiffusible group, it is selected such that the total number of carbon atoms contained therein is 8 to 40, preferably 12 to 32. Otherwise, the total number of carbon atoms contained in such a substituent is preferably 15 or less. If the coupler is a bis type, telomer type, or polymer type coupler, any one of the above described substituents represents a divalent group which connects repeating units. In this case, the total number of carbon atoms in the substituent may depart from the above specified range.

In the following description $R_{41}$ represents an aliphatic group, aromatic group, or heterocyclic group, $R_{42}$ represents an aromatic group or heterocyclic group, and $R_{43}$, $R_{44}$ and $R_{45}$ each represents a hydrogen atom, aliphatic group, aromatic group, or heterocyclic group.

$R_{51}$ has the same meaning as $R_{41}$. $R_{52}$ and $R_{53}$ each has the same meaning as $R_{42}$. $R_{54}$ has the same meaning as $R_{41}$ or represents an $$R_{41}CON(R_{43})-,\quad R_{41}N(R_{43})-,\quad R_{41}SO_2N(R_{43})-,\quad R_{41}S-,\quad R_{43}O-,$$

$$R_{45}NCON(R_{43})(R_{44})-,\quad R_{41}OOC-,\quad R_{44}NCO(R_{43})-,$$

or N≡C— group. $R_{55}$ has the same meaning as $R_{41}$. $R_{56}$ and $R_{57}$ each has the same meaning as $R_{43}$ or represents an $R_{41}S$—, $$R_{43}O(R_{43})-,\quad R_{41}CON(R_{43})-,\quad R_{41}N(R_{43})-,$$

$$R_{41}OCONR_{43}(R_{44})NCON(R_{45})-,\quad \text{or}\quad R_{41}SO_2N(R_{43})-$$

group. $R_{58}$ has the same meaning as $R_{41}$. $R_{59}$ has the same meaning as $R_{41}$ or represents an $R_{41}CON(R_{43})-$, $R_{41}OCON(R_{43})-$, $R_{41}SO_2N(R_{43})-$, $R_{43}NCON(R_{44})(R_{45})-$, $R_{41}S-$, or $R_{41}N(R_{43})-$ group, or a halogen atom. The suffix p represents an integer of 0 to 3. When p is a plural number, the plurality of $R_{59}$'s represent the same or different substituents. The plurality of $R_{59}$'s may be divalent groups which are connected to each other to form a cyclic structure. Examples of such divalent groups forming a cyclic structure include groups represented by the following formulae:

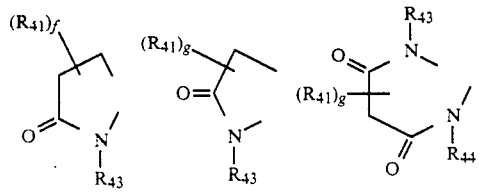

wherein f represents an integer of 0 to 4; and g represents an integer of 0 to 2.

$R_{60}$ has the same meaning as $R_{41}$; $R_{61}$ has the same meaning as $R_{41}$; $R_{62}$ has the same meaning as $R_{41}$ or represents an $R_{41}CONH-$, $R_{41}OCONH-$, $R_{41}SO_2NH-$, $R_{43}NCON(R_{44})(R_{45})-$, $R_{43}NSO_2N(R_{44})(R_{45})-$, $R_{43}O-$, $R_{41}S-$, or $R_{41}N(R_{43})-$ group or a halogen atom; and h represents an integer of 0 to 4, with the proviso that when there are a plurality of $R_{62}$'s, they may be the same or different.

In the above description, the aliphatic group is a $C_{1-40}$, preferably $C_{1-22}$ saturated or unsaturated, chain or cyclic, straight-chain or branched, substituted or unsubstituted aliphatic hydrocarbon group. Typical examples of such an aliphatic hydrocarbon group include methyl group, ethyl group, propyl group, isopropyl group, butyl group, (t)-butyl group, (i)-butyl group, (t)-amyl group, hexyl group, cyclohexyl group, 2-ethylhexyl group, octyl group, 1,1,3,3-tetramethylbutyl group, decyl group, dodecyl group, hexadecyl group, and octadecyl group.

The aromatic group is $C_{6-20}$, preferably substituted or unsubstituted phenyl group, or substituted or unsubstituted naphthyl group.

The heterocyclic group is a $C_{1-20}$, preferably $C_{1-7}$ substituted or unsubstituted 3- to 8-membered heterocyclic group containing hetero atoms selected from nitrogen, oxygen and sulfur. Typical examples of such a heterocyclic group include 2-pyridyl group, 4-pyridyl group, 2-thienyl group, 2-furyl group, 2-imidazolyl group, pyradinyl group, 2-pyrimidinyl group, 1-imidazolyl group, 1-indolyl group, phthalimide group, 1,3,4-thiadiazol-2-yl group, benzoxazol-2-yl group, 2-quinolyl group, 2,4-dioxo-1,3- imidazolidin-5-yl group, 2,4-dioxo-1,3-imidazolidin-3-yl group, succinimide group, phthalimide group, 1,2,4-triazol-2-yl group, and 1-pyrazolyl group.

If the above described aliphatic hydrocarbon group, aromatic group or heterocyclic group contains substituents, typical examples of such substituents include a halogen atom, $R_{47}O-$ group, $R_{46}S-$ group, $R_{47}CON(R_{48})-$ group, $R_{47}NCO(R_{48})-$ group, $R_{46}OCON(R_{47})-$ group, $R_{46}SO_2N(R_{47})-$ group, $(R_{46})(R_{47})C{=}N-$ group, $R_{47}NSO_2(R_{48})-$ group, $R_{46}SO_2-$ group, $R_{47}OCO-$ group, $R_{47}NCON(R_{48})(R_{49})-$ group, $(R_{47})(R_{48})N-$ group, groups having the same meaning as $R_{46}$,

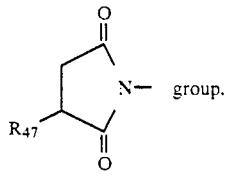

$R_{46}COO-$ group, $R_{47}OSO_2-$ group, cyano group, and nitro group. $R_{46}$ represents an aliphatic group, aromatic group, or heterocyclic group, and $R_{47}$, $R_{48}$, and $R_{49}$ each represents an aliphatic group, aromatic group, heterocyclic group, or hydrogen atom. The aliphatic group, aromatic group, or heterocyclic group has the same meanings as defined above.

Preferred examples of $R_{51}$ to $R_{62}$, p and h will be further described hereinafter.

$R_{51}$ is preferably an aliphatic group or aromatic group.

$R_{52}$, $R_{53}$ and $R_{55}$ each is preferably an aromatic group.

$R_{54}$ is preferably an $R_{41}CONH-$ group or $R_{41}-N(R_{43})-$ group.

$R_{56}$ and $R_{57}$ each is preferably an aliphatic group, $R_{41}O-$ group, or $R_{41}S-$ group.

$R_{58}$ is preferably an aliphatic group or aromatic group.

In formula (Cp-6), $R_{59}$ is preferably a chlorine atom, aliphatic group, or $R_{41}CONH-$ group.

The suffix p is preferably 1 or 2.

$R_{60}$ is preferably an aromatic group.

In formula (Cp-7), $R_{59}$ is preferably an $R_{41}CONH-$ group.

In formula (Cp-7), p is preferably 1.

$R_{61}$ is preferably an aliphatic group or aromatic group.

In formula (Cp-8), h is preferably 0 or 1.

$R_{62}$ is preferably an $R_{41}OCONH$— group, $R_{41}CONH$— group, or $R_{41}SO_2NH$— group. $R_{62}$ is preferably connected to the naphthol ring at the 5-position.

Typical examples of $R_{51}$ to $R_{62}$ will be further described hereinafter.

Typical examples of $R_{51}$ include (t)-butyl group, 4-methoxyphenyl group, phenyl group, 3-[2-(2,4-di-t-amylphenoxy)butanamide]phenyl group, 4-octadecyloxyphenyl group, and methyl group. Typical examples of $R_{52}$ and $R_{53}$ include 2-chloro-5-dodecyloxycarbonylphenyl group, 2-chloro-5-hexadecylsulfonamidephenyl group, 2-chloro-5-tetradecaneamidephenyl group, 2-chloro-5-[4-(2,4-di-t-amylphenoxy)butanamide]phenyl group, 2-chloro-5-[2-(2,4-di-t-amylphenoxy)butanamide]phenyl group, 2-methoxyphenyl group, 2-methoxy-5-tetradecyloxycarbonylphenyl group, 2-chloro-5-(1-ethoxycarbonylethoxycarbonyl)phenyl group, 2-pyridyl group, 2-chloro-5-octyloxycarbonylphenyl group, 2,4-dichlorophenyl group, 2-chloro-5-(1-dodecyloxycarbonylethoxycarbonyl)phenyl group, 2-chlorophenyl group, and 2-ethoxyphenyl group. Typical examples of $R_{54}$ include 3-[2-(2,4-di-t-amylphenoxy)butanamide]-benzamide group, 3-[4-(2,4-di-t-amylphenoxy)-butanamide]benzamide group, 2-chloro-5-tetradecaneamideanilino group, 5-(2,4-di-t-amylphenoxyacetamide)benzamide group, 2-chloro-5-dodecenylsuccinimideanilino group, 2-chloro-5-[2-(3-t-butyl-4-hydroxyphenoxy)tetradecanamide]anilino group, 2,2-dimethylpropanemimide group, 2-(3-pentadecylphenoxy)butanamide group, pyrrolidino group, and N,N-dibutylamino group. Preferred examples of $R_{55}$ include 2,4,6-trichlorophenyl group, 2-chlorophenyl group, 2,5-dichlorophenyl group, 2,3-dichlorophenyl group, 2,6-dichloro-4-methoxyphenyl group, 4-[2-(2,4-di-t-amylphenoxy)butanamide]phenyl group, and 2,6-dichloro-4-methanesulfonylphenyl group. Typical examples of $R_{56}$ include methyl group, ethyl group, isopropyl group, methoxy group, ethoxy group, methylthio group, ethylthio group, 3-phenylureide group, 3-butylureide group, and 3-(2,4-di-t-amylphenoxy)propyl group. Typical examples of $R_{57}$ include 3-(2,4-di-t-amylphenoxy)propyl group, 3-[4-{2-[4-(4-hydroxyphenylsulfonyl)phenoxy]tetradecanamide}-phenyl]propyl group, methoxy group, ethoxy group, methylthio group, ethylthio group, methyl group, 1-methyl-2-{2-octyloxy-5-[2-octyloxy-5-(1,1,3,3-tetramethylbutyl)-phenylsulfonamide]phenylsulfonamide}ethyl group, 3-{4-(4-dodecyloxyphenylsulfonamide)phenyl}propyl group, 1,1-dimethyl-2-{2-octyloxy-5-(1,1,3,3-tetramethyl)phenylsulfonamide}ethyl group, and dodecylthio group. Typical examples of $R_{58}$ include 2-chlorophenyl group, pentafluorophenyl group, heptafluoropropyl group, 1-(2,4-di-t-amylphenoxy)propyl group, 3-(2,4-di-t-amylphenoxy)propyl group, 2,4-di-t-amylmethyl group, and furyl group. Typical examples of $R_{59}$ include chlorine atom, methyl group, ethyl group, propyl group, butyl group, isopropyl group, 2-(2,4-di-t-amylphenoxy)butanamide group, 2-(2,4-di-t-amylphenoxy)-hexanamide group, 2-(2,4-di-t-octylphenoxy)octanamide group, 2-(2-chlorophenoxy)tetradecanamide group, 2,2-dimethylpropanamide group, 2-{4-(4-hydroxyphenylsulfonyl)phenoxy}tetradecanamide group, and 2-[2-(2,4-di-t-amylphenoxyacetamide)-phenoxy] butanamide group. Typical examples of $R_{60}$ include 4-cyanophenyl group, 2-cyanophenyl group, 4-butylsulfonylphenyl group, 4-propylsulfonylphenyl group, 4-ethoxycarbonylphenyl group, 4-N,N-diethylsulfamoylphenyl group, 3,4-dichlorophenyl group, and 3-methoxycarbonylphenyl group. Typical examples of $R_{61}$ include dodecyl group, hexadecyl group, cyclohexyl group, butyl group, 3-(2,4-di-t-amylphenoxy)propyl group, 4-(2,4-di-t-amylphenoxy)butyl group, 3-dodecyloxypropyl group, 2-tetradecyloxyphenyl group, t-butyl group, 2-(2-hexyldecyloxy)phenyl group, 2-methoxy-5-dodecyloxycarbonylphenyl group, 2-butoxyphenyl group, and 1-naphthyl group. Typical examples of $R_{62}$ include isobutyloxycarbonylamino group, ethoxycarbonylamino group, phenylsufonylamino group, methanesulfonamide group, butanesulfonamide group, 4-methylbenzenesulfonamide group, benzamide group, trifluoroacetamide group, 3-phenylureide group, butoxycarbonylamino group, and acetamide group.

$LVG_1$ to $LVG_4$ will be further described hereinafter.

$LVG_1$, $LVG_2$, $LVG_3$, and $LVG_4$ each represents a coupling split-off group or hydrogen atom. Preferred examples of such a coupling split-off group will be further described hereinafter.

Preferred examples of $LVG_1$ include an $R_{65}O$— group, imide group which is connected to a nitrogen atom in the coupling position (such as 2,4-dioxo-1,3-imidazolidin-3-yl group, 2,4-dioxo-1,3-oxazolidin-3-yl group, 3,5-dioxo-1,2,4-triazolidin-4-yl group, succinimide group, phthalimide group, and 2,4-dioxo 1,3-imidazolidin-1-yl group), unsaturated nitrogen-containing heterocyclic group which is connected to a nitrogen atom in the coupling position (such as 1-imidazolyl group, 1-pyrazolyl group, 1,2,4-triazol-2(or 4)-yl group, benzotriazol-1-yl group, and 3-pyrazolin-5-on-2-yl group), and $R_{66}S$— group.

Preferred examples of $LVG_2$ include an $R_{66}S$— group, unsaturated nitrogen-containing heterocyclic group which is connected to a nitrogen atom in the coupling position (such as 1-pyrazolyl group, 1-imidazolyl group, 1,2,4-triazol-2-(or 4)-yl group, benzotriazol-1-yl group, benzoimidazolyl group, and benzoindazolyl group), $R_{65}O$— group, and hydrogen atom.

Preferred examples of $LVG_3$ include a halogen atom, $R_{66}S$— group, unsaturated nitrogen-containing heterocyclic group which is connected to a nitrogen atom in the coupling position (such as 1-pyrazolyl group, 1-imidazolyl group, and benzotriazol-1-yl group), and hydrogen atom.

Preferred examples of $LVG_4$ include a halogen atom, $R_{66}O$— group, $R_{66}S$— group, and hydrogen atom.

$R_{65}$represents an aromatic group or heterocyclic group, and $R_{66}$ represents an aliphatic group, aromatic group, or heterocyclic group. The aromatic group, heterocyclic group, and aliphatic group have the same meanings as defined with reference to $R_{41}$.

When $LVG_1$, $LVG_2$ and $LVG_3$ each represents the above described heterocyclic group, they may contain substituents in substitutable positions. Typical examples of such substituents include those described with reference to the heterocyclic group represented by $R_{41}$.

Typical examples of $LVG_1$, $LVG_2$, $LVG_3$ and $LVG_4$ will be further described hereinafter.

Typical examples of $LVG_1$ include 1-benzyl-5-ethoxy-2,4-dioxo-1,3-imidazolidin-3-yl group, 1-methyl-5-hexyloxy-2,4-dioxo-1,3-imidazolidin-3-yl group, 1-phenyl-5-benzyl-2,4-dioxo-1,3,5-triazolidin-3-yl group, 5,5-dimethyl-2,4-dioxo-1,3-oxazolidin-3-yl group, 1-pyrazolyl group, 4,5-bis(methoxycarbonyl)imidazol-1-yl group, 2-phenylcarbamoyl-1,3-imidazolyl-1-yl group, 4-phenyl -carbamoly-1,3-imidazolyl-1-yl group, 6-methylxanthin-1-yl group, 4-(4-hydroxyphenylsulfonyl)phenoxy group, 4-isopropoxyphenoxy group, 4-cyanophenoxy group, 2-chloro-4-(2-chloro-4-hydroxyphenylsulfonyl)phenoxy group, 5-phenoxycarbonyl-1-benzotriazolyl group, 4-carboxyphenoxy group, and 4-(4-benzyloxyphenylsulfonyl)phenoxy group. Typical examples of $LVG_2$ include hydrogen atom, 1-pyrazolyl group, 3-chloro-5-methyl-1,2,4-triazol-2-yl group, 5-phenoxycarbonyl-1-benzotriazolyl group, 2-butoxy -5-(1,1,3,3-tetramethylbutyl)phenylthio group, 4-chloro-1-pyrazolyl group, 4-[3-(2 decyl-4-methylphenoxyacetoxy)propyl]pyrazol-1-yl group, dodecyloxycarbonyl methylthio group, 1-phenyltetrazolyl-5-thio group, and 4-dodecylsulfamoylphenoxy group. Typical examples of $LVG_3$ include chlorine atom, hydrogen atom, 4-methylphenoxy group, 4-cyanophenoxy group, 2-butoxy-5-(1,1,3,3-tetramethylbutyl)phenylthio group, 1-pyrazolyl group, and 2-(2-phenoxyethoxy)-5-(1,1,3,3-tetramethylbutyl)phenylthio group. Typical examples of $LVG_4$ include chlorine atom, hydrogen atom, 4-methoxyphenoxy group, 4-(1,1,3,3-tetramethylbutyl)-phenoxy group, 2-carboxyethylthio group, 2-(2-carboxyethylthio)ethoxy group, 1-phenyltetrazolyl-5-thio group, 1-ethyltetrazolyl-5-thio group, 3-carboxypropoxy group, 5-phenoxycarbonylbenzotriazole-1-methoxy group, 2,3-dihydroxy-4-(1-phenyltetrazolyl-5-thio)-5-propylcarbamoylphenoxy group, 2-(1-carboxytridecylthio)ethoxy group, 2-(2-methoxyethylcarbamoyl)ethoxy group, and 2-[4-(8-acetamide-1-hydroxy-3,6-disulfonaphthyl-2-azo)phenoxy]ethoxy-disodium salt.

The compound of the present invention represented by formula (I) and the couplers to be used in the present invention may optionally be polymers. That is, the present compound of formula (I) or the coupler to be used in the present invention may be a polymer derived from a monomer represented by formula (IV) containing repeating units represented by formula (V) or a copolymer with one or more noncoloring ethylenic monomers incapable of coupling with an oxidation product of an aromatic primary amine developing agent. Two or more different monomers represented by formula (IV) may be polymerized.

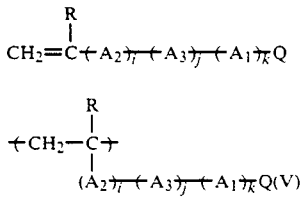

(IV)

wherein R represents a hydrogen atom, $C_{1-4}$ lower alkyl group or chlorine atom; $A_1$ represents —CONH—, —NHCONH—, —NHCOO—, —COO—, —$SO_2$—, —CO—, —NHCO—, —$SO_2$NH—, —NH$SO_2$—, —OCO—, —OCONH—, —NH— or —O—; $A_2$ represents —CONH— or —COO—; $A_3$ represents a $C_{1-10}$ substituted or unsubstituted straight-chain or branched alkylene group (such as methylene, methylmethylene, dimethylmethylene, dimethylene, trimethylene, tetramethylene, pentamethylene, hexamethylene, and decylmethylene), aralkylene group (such as benzylidene), or substituted or unsubstituted arylene group (such as phenylene and naphthylene); Q represents a compound residual group or coupler residual group represented by formula .I() which may be connected to the rest of the monomer at any position of the substituents described with reference to the compound residual group or coupler residual group; and i, j and k each represents an integer of 0 or 1, with the proviso that i, j and k are not 0 at the same time.

Examples of substituents for the alkylene group, aralkylene group or arylene group represented by $A_3$ include an aryl group (such as phenyl group), nitro group, hydoxyl group, cyano group, sulfo group, alkoxy group (such as methoxy group), aryloxy group (such as phenoxy group), acyloxy group (such as acetoxy group), acylamino group (such as acetylamino group), sulfonamide group (such as methanesulfonamide group), sulfamoyl group (such as methylsulfamoyl group), halogen atom (such as fluorine, chlorine, and bromine), carboxy group, carbamoyl group (such as methylcarbamoyl group), alkoxycarbonyl group (such as methoxycarbonyl group), and sulfonyl group (such as methylsulfonyl group). If two or more of these substituents are contained, they may be the same or different.

Examples of noncoloring ethylenic monomer which doesn't undergo coupling reaction with an oxidation product of an aromatic primary amine developing agent include acylic acid, α-chloroacrylic acid, α-alkylacrylic acid, and ester, amide, methylenebisacrylamide, vinylester, and acrylinitrile derived from these acrylic acids, aromatic vinyl compounds, maleic acid derivatives, and vinylpyridine. Two or more different such noncoloring ethylenic unsaturated monomers may be used in combination.

In the present invention, various functional couplers may be used in addition to or optionally as the above described image-forming coupler. Examples of such functional couplers which may be used in the present invention include DIR couplers as described in U.S. Pat. Nos. 3,227,554, 4,146,396, 4,248,962, 4,409,323, 4,421,845, 4,477,563, and 3,148,062; development accelerators or fogging agent-releasing couplers as described in U.S. Pat. No. 4,390,618; colored couplers as described in U.S. Pat. Nos. 4,004,929, 4,138,258, and 4,070,191; competing couplers as described in U.S. Pat. No. 4,130,427; poly-equivalent couplers as described in U.S. Pat. Nos. 4,283,472, 4,338,393, and 4,310,618; DIR redox compound-releasing couplers as described in Japanese Patent Application (OPI) No. 185,950/85; dye-releasing couplers which recover their original color after splitting-off as described in European Patent 173,302A; and couplers which do not substantially produce a dye as described in U.S. Pat. Nos. 3,958,993, 3,961,959, 4,315,070, 4,183,752, and 4,171,223.

Specific examples of the coupler to be used in the present invention will be shown hereinafter, but the present invention should not be construed as being limited thereto.

Cp-1
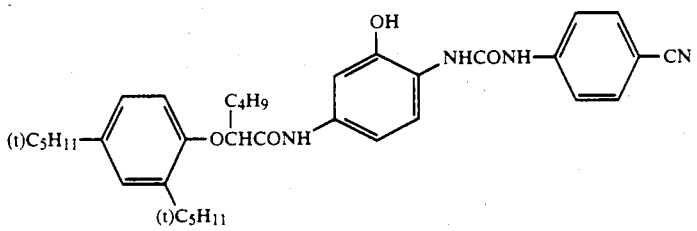
Cp-2
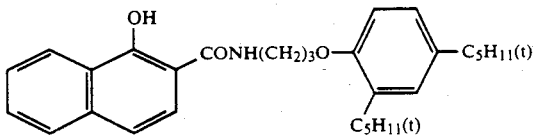
Cp-3
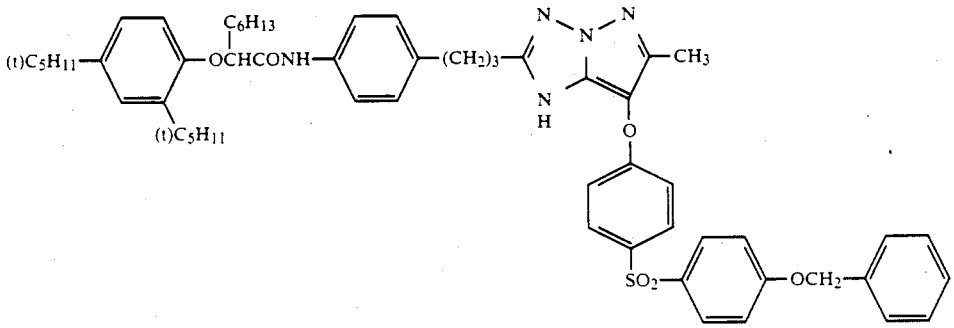
Cp-4
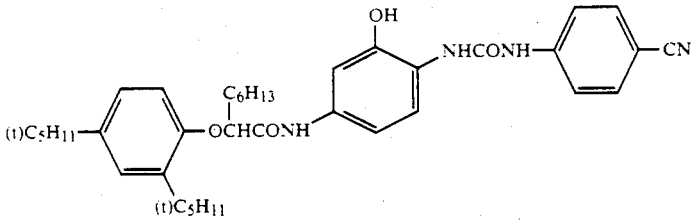
Cp-5
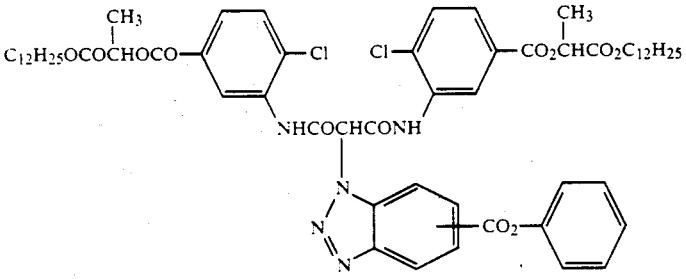
Cp-6
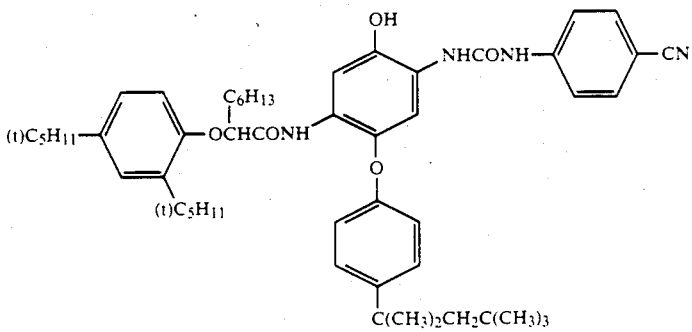

-continued
Cp-7
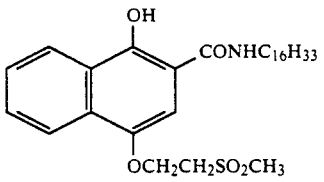
Cp-8
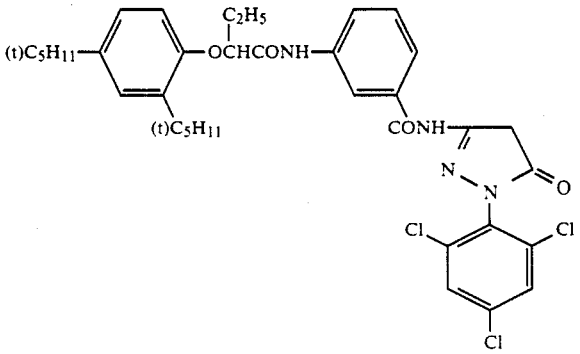
Cp-9
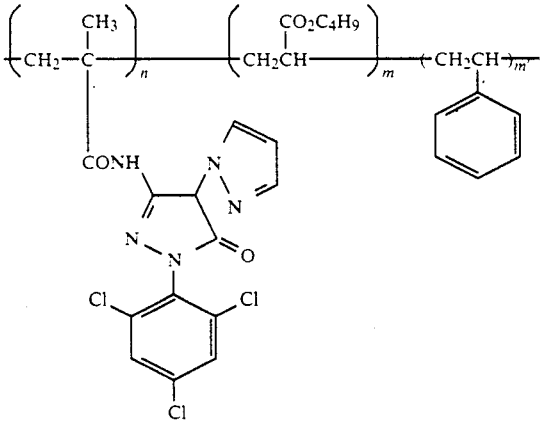
n/m/m' = 50/25/25
(Weight %)
Average molecular weight: about 20,000
Cp-10
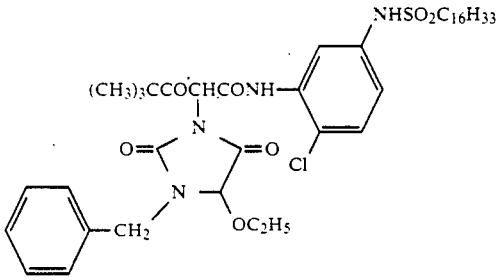
Cp-11
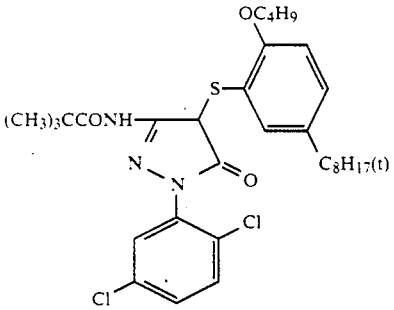

-continued
Cp-12
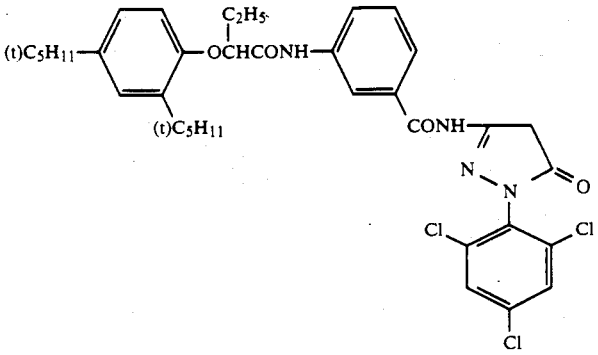
Cp-13
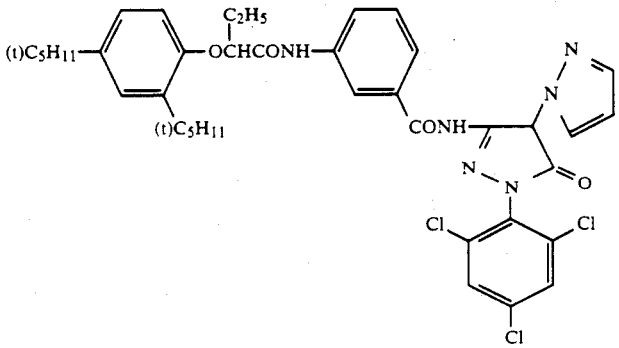
Cp-14
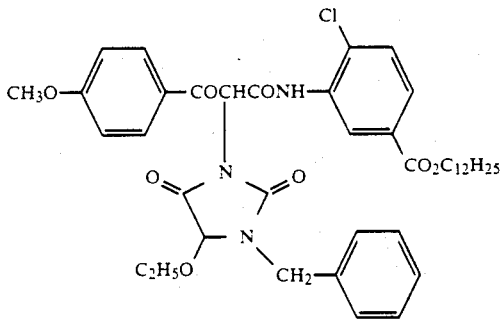
Cp-15
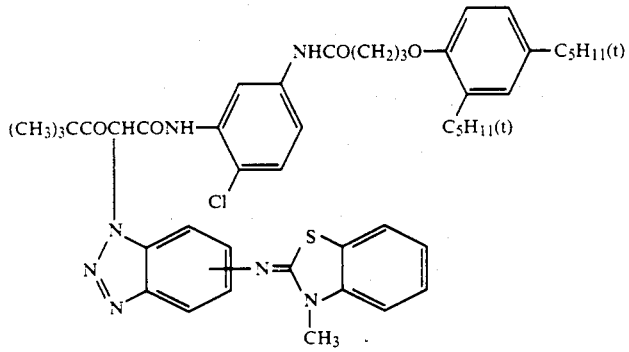
Cp-16
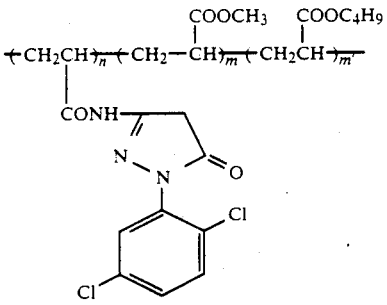

-continued
n/(m + m') = 1, m/m' = 1
(Weight ratio)
Molecular weight: about 40,000
Cp-17
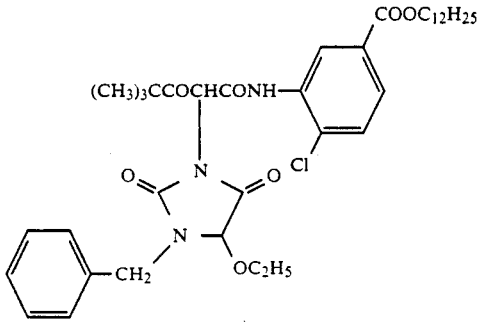
Cp-18
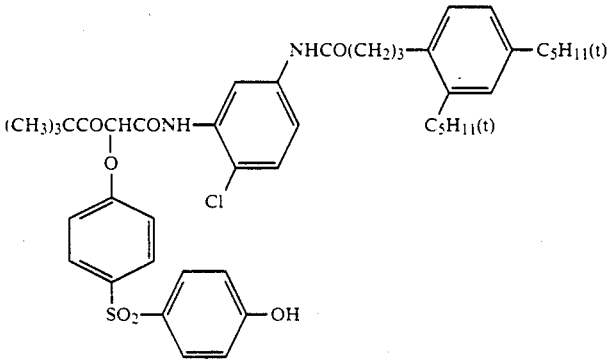
Cp-19
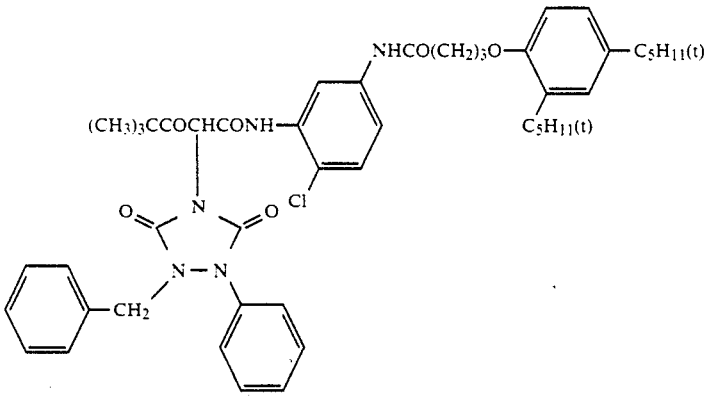
Cp-20
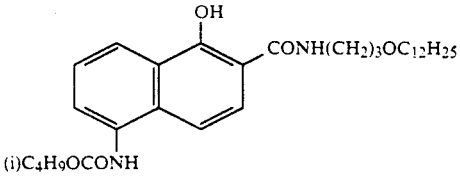

-continued
Cp-21
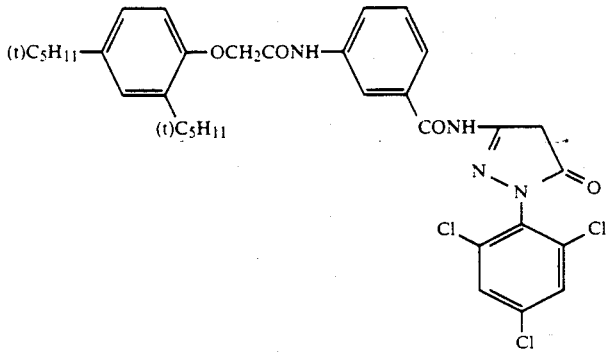
Cp-22
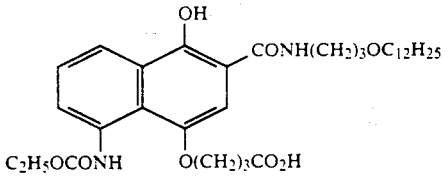
Cp-23
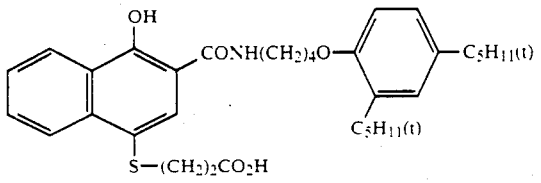
Cp-24
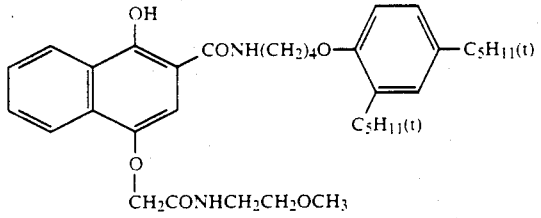
Cp-25
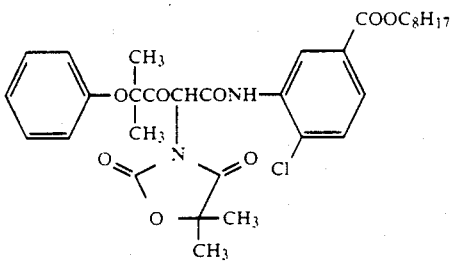
Cp-26
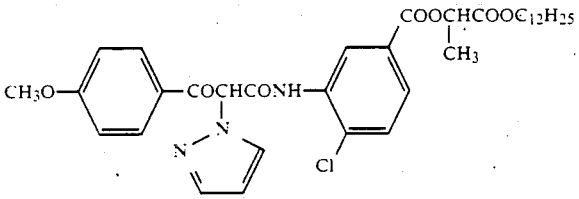

-continued
Cp-27
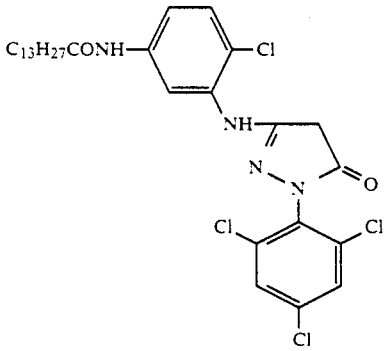
Cp-28
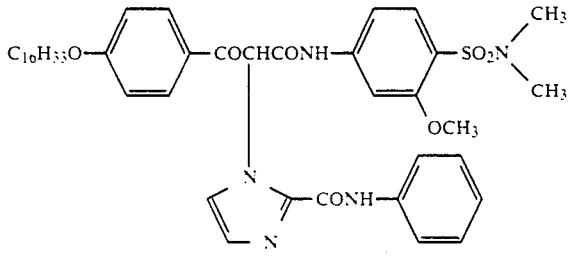
Cp-29
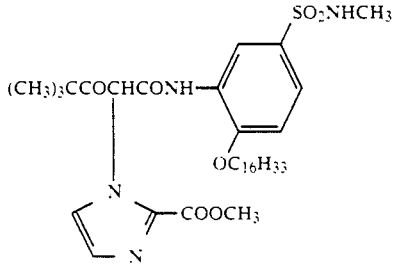
Cp-30
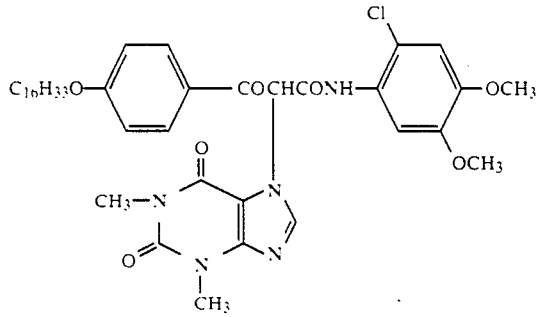
Cp-31
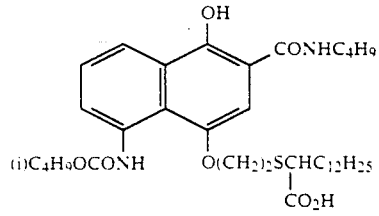

-continued
Cp-32
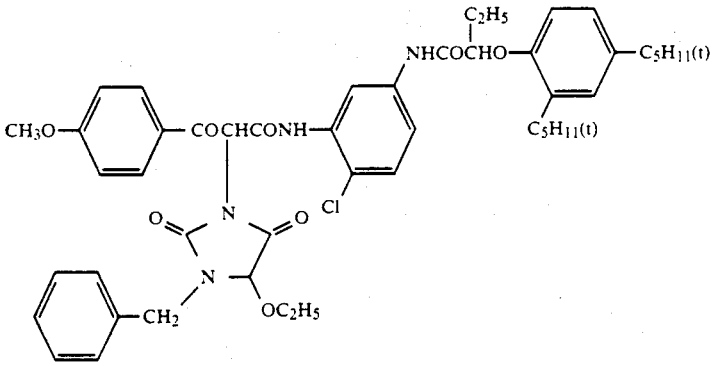
Cp-33
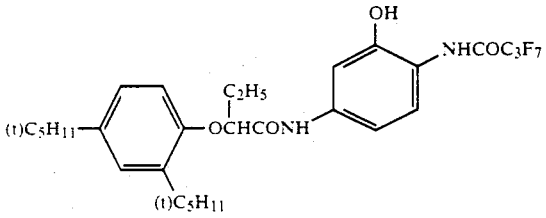
Cp-34
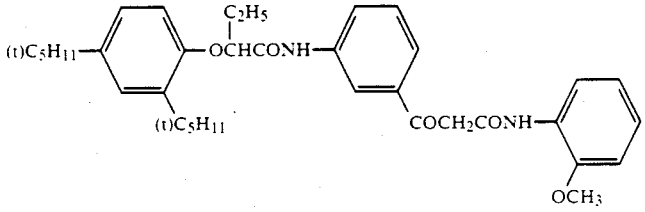
Cp-35
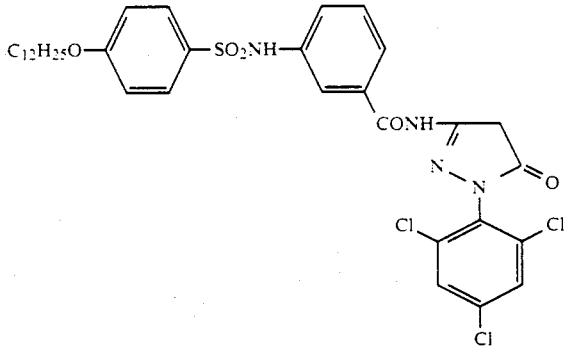
Cp-36
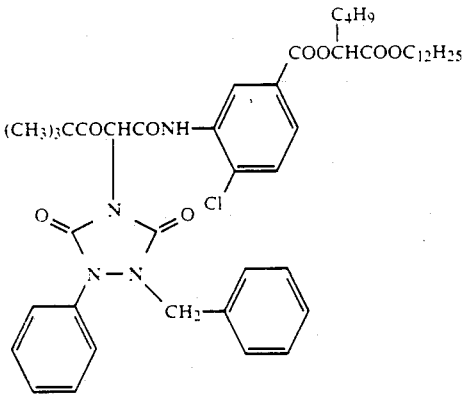

-continued
Cp-37
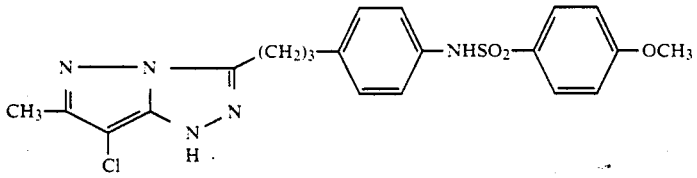
Cp-38
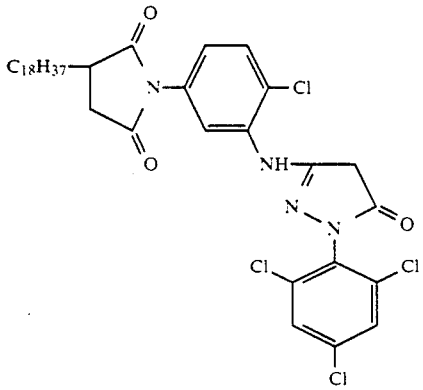
Cp-39
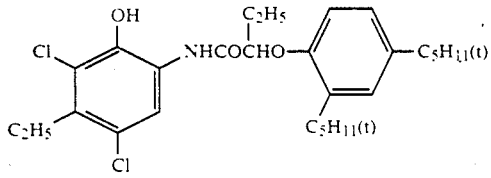
Cp-40
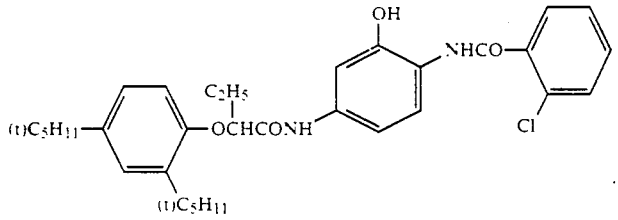
Cp-41
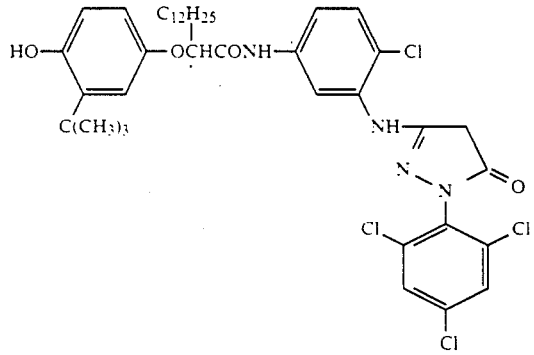
Cp-42
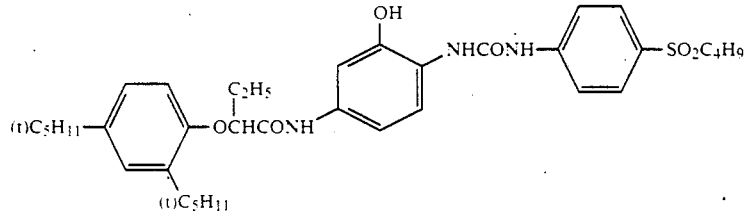

-continued
Cp-43
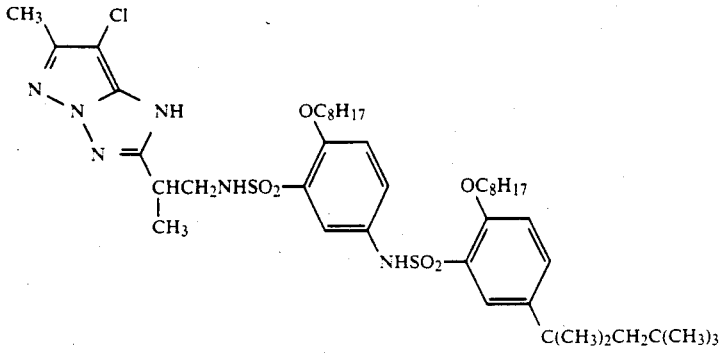
Cp-44
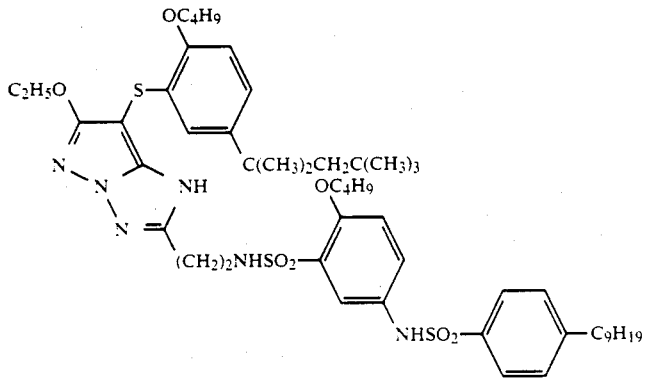
Cp-45
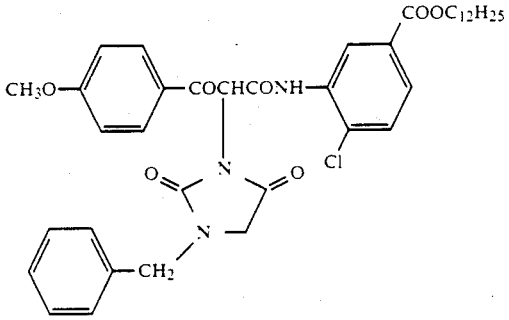
Cp-46
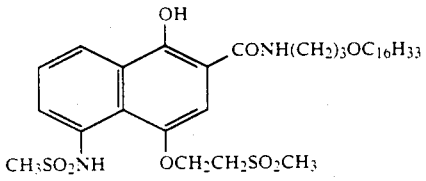
Cp-47
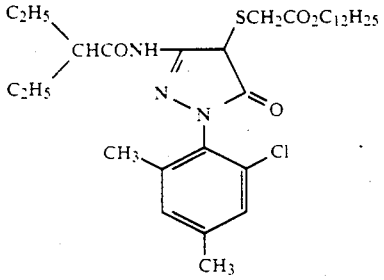
Cp-48
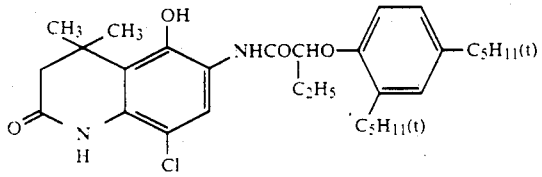

-continued
Cp-49
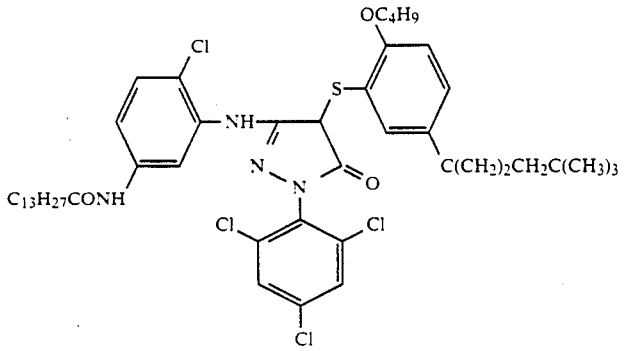
Cp-50
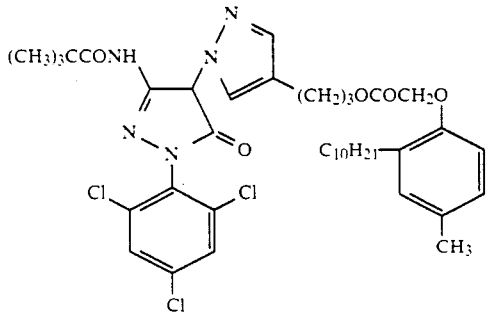
Cp-51
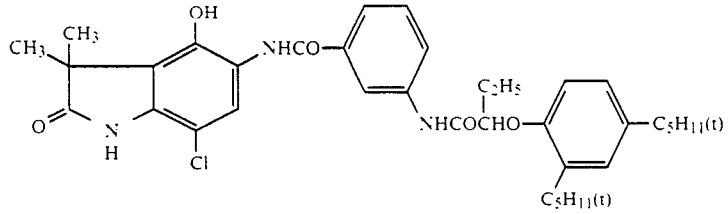
Cp-52
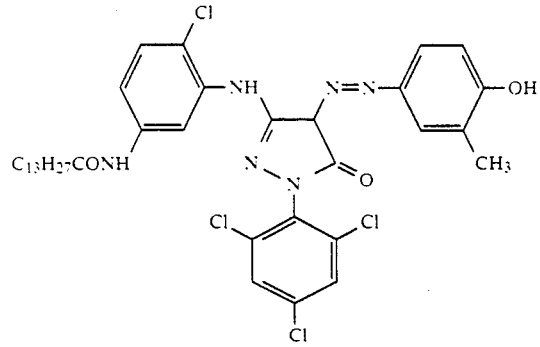
Cp-53
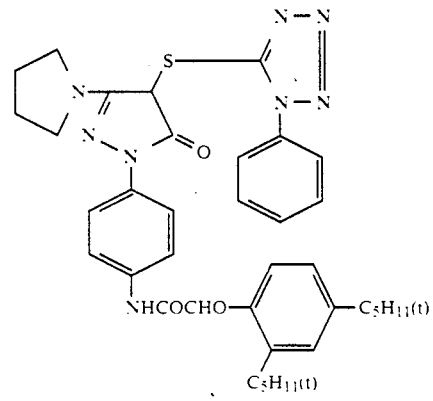

-continued
Cp-54
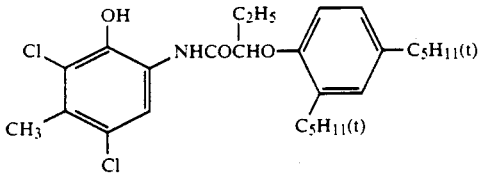
Cp-55
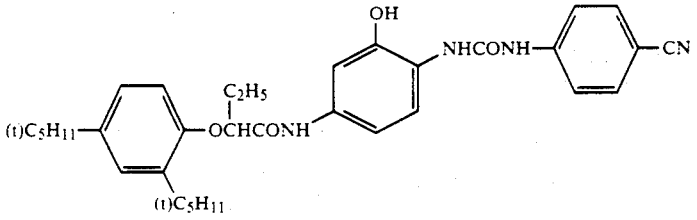
Cp-56
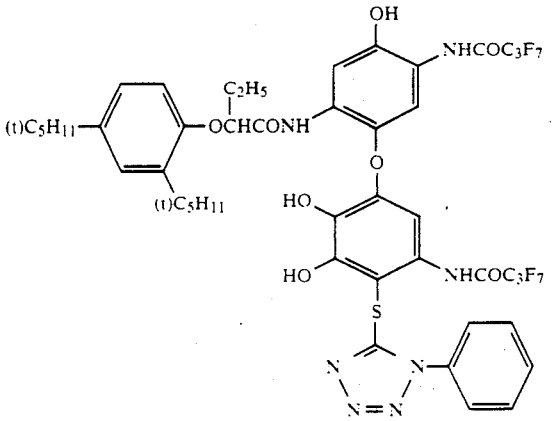
Cp-57
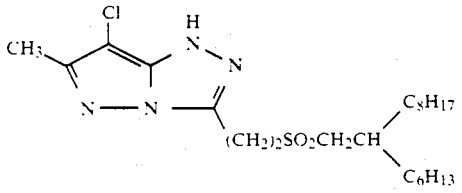
Cp-58
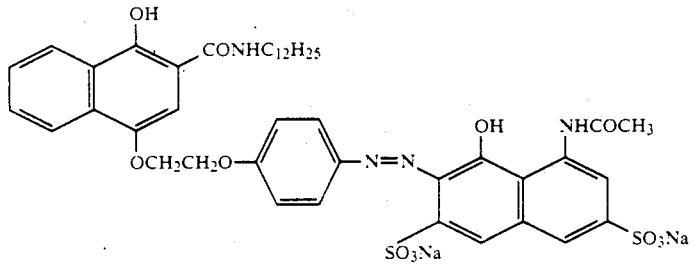
Cp-59
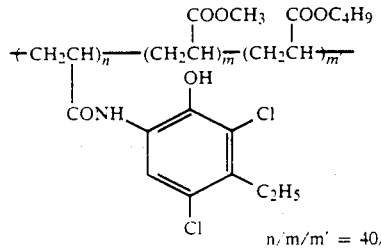
n/m/m' = 40/30/30
(Weight %)
Average molecular weight: about 40,000

-continued
Cp-60
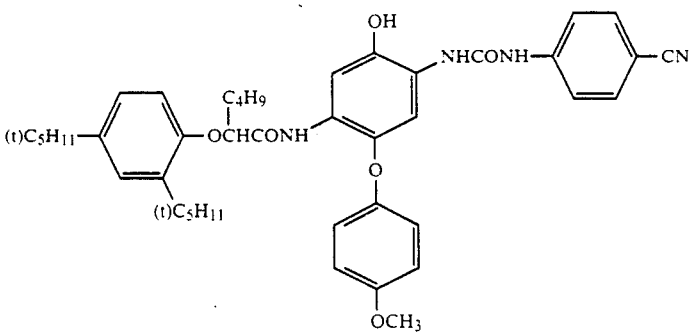
Cp-61
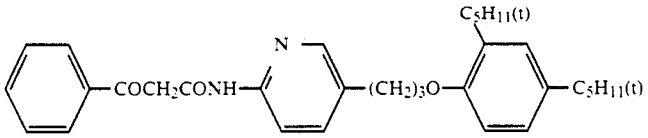
Cp-62
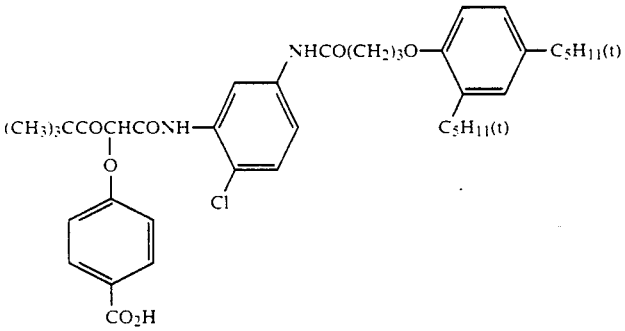
Cp-63
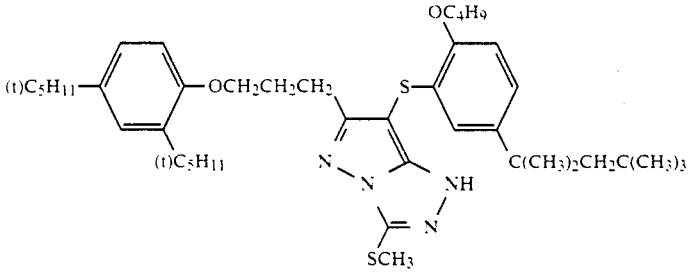
Cp-54
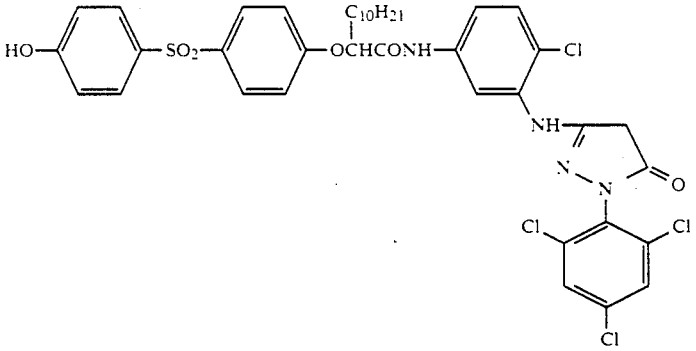
Cp-65
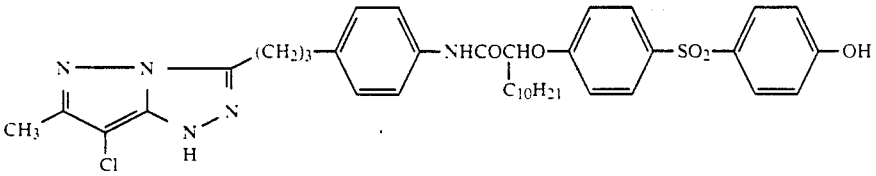

-continued
Cp-66
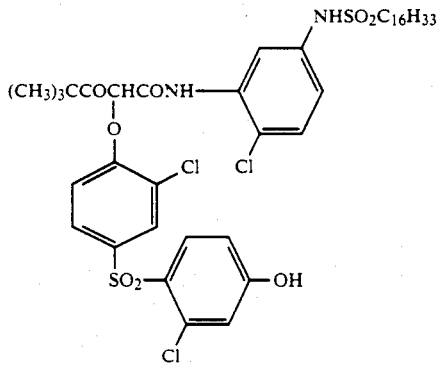
Cp-67
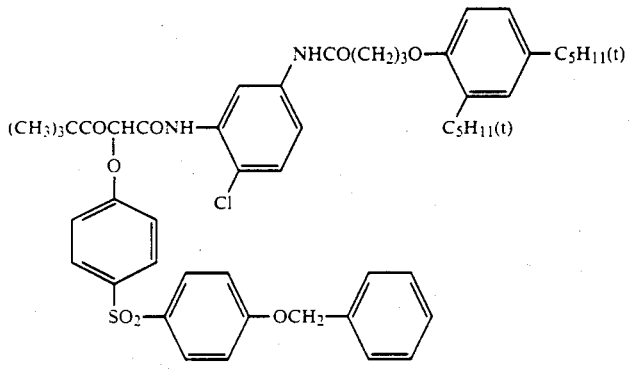
Cp-68
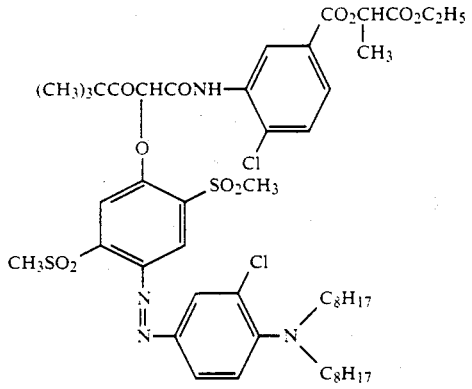
Cp-69
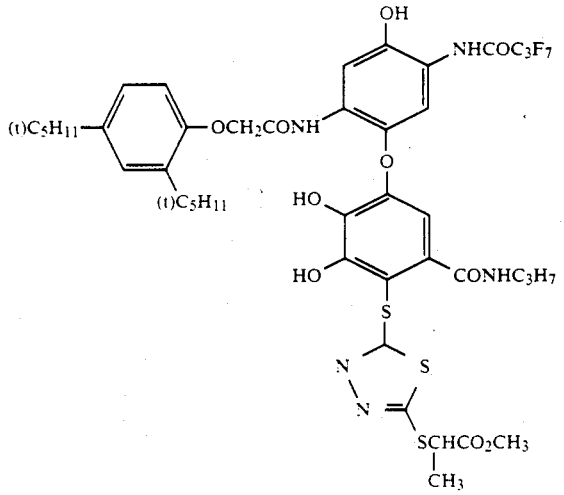

-continued
Cp-70
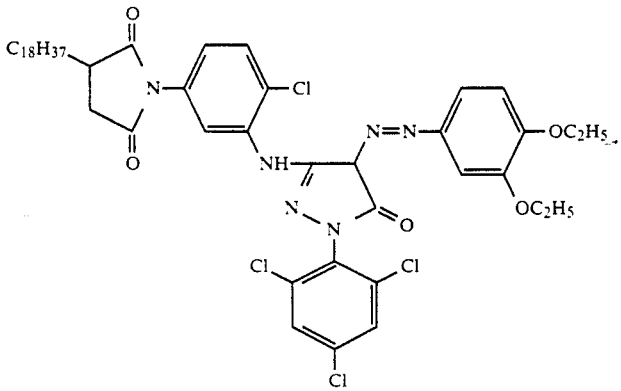
Cp-71
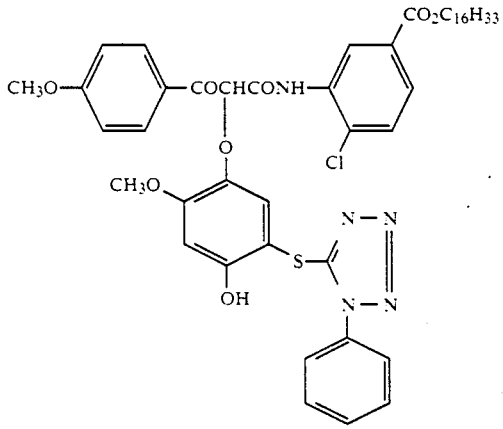
Cp-72
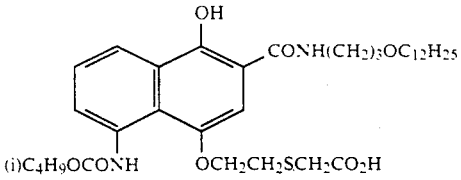
Cp-73
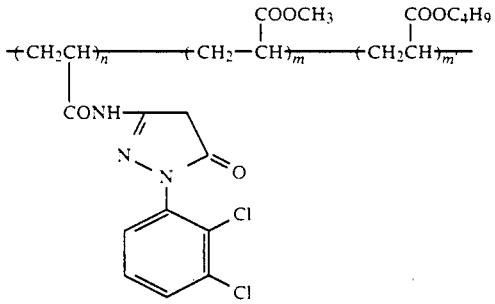
n/(m + m') = 1, m/m' = 1
(Weight ratio)
Molecular weight: about 40,000

-continued
Cp-74
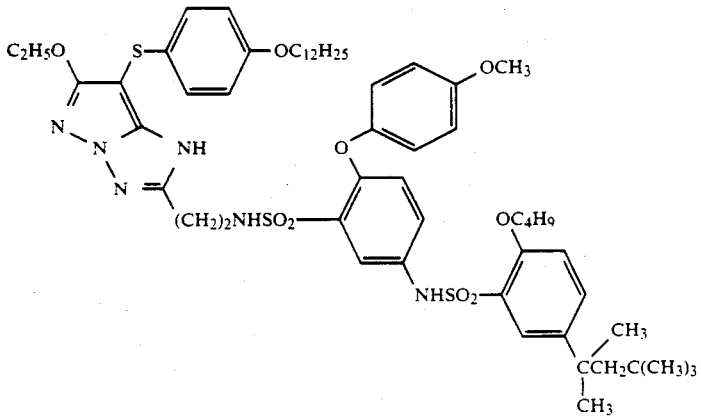
Cp-75
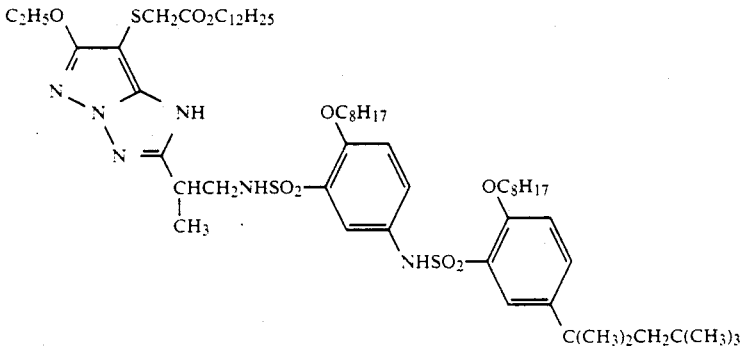
Cp-76
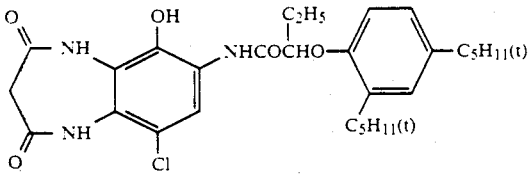
Cp-77
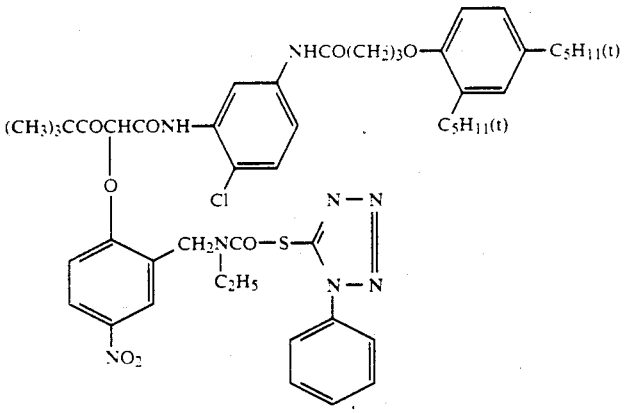

-continued
Cp-78
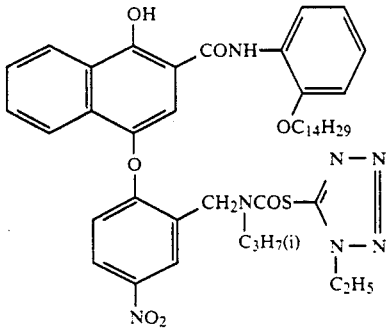
Cp-79
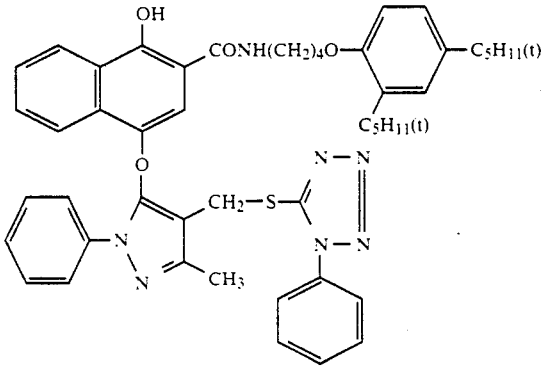
Cp-80
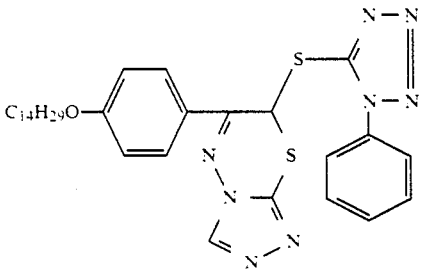
Cp-81
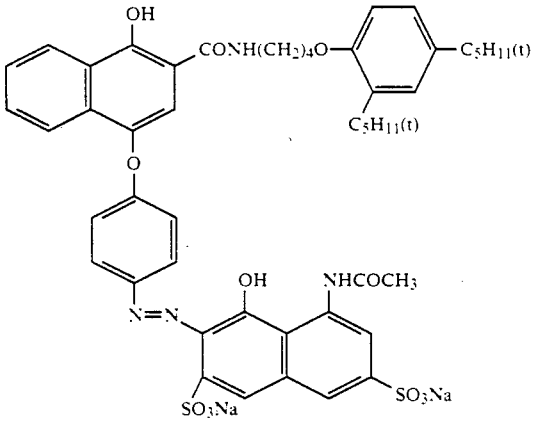

-continued
Cp-82
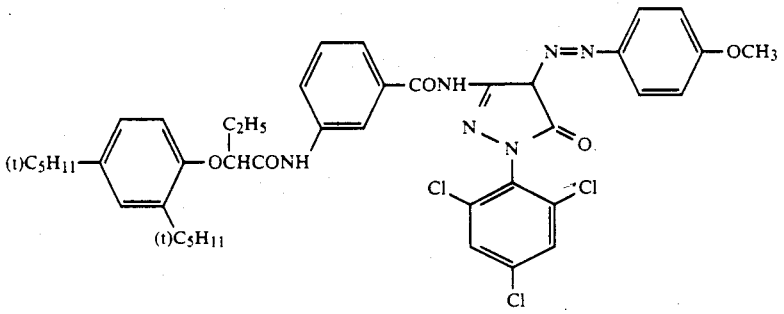
Cp-83
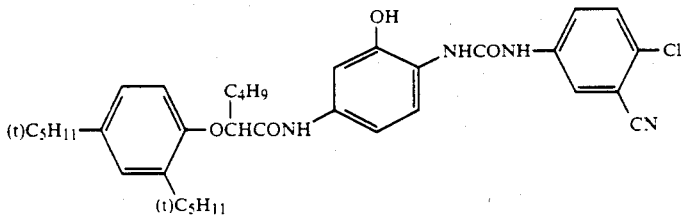
Cp-84
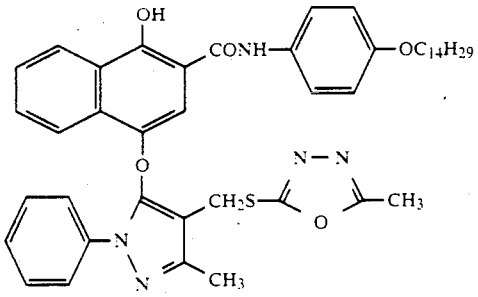
Cp-85
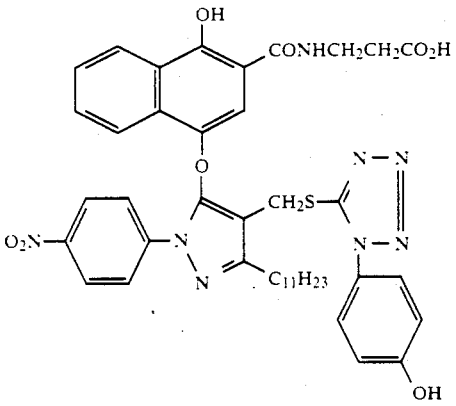
Cp-86
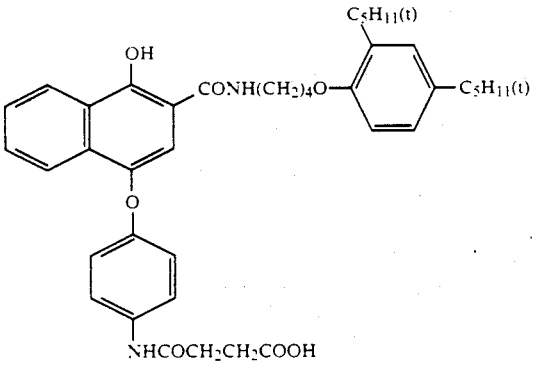
The present invention can be applied to a multilayer color photographic light-sensitive material having at least three spectral sensitivities on a support and a Such a multilayer color photographic light-sensitive material normally comprises at least one red-sensitive emulsion layer, at least one green-sensitive emulsion layer, and at least one blue-sensitive emulsion layer on a support. The order of arrangement of these emulsion layers may be optional.

The compound and coupler represented by formula (I) to be used in the present invention may be incorporated in these color-sensitive emulsion layers or adjacent intermediate layers free of light-sensitive emulsion.

If the above described color-sensitive emulsion layers consist of two or more layers having the same color-sensitivities and different sensitivities, the compound and coupler represented by formula (I) may be incorporated in any one of high sensitivity layer, middle sensitivity layer, and low sensitivity layer.

The added amount of the compound represented by formula (I) is preferably in the range of $1\times10^{-7}$ to $1\times10^{-1}$ mol/m$^2$, particularly $1\times10^{-6}$ to $1\times10^{-3}$ mo/m$^2$.

The present compound represented by formula (I) accepts electrons from a reducing substance to release a photographically useful group or its precursor. Accordingly, after the reducing substance is imagewise oxidized, the residual counterimagewise reducing substance is used.

The reducing substance to be used in the present invention may be either an inorganic compound or organic compound and its oxidation potential is preferably lower than the standard oxidation-reduction potential of silver ion/silver, i.e., 0.80 V.

Examples of such an inorganic reducing substance include metals having an oxidation potential of 0.8 V or less, such as Mn, Ti, Si, Zn, Cr, Fe, Co, Mo, Sn, Pb, W, $H_2$, Sb, Cu, and Hg. Other examples of such an inorganic reducing substance include ion having an oxidation potential of 0.8 V or less or its complex compound, such as $Cr^{2+}$, $V^{2+}$, $Cu^{+}$, $Fe^{2+}$, $MnO_4^{2-}$, $I^-$, $Co(CN)_6^{4-}$, $Fe(CN)_6^{4-}$, and $(Fe\text{-}EDTA)^{2-}$. Further examples of such an inorganic reducing substance include hydrogenated metals having an oxidation potential of 0.8 V or less, such as NaH, LiH, KH, $NaBH_4$, $LiBH_4$, $LiAl(O—C_4H_9—t)_3H$, and $LiAl(OCH_3)_3H$. Further examples of such an inorganic reducing substance include sulfur or phosphorous compounds such as $Na_2SO_3$, NaHS, $NaHSO_3$, $H_3P$, $H_2S$, $Na_2S$, and $Na_2S_2$.

Examples of suitable organic reducing substances include organic nitrogen compounds such as aliphatic or aromatic amines, organic sulfur compounds such as aliphatic or aromatic thiols, and organic phosphorous compounds such as aliphatic or aromatic phosphines. Preferred examples of such organic reducing substances include compounds according to the Kendall-Pelz equation represented by formula (C) as described in T. H. James, *The Theory of the Photographic Process*, 4th. ed., page 299.

$$Q_1—V_n—Q_2 \qquad (C)$$

wherein $Q_1$ and $Q_2$ each represents

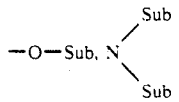

or —S—Sub in which Sub has the same meaning as defined in formula (A); and n represents an integer of 0 to 8. When n is 0, formula (C) is $Q_1$-$Q_2$. $V_1$ to $V_8$ represent $\text{-}(\alpha_1—\beta_1)\text{-}$, $\text{-}(\alpha_1—\beta_1)(\alpha_2—\beta_2)\text{-}$, $\text{-}(\alpha_1—\beta_1)(\alpha_2—\beta_2)(\alpha_3—\beta_3—$, $—\alpha_1—\beta_1)(\alpha_2—\beta_2)(\alpha_3—\beta_3)(\alpha_4—\beta_4—$, $—\alpha_1—\beta_1)(\alpha_2—\beta_2)(\alpha_3—\beta_3)(\alpha_4—\beta_4)(\alpha_5—\beta_5—$, $—\alpha_1—\beta_1)(\alpha_2—\beta_2)(\alpha_3—\beta_3)(\alpha_4—\beta_4)(\alpha_5—\beta_5)(\alpha_6—\beta_6—$, $—\alpha_1—\beta_1)(\alpha_2—\beta_2)(\alpha_3—\beta_3)(\alpha_4—\beta_4)(\alpha_5—\beta_5)(\alpha_6—\beta_6)(\alpha_7—\beta_7—$, and $—\alpha_1—\beta_1)(\alpha_2—\beta_2)(\alpha_3—\beta_3)(\alpha_4—\beta_4)(\alpha_5—\beta_5)(\alpha_6—\beta_6)(\alpha_7—\beta_7)(\alpha_8—\beta_8—$, respectively, in which $\alpha_1$ to $\alpha_8$ and $\beta_1$ to $\beta_8$ each represents

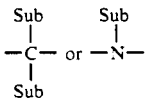

wherein Sub has the same meaning as defined in formula (A).

$Q_1$, $Q_2$ and $V_n$ may be connected to each other to form a heterocyclic group.

Preferred examples of the compound represented by formula (C) will be shown hereinafter.

(C-1)

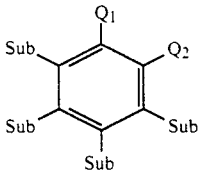

(C-2)

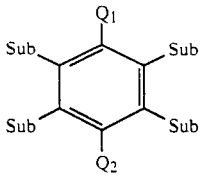

(C-3)

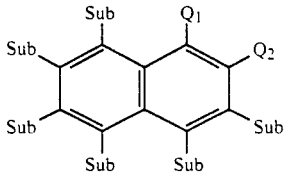

(C-4)

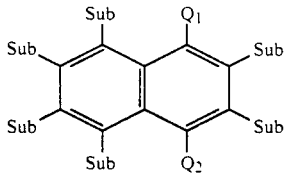

(C-5)

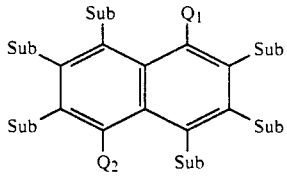

(C-6)

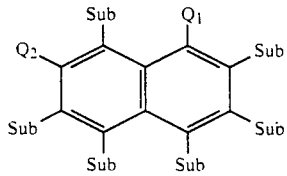

-continued

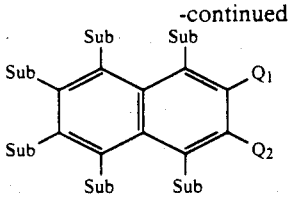

(C-7)

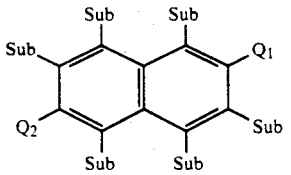

(C-8)

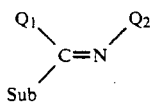

(C-9)

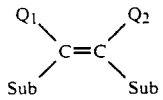

(C-10)

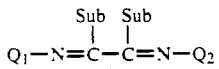

(C-11)

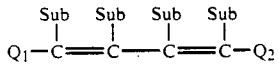

(C-12)

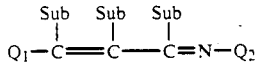

(C-13)

wherein Sub has the same meaning as $Q_1$ or $Q_2$ or as defined in formula (A).

Preferred examples of $Q_1$ and $Q_2$ include those shown below.

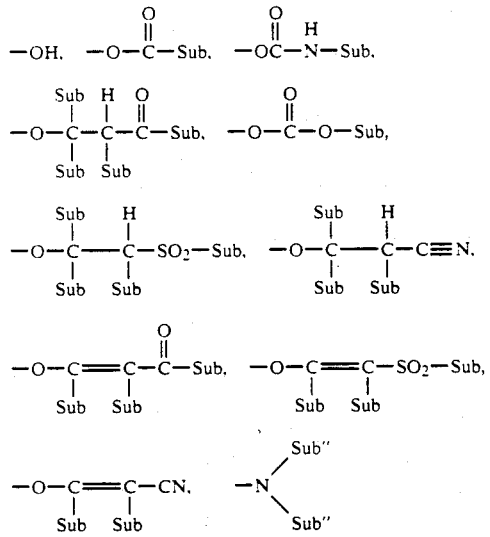

wherein Sub has the same meaning as defined in formula (A). Sub'' has the same meaning as Sub. Particularly preferred examples of Sub'' include hydrogen atom, alkyl group, aryl group, acyl group, and sulfonyl group.

Examples of compounds which can be used as reducing substances in the present invention include inorganic reducing agents such as sodium sulfite, and sodium hydrogensulfite, benzenesulfinic acids, hydroxylamines, hydrazines, hydrazides, boran amine complexes, hydroquinones, aminophenols, catechols, p-phenylenediamines, 3-pyrazolidinones, hydroxytetrons, ascorbic acid, and 4-amino-5-pyrazolones. Other examples of compounds which can be used as reducing substances include reducing agents as described in T. H. James, *The Theory of the Photographic Process*, 4th. ed., pp. 291–334. Further examples of compounds which can be used as reducing substances include reducing agent precursors as described in Japanese Patent Application (OPI) Nos. 138,736/81 and 40,245/82, and U.S. Pat. No. 4,330,617.

Examples of compounds which can be more preferably used as reducing agents include 3-pyrazolidones and precursors thereof (such as 1-phenyl-3-pyrazolidone, 1-phenyl-4,4-dimenthyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, and 1-phenyl-3-acetoxypyrazolidone), hydroquinones and precursors thereof (such as hydroquinone, toluhydroquinone, 2,6-dimethylhydroquinone, t-butylhydroquinone, 2,5-di-t-butylhydroquinone, t-octylhydroquinone, 2,5-di-t-octylhydroquinone, pentadecylhydroquinone, sodium 5-pentadecylhydroquinone-2-sulfonate, p-benzoyloxyphenol, 2-methyl-4-benzoyloxyphenol, 2-t-butyl-4-(4-chlorobenzoyloxy)phenol, sodium hydroquinone-2-sulfonate, 2-[3,5-bis(2-hexyldecanamide)benzamide]hydroquinone, 2-(3-hexadecanamide)benzamidehydroquinone, and 2-(2-hexyldecanamide)hydroquinone), paraphenylenediamine color developing agents (such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-butoxyethylaniline, 3-methyl-4-amino-N-ethyl-N-β-methanesulfonamidoethylaniline, and 4-amino-3-methyl-N-ethyl-N-β-methoxyethylaniline), and aminophenol reducing agents (such as 4-amino-2,6-dichlorophenol, 4-amino-2,6-dibromophenol, 4-amino-2-methylphenol sulfate, 4-amino-3-methylphenol sulfate, and 4-amino-2,6-dichlorophenol hydroclhoride). Other useful reducing agents include 2,6-dichloro-4-substituted sulfonamidephenols and 2,6-dibromo-4-substituted sulfonamidephenols as described in *Research Disclosure*, No. 15,108, and U.S. Pat. No. 4,021,240, and p-(N,N-dialkylaminophenyl)sulfamines as described in Japanese Patent Application (OPI) No. 116,740/84. Besides the above described phenol reducing agents, naphtholic reducing agents such as 4-aminonaphthol derivatives and 4-substituted sulfonamidenaphthol derivatives are useful. Examples of general color developing agents which can be used in the present invention include aminohydroxypyrazole derivatives as described in U.S.

Pat. No. 2,895,825, aminopyrazoline derivatives as described in U.S. Pat. No. 2,892,714, and hydrozine derivatives as described in *Research Disclosure,* Nos. 19412 and 19415 (June 1980, pp. 227–230, 236–240). These color developing agents can be used singly or in combination.

The above described reducing agents may be contained in a developing solution or light-sensitive material. A paraphenylenediamine developing agent is normally contained in a developing solution. In this case, the light-sensitive material may further contain a reducing agent. If a reducing agent is contained in a light-sensitive material, the above described reducing agents may be used singly or in combination as they are or in the form of a precursor thereof. Examples of such precursors include those described in U.S. Pat. Nos. 3,342,599, 3,565,627, 3,291,609, 4,157,915, 3,415,651, 3,419,395, 2,930,693, 3,650,749, 4,560,646, 4,554,243, 4,522,917, 4,446,216, 4,439,519, and 4,426,444, Japanese Patent Application (OPI) No. 104,641/85, and *Research Disclosure*, No. 15,159.

In a particularly preferred embodiment of the present invention, a paraphenylenediamine color developing agent is contained in a processing solution and a reducing agent represented by formula (C) is incorporated in a light-sensitive material. Such a reducing agent is used in an amount of $10^{-2}$ to $10^{2}$ mol, particularly $10^{-1}$ to 10 mol per mol of the compound of formula (I). In the present embodiment, as reducing agents to be incorporated in the light-sensitive material there may be preferably used reducing agents passivated by a ballast group (particularly containing 8 or more carbon atoms) represented by formulae (C-1) to (C-8), particularly (C-1) to (C-4). Particularly preferred are ballastized hydroquinones and ballastized ortho or parasulfonamidephenol or naphthols. In the present embodiment, a pharaphenylenediamine contained in the processing solution reacts with developed silver halide in an emulsion layer in a color light-sensitive material to form an oxidation product. The majority of the oxidation product undergoes a color reaction with a coupler, and the rest oxidizes a reducing agent incorporated in the light-sensitive material. In undeveloped portions, this oxidation reaction doesn't occur so that the reducing agent incorporated therein reduces the compound represented by formula (I) to cause cleavage of a photographically useful group.

The photographic emulsion layer in the photographic light-sensitive material to be used in the present invention may comprise any silver halide selected from silver bromide, silver bromoiodide, silver bromochloroiodide, silver bromochloride, and silver chloride. A preferred silver halide to be used in the present invention is silver bromoiodide or silver bromochloroiodide containing about 30 mol % or less of silver iodide. A particularly preferred silver halide may be silver bromoiodide containing about 2 to about 25 mol % of silver iodide.

Particulate silver halide to be contained in the photographic emulsion may have a regular crystal structure (such as a cube, an octahedron, and a tetradecahedron), an irregular crystal structure (such as a sphere), a crystal structure having crystal defect (such as twinning plane), or a composite thereof.

The particulate silver halide according to the present invention may be either finely divided particles having a particle diameter of about 0.1 μm or less or large size particle having a particle diameter of up to about 10 μm in terms of diameter of projected area. The silver halide emulsion according to the present invention may be in the form of a monodisperse emulsion having a narrow distribution or a polydisperse emulsion having a wide distribution.

The preparation of a silver halide photographic emulsion which can be used in the present invention can be accomplished by any suitable known method as described in *Research Disclosure*, No. 17,643 (Dec. 1978), pp. 22–23, "I. Emulsion Preparation and Types", *Research Disclosure*, No. 18,716 (Nov. 1979), page 648, P. Glafkides, *Chimie et Physique Photographique*, Paul Montel, 1967, G. F. Duffin, *Photographic Emulsion Chemistry*, Focal Press, 1966, V. L. Zelikman et al, *Making and Coating Photographic Emulsion*, Focal Press, 1964, etc. Particularly, the preparation of the present silver halide photographic emulsion can be accomplished by any one of an acidic process, neutral process, and ammonia process. The process for the reaction of the soluble silver salt with the soluble silver halide can be accomplished by separate mixing process, simultaneous mixing process, or a combination thereof. The process for the reaction of the soluble silver salt with the soluble silver halide can be accomplished by a process in which particles are formed in excess silver ions (so-called reversal mixing process). One form of the simultaneous mixing process is a so-called controlled double jet process in which the pAg of the liquid phase in which silver halide is formed is kept constant. This process can provide a silver halide emulsion having a regular crystal structure and a nearly uniform particle size.

Two or more silver halide emulsions which have been separately prepared may be mixed before use.

The above described silver halide emulsion comprising regular particles can be prepared by controlling the pAg and pH of the solution during the formation of particles. The details are described in *Photographic Science and Engineering*, Vol. 6, pp. 159–165, *Journal of Photographic Science*, Vol. 12, pp. 242–251, U.S. Pat. No. 3,655,394, and British Patent 1,413,748.

A typical monodisperse emulsion is an emulsion of silver halide particles having an average diameter of more than about 0.1 μm in which the particle diameter of at least about 95% by weight thereof falls with ±40% of the average particle diameter. In the present invention, an emulsion of silver halide particles having an average particle diameter of about 0.25 to 2 μm in which the particle diameter of at least about 95% by weight or number of particles falls within ±20% of the average particle diameter may be used. Examples of the process for the preparation of such emulsions are described in U.S. Pat. Nos. 3,574,628 and 3,655,394, and British Patent 1,413,748. Other examples of preferred monodisperse emulsions which can be used in the present invention are described in Japanese Patent Application (OPI) Nos. 8,600/73, 39,027/76, 83,097/76, 137,133/78, 48,521/79, 99,419/79, 37,635/83, and 49,938/83.

Alternatively, tabular particles having an aspect ratio of about 5 or more may be used in the present invention. Such tabular particles can be easily prepared by any suitable method as described in Gutoff, Photographic Science and Engineering, Vol. 14, pp. 248–257, 1970, U.S. Pat. Nos. 4,434,226, 4,414,310, 4,433,048, and 4,439,520, and British Patent 2,112,157. The above cited U.S. Pat. No. 4,434,226 describes in detail that the incorporation of such tabular particles has an advantage that the efficiency in color sensitization by a sensitizing dye, graininess, and sharpness can be improved.

The crystal structure of the present particulate silver halide may be uniform, or such that the halide composition varies between the inner portion and the outer portion thereof, or may be a layer. These emulsion particles are disclosed in British Patent 1,027,146, U.S. Pat. Nos. 3,505,068 and 4,444,877, and Japanese Patent Application (OPI) No. 143,331/85. Alternatively, silver halides having different compositions may be connected to each other by an epitaxial junction or by any suitable compound other than silver halide such as silver thiocyanate and zinc oxide. These emulsion particles are disclosed in U.S. Pat. Nos. 4,094,684, 4,142,900, 4,459,353, 4,349,622, 4,395,478, 4,433,501, 4,463,087, 3,656,962, and 3,852,067, British Patent 2,038,792, and Japanese Patent Application (OPI) No. 162,540/84.

Alternatively, a mixture of particles having various crystal structures may be used.

The present silver halide emulsion may be normally subjected to physical ripening, chemical ripening, and spectral sensitization before use. Examples of additives to be used in such processes are described in *Research Disclosure*, Nos. 17,643 and 18,716. The places where such a description is found are summarized in the table shown below.

Examples of known photographic additives which can be used in the present invention are described in these citations. The table shown below also contains the places where such a description is found.

| Additives | RD 17643 | RD 18716 |
|---|---|---|
| 1. Chemical sensitizer | Page 23 | Right column on page 648 |
| 2. Sensitivity improver | | Right column on page 648 |
| 3. Spectral sensitizer, supersensitizer | Page 23–page 24 | Right column on page 648 - right column on page 649 |
| 4. Brightening agent | Page 24 | |
| 5. Fog inhibitor, stabilizer | Page 24–page 25 | Right column on page 649 |
| 6. Light absorber, filter dye, ultraviolet absorber | Page 25–page 26 | Right column on page 649 - left column on page 650 |
| 7. Stain inhibitor | Right column on page 25 | Left column - right column on page 650 |
| 8. Dye stabilizer | Page 25 | |
| 9. Film hardener | Page 26 | Left column on page 651 |
| 10. Binder | Page 26 | Left column on page 651 |
| 11. Plasticizer, lubricant | Page 27 | Right column on page 650 |
| 12. Coating aid, surface active agent | Page 26–page 27 | Right column on page 650 |
| 13. Antistatic agent | Page 27 | Right column on page 650 |

Examples of suitable supports which can be used in the present invention are described on page 28 of *Research Disclosure*, No. 17,643 and from the right column on page 647 to the left column on page 648 in *Research Disclosure*, No 18,716.

The color developing solution to be used for color development of the photographic materials of the present invention is an aqueous alkaline solution consisting mainly of an aromatic primary amine series developing agent. As the color developing agent, p-phenylenediamine series compounds are preferably used, although aminophenol series compounds are also useful. Specific examples of the p-phenylenediamine series compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides and phosphates thereof as well as p-toluenesulfonic acid salts, tetraphenylboric acid salts, p-(t-octyl)benzenesulfonic acid salts, etc. These diamines are more stable in the form of a salt thereof, than in a free state. Therefore, salts of such diamines are preferably used.

Aminophenol series derivatives include, for example, o-aminophenol, p-aminophenol, 4-amino-2-methylphenol, 2-amino-3-methylphenol, 2-hydroxy-3-amino-1,4-dimethylbenzene, etc.

Further, the compounds described in L. F. A. Mason, *Photographic Processing Chemistry* (published by Focal Press), pages 226 to 229, U.S. Pat. Nos. 2,193,015 and 2,592,364, Japanese Patent Application (OPI) No. 64933/73, etc., can also be used. If desired, two or more kinds of color developing agents can be used in combination.

The color developing solutions for processing the photographic material of the present invention can further contain a pH buffer such as alkali metal carbonates, borates or phosphates; a development inhibitor or antifoggant such as bromides, iodides, benzimidazoles, benzothiazoles, mercapto compounds, etc.; a perservative such as hydroxylamine, triethanoloamine, the compounds described in West German Patent Application (OLS) No. 2,622,950, sulfites, bisulfites, etc.; an organic solvent such as diethylene glycol, etc.; a development accelerator such as benzyl alcohol, polyethylene glycol, quaternary ammonium salts, amines, thiocyanates, 3,6-thiaoctane-b 1,8-diol, etc.; a color-forming coupler; a competing coupler; a nucleating agent such as sodium borohydride, etc.; an auxiliary developing agent such as 1-phenyl-3-pyrazolidone, etc.; a tackifier; a chelating agent such as aminopolycarboxylic acids, for example, ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid and the compounds described in Japanese Patent Application (OPI) No. 195845/83, etc., 1-hydroxyethylidene-1,1'-diphosphonic acid, the organic phosphonic acids described in *Research Disclosure* (RD No. 18170) (May, 1979), aminophosphonic acids, for example, aminotris(methylenephosphonic acid), ethylenediamine-N,N,N',N'-tetramethylenephosphonic acid, etc., the phosphonocarboxylic acids described in Japanese Patent Application (OPI) No. 102726/77, 42730/78, 121127/79, 4024/80, 4025/80, 126241/80, 65955/80, and 65956/80, *Research Disclosure* (RD No. 18170) (May, 1979), etc.

The concentration of the color developing agent in a color developing solution is generally from about 0.1 g to about 30 g, more preferably from about 1 g to about 15 g, per liter of the developer. The pH value of the color developing solution is usually 7 or more, and generally from about 9 to about 13. For the color developing solution, a replenisher containing halides and color developing agent each in a controlled concentration is preferably used, so as to reduce the amount of the replenisher added for the purpose of prevention of environmental pollution and reduction of manufacture cost.

In general, reversal color photographic materials are first subjected to black-and-white development and then to color development. The black-and-white developing solution for use in the development may contain any known black-and-white developing agents, for example, a dihydroxybenzene compound such as hydroquinone, hydroquinone monosulfonate, etc., a 3-pyrazolidone compound such as 1 -phenyl-3-pyrazolidone, etc., or an aminophenol compound such as N-methyl-p-aminophenol, etc., singly or in combination thereof.

After color development, the photographic emulsion layers are generally bleached. The bleaching step can be carried out simultaneously with fixation in a combined blix bath, or can be carried out separately. In order to accelerate the processing operation, bleach-fixation may follow bleaching. As bleaching agents to be used for bleaching or bleach-fixation, there are, for example, compounds of polyvalent metals such as iron(III), cobalt(III), chromium(VI), copper(II), etc. (e.g., ferricyanides), peracids; quinones; nitroso compounds; organic complexes of iron(III) or cobalt(III) (e.g., complexes with aminopolycarboxylic acids such as ethylenediaminetetraacetic acid, diethylenetriaminepentaacetic acid, etc., or aminopolyphosphonic acids, phosphonocarboxylic acids and organic phosphonic acids, etc.); or organic acids such as citric acid, tartaric acid, malic acid, etc.; persulfates; hydrogen peroxide; permanganates; etc. Among these compounds, organic complexes of iron(III) and persulfates are especially preferred, due to their rapid processablility and freedom from environmental pollution. Examples of aminopolycarboxylic acids and aminopolyphosphonic acids and salts thereof, which are useful for formation of organic complexes of iron(III), are set forth below.

Ethylenediaminetetraacetic Acid
Diethylenetriaminepentaacetic Acid
Ethylenediamine-n-(β-oxyethyl)-N,N',N'-triacetic Acid
1,2-Diaminopropanetetraacetic Acid
Triethylenetetraminehexaacetic Acid
Propylenediaminetetraacetic Acid
Nitrilotriacetic Acid
Nitrilotripropionic Acid
Cyclohexanediaminetetraacetic Acid
1,3-Diamino-2-propanoltetraacetic Acid
Methylimonodiacetic Acid
Iminodiacetic Acid
Hydroxylaminodiacetic Acid
Dihydroxyethylglycine-ethylether-diaminetetraacetic Acid
Glycolether-diaminetetraacetic Acid
Ethylenediaminetetrapropionic Acid
Ethylenediaminedipropionic Acid
Phenylenediaminetetraacetic Acid
2-Phosphonobutane-1,2,4-triacetic Acid
1,3-Diaminopropanol-N,N,N',N'-tetramethylenephosphonic Acid
Ethylenediamine-N,N,N',N'-tetramethylenephosphonic Acid
1,3-Propylenediamine-N,N,N',N'-tetramethylenephosphonic Acid
1-Hydroxyethylidene-1,1'-diphosphonic Acid Among these compounds, iron(III) complexes with ethylenediaminetetraacetic acid, diethylenetriaminepentaacetic acid, cyclohexanedimainetetraacetic acid, 1,2-diaminopropanetetraacetic acid or methyliminodiacetic acid are especially preferred as having a high bleaching capacity.

Regarding the iron(III) complexes, one or more ready-made iron(III) complexes can be used directly; or an iron(III) salt (for example, ferric sulfate, ferric chloride, ferric nitrate, ammonium ferric sulfate, ferric phosphate, etc.) and a chelating agent (for example, aminopolycarboxylic acids, aminopolyphosphonic acids, phosphonocarboxylic acids, etc.) may be reacted in a solution to form the corresponding ferric complex therein. In the latter case, where the complex is formed in a solution, one or both of the ferric salt and chelating agent may be used as a mixture of two or more thereof. In both cases of using a ready-made complex or forming the complex in a solution, the chelating agent can be used in an amount more than the stoichiometric amount thereof. Further, the above-mentioned ferric complex-containing bleaching solution or bleach-fixing solution can contain any metal ion other than iron, for example, calcium, magnesium, aluminium, nickel, bismuth, zinc, tungsten, cobalt, copper, etc., as well as complex salts thereof, or hydrogen peroxide.

Persulfates to be used for bleaching or bleach-fixation of the photographic materials of the present invention are alkali metal persulfates such as potassium persulfate or sodium persulfate as well as ammonium persulfate.

The bleaching solution or bleach-fixing solution can contain a re-halogenating agent, such as bromides (e.g., potassium bromide, sodium bromide, ammonium bromide), chlorides (e.g., potassium chloride, sodium chloride, ammonium chloride) or iodides (e.g., ammonium iodide). The solution may further contain, if desired, one or more inorganic acids, organic acids and alkali metal or ammonium salts thereof, which have a pH-buffering capacity, for example, boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., or a corrosion-inhibitor such as ammonium nitrate, guanidine, etc.

The amount of the bleaching agent in the bleaching solution is suitably from 0.1 to 2 mols per liter of the solution. The preferred pH range of the bleaching solution is from 0.5 to 8.0 for the case of ferric complexes, and from 4.0 to 7.0 in the case of using ferric complexes of aminopolycarboxylic acids, aminopolyphosphonic acids, phosphonocarboxylic acids or organic phosphonic acids. In the case of using persulfates, the concentration is preferably from 0.1 to 2 mols/liter and the pH range is preferably from 1 to 5.

The fixing agent to be used for fixation or bleach-fixation may be any and every known fixing agent. For example, water-soluble silver halide solvents, which include thiosulfates, such as sodium thiosulfate, ammonium thiosulfate, etc.; thiocyanates, such as sodium thiocyanate, ammonium thiocyanate, etc.; and thioether compounds and thioureas, such as ethylenebisthioglycolic acid, 3,6-dithia-1,8-octanediol, etc., can be used as the fixing agent, either singly or in the form of a mixture of two or more thereof. Further, in bleach-fixation, a special bleach-fixing solution comprising a combination of a fixing agent and a large amount of a halide such as potassium iodide, as described in Japanese Patent Application (OPI) No. 155354/80, can also be used.

In fixation or bleach-fixation, the concentration of the fixing agent is desirably from 0.2 to 4 mol/liter. In bleach-fixation, the content of the ferric complex in the bleach-fixing solution is desirably from 0.1 to 2 mols per liter of the solution and the content of the fixing agent therein is desirably from 0.2 to 4 mols per liter of the solution. The pH value of the fixing solution or bleach-fixing solution is preferably from 4.0 to 9.0, and more preferably from 5.0 to 8.0.

The fixing solution of the bleach-fixing solution can further contain, in addition to the above-mentioned additives for bleaching solution, sulfites (e.g., sodium sulfite, potassium sulfite, ammonium sulfite, etc.), bisulfites, hydroxylamine, hydrazine, aldehyde-bisulfite adducts (e.g., acetaldehyde sodium bisulfite, etc.), etc., as a preservative. In addition, various kinds of brightening agents, defoaming agents, and surfactants as well as organic solvents (such as polyvinyl pyrrolidone, metanol, etc.), can also be incorporated into the fixing solution.

A bleaching accelerator can optionally be incorporated into the bleaching solution or bleach-fixing solution, or in the pre-bath thereof. Examples of useful bleaching accelerators include the mercapto group- or disulfide group-containing compounds described in U.S. Pat. No. 3,893,858, West German Patents 1,290,812 and 2,059,988, Japanese Patent Application (OPI) No. 32736/78, 57831/78, 37418/78, 65732/78, 72623/78, 95630/78, 95631/78, 104232/78, 124424/78, 141623/78, and 28426/78, *Research Disclosure* (RD No. 17129), (July, 1978), etc.; the thiazolidine derivatives described in Japanese Patent Application (OPI) No. 140129/75, etc.; the thiourea derivatives described in Japanese Patent Publication No. 8506/70, Japanese Patent Application (OPI) Nos. 20832/77 and 32735/78, U.S. Pat. No. 3,706,561, etc.; the iodides described in West German Patent 1,127,715, Japanese Patent Application (OPI) No. 16235/83, etc.; the polyethylene oxides described in West German Patents 966,410 and 2,748,430, etc.; the polyamine compounds described in Japanese Patent Publication No. 8836/70, etc.; the compounds described in Japanese Patent Application (OPI) Nos. 42434/74, 59644/74, 94927/78, 35727/79, 26506/80, and 163940/83, etc., as well as iodide and bromide ions. The mercapto group- or disulfite group-containing compounds are particularly preferred, as they have a large accelerating effect, and in particular, the compounds described in U.S. Pat. No. 3,893,858, West German Patent 1,290,812 and Japanese Patent Application (OPI) No. 95630/78, are especially preferred.

In the practice of the present invention, the processing solutions are used at a temperature of from 10° C. to 50° C. Although the temperature range falling between 33° C. and 38° C. is standard, it is possible to elevate the processing temperature to accelerate the processing so as to shorten the processing time, or on the other hand, to lower the temperature to improve the quality of images formed or to improve the stability of the processing solutions used. For the purpose of economizing silver in the photographic materials, the cobalt intensifier or hydrogen peroxide intensifier described in West German Patent 2,226,770 and U.S. Pat. No. 3,674,499, or the combined development-bleaching-fixation monobath system described in U.S. Pat. No. 3,923,511, can be used.

The silver halide color photographic materials of the present invention are, after being desilverized as described above, generally subjected to rinsing in water and stabilization. However, these materials may be processed by a simple stabilization process only, without being subjected to a substantial rinsing-in-water process.

Known additives can be added to the rinsing water to be used in the rinsing-in-water step, if so desired. For example, chelating agents such as inorganic phosphoric acids, aminopolycarboxylic acids, organic phosphoric acids, etc.; bactericides and fungicides for preventing propagation of various bacteria and algae; hardening agents such as magnesium salts, aluminium salts, etc.; surfactants for preventing drying load or unevenness, etc. all can be used. Further, the compounds described in L. E. West, *Water Quality Criteria Photo. Sci. and Eng.*, Vol. 9, No. 6, pages 344 to 359 (1965), etc., can also be used.

The rinsing-in-water step can be carried out in two or more rinsing tanks, if desired. Further, a multistage countercurrent rinsing system (for example, comprising from 2 to 9 stages) can also be employed so as to economize and reduce the rinsing water to be used.

As the stabilizing solution for use in the stabilization step, there is a processing solution capable of stabilizing color images formed. For example, a processing solution with a pH of from 3 to 6, which has a buffering capacity, or a solution containing an aldehyde (e.g., formalin, etc.), or the like, can be used. The stabilizing solution may further contain, if desired, a brightening agent, a chelating agent, a bactericide, a fungicide, a hardening agent, a surfactant, etc.

The stabilization step can be carried out in two or more tanks, if desired, or a multistage countercurrent stabilization step (for example, comprising from 2 to 9 stages) can optionally be employed so as to economize and reduce the stabilizer solution to be used. Further, the rinsing-in-water step can be omitted.

In continuous processing, replenishers for the respective processing solutions can be added so as to prevent the fluctuation of the compositions of the respective solutions, whereby constantly finished films can be obtained. The amount of the replenisher to be added may be a half or less of the standard amount to be replenished, so as to reduce the processing cost.

The respective processing baths can be provided with a heater, a temperature sensor, a liquid level sensor, a circulating pump, a filter, a floating lid, a squeegee, a nitrogen stirrer, an air stirrer, etc., if desired.

The processing time can be made shorter than the standard time, if desired, for the purpose of accelerating the processing step, only if the shortened processing times does not interfere with the processing itself.

The silver halide color photographic material of the present invention can contain a color developing agent, or a precursor thereof, for the purpose of simplifying and accelerating the processing step. When the agent is incorporated into the photographic material, the precursor thereof is preferred in view of the maintenance of the stability of the materials. Examples of developing agent precursors include the indoaniline series compounds described in U.S. Pat. No. 3,342,597; the Shiff base type compounds described in U.S. Pat. No. 3,342,599, *Research Disclosure* (RD No. 14850), (August, 1976), *Research Disclosure* (RD No. 15159), (November, 1976), etc.; the aldole compounds described in *Research Disclosure* (RD No. 13924), etc.; the metal complexes described in U.S. Pat. No. 3,719,492, etc.; the urethane series compounds described in Japanese Patent Application (OPI) No. 135628/78, etc. Furthermore, the various salt type precursors described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82, and 83565/82, etc., can also be used in the present invention.

The silver halide color photographic material of the present invention may further contain various kinds of 1-phenyl-3-pyrazolidones so as to accelerate the color development of the materials. Specific compounds for this purpose are described in Japanese Patent Application (OPI) Nos. 64339/81, 144547/82, 211147/82, 50532/83, 50536/83, 50533/83, 50534/83, 50535/83, and 115438/83, etc.

In continuous processing, replenishers for the respective processing solutions can be added so as to prevent the fluctuation of the compositions of the respective solutions, whereby constantly finished films can be obtained. The amount of the replenisher to be added may be a half or less of the standard amount to be replenished, so as to reduce the processing cost.

The respective processing baths can be provided with a heater, a temperature sensor, a liquid level sensor, a circulating pump, a filter, a floating lid, a squeegee, etc., if desired.

If the present light-sensitive material is a color paper, it is normally subjected to blix processing. Also, if the present light-sensitive material is a color photographic light-sensitive material for photographing purpose, it may be optionally subjected to blix processing.

The present invention will be further described in the following examples, but the present invention should not be construed as being limited thereto.

EXAMPLE 1

Preparation of Specimen 101

Specimen 101 was prepared by coating layers of the undermentioned compositions on a transparent support.

| | |
|---|---|
| 1st layer | |
| Silver bromoiodide emulsion (AgI content: 3 mol %, average grain diameter: 0.6 μm) | 0.9 g/m$^2$ |
| Gelatin | 1.5 g/m$^2$ |
| Coupler ExC-1 | 0.6 g/m$^2$ |
| Comparative Compound A | 0.2 mol per mol of Ag |
| 2nd layer | |
| Gelatin | 0.5 g/m$^2$ |
| Polymethacrylate particle | 0.2 g/m$^2$ |

Onto each of the layers were further coated a gelatin hardener and a surfactant.

Preparation of Specimens 102 to 104

Specimens 102 to 104 were prepared in the same manner as in Specimen 101 except that Comparative Compound A was replaced by an equimolar amount of each of Compound (1), (3) and (6) of the present invention.

Preparation of Specimens 105 to 110

Specimens 105 to 110 were prepared in the same manner as in Specimens 102 to 104 except that each of HQ-1 to HQ-4 was added as an additive in an equimolar amount to the present compound as shown in Table 1.

The thus prepared specimens were subjected to edge exposure and then processed in the manner described below.

Further, these specimens were exposed to light through an MTF chart and measured for MTF.

ExC-1

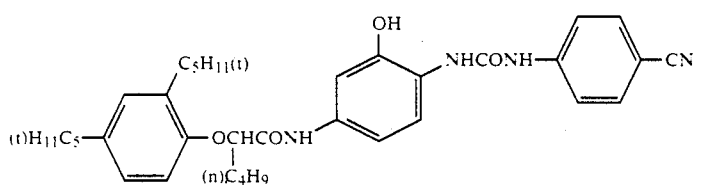

Comparative Compound A

-continued

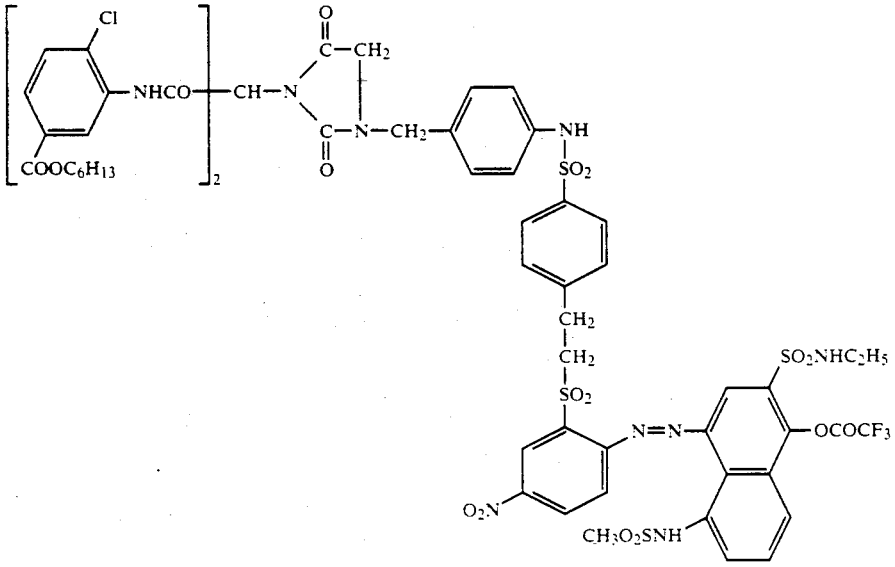

Compound described in Japanese Patent Application (OPI) No. 35,355/87

HQ-1

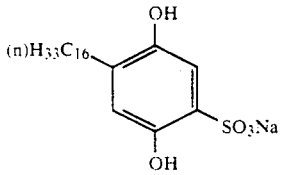

HQ-2

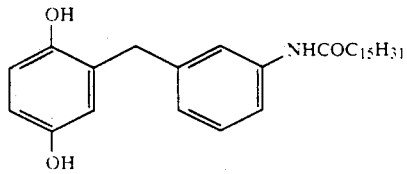

HQ-3

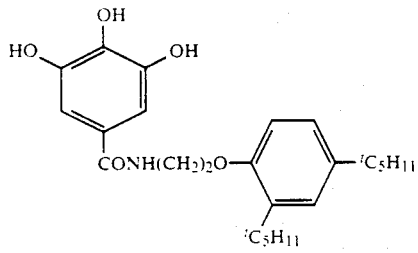

HQ-4

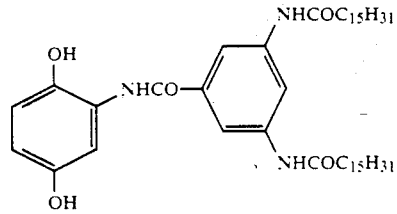

Processing

| Processing step | Processing time | Processing temperature |
|---|---|---|
| Color development | 3 min. 15 sec. | 38° C. |
| Bleaching | 1 min. 00 sec. | 38° C. |
| Blix | 3 min. 15 sec. | 38° C. |
| Rinse (1) | 40 sec. | 35° C. |
| Rinse (2) | 1 min. 00 sec. | 35° C. |
| Stabilizing | 40 sec. | 38° C. |

-continued

| Processing step | Processing time | Processing temperature |
|---|---|---|
| Drying | 1 min. 15 sec. | 55° C |

The composition of the processing solutions used will be described hereinafter.

Color developing solution

| | (unit: g) |
|---|---|
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2-methylaniline sulfate | 4.5 |
| Water to make | 1.0 l |
| pH | 11.5 |

Bleaching solution

| | (unit: g) |
|---|---|
| $NH_4$[Fe(III)(EDTA)] (dihydrate) | 120.0 |
| EDTA.2Na | 10.0 |
| Ammonium bromide | 100.0 |
| Ammonium sulfate | 10.0 |
| Bleach accelerator | 0.005 mol |

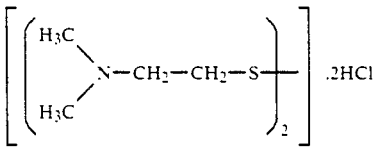

| | |
|---|---|
| Ammonia water (27%) | 15.0 ml |
| Water to make | 1.0 l |
| pH | 6.3 |

Blix solution

| | (unit: g) |
|---|---|
| $NH_4$[Fe(III)(EDTA)] (dihydrate) | 50.0 |
| EDTA.2Na | 5.0 |
| Sodium sulfite | 12.0 |
| Aqueous solution of ammonium thiosulfate (70%) | 240.0 ml |
| Ammonia water (27 %) | 6.0 ml |
| Water to make | 1.0 l |
| pH | 7.2 |

Rinsing solution

Tap water was allowed to pass through a mixed bed column filled with a strongly acidic H-type cationic exchange resin (Rohm & Haas Co.; Amberlite ® IR-120B) and an OH-type anionic exchange resin (Amberlite ® IR-400) so that the content of calcium and magnesium ions were reduced to 3 mg/l or less. Sodium dichlorinated isocyanurate and sodium sulfate were added to the water in amounts of 20 mg/l and 150 mg/l, respectively.

The pH of the rinsing solution thus prepared was between 6.5 and 7.5

Stabilizing solution

| | (unit: g) |
|---|---|
| Formalin (37%) | 2.0 ml |
| Polyoxyethylene-p-monononylphenylether (average polymerization degree: 10) | 0.3 |
| EDTA.2Na | 0.05 |
| Water to make | 1.0 l |
| pH | 5.0-8.0 |

TABLE 1

| Specimen No. | | Compound No. | Additive | MTF (10 cycle/mm) pH 10.05 | pH 11.5 |
|---|---|---|---|---|---|
| 101 | (comparative example) | A | — | 0.65 | 0.65 |
| 102 | (present invention) | (1) | — | 0.70 | 0.71 |
| 103 | " | (3) | — | 0.73 | 0.78 |
| 104 | " | (6) | — | 0.73 | 0.78 |
| 105 | " | (1) | HQ-1 | 0.78 | 0.85 |
| 106 | " | (3) | " | 0.79 | 0.88 |
| 107 | " | (6) | " | 0.77 | 0.84 |
| 108 | " | (3) | HQ-2 | 0.74 | 0.85 |
| 109 | " | (3) | HQ-3 | 0.74 | 0.84 |
| 110 | " | (3) | HQ-4 | 0.76 | 0.86 |

EXAMPLE 2

A multilayer color light-sensitive material specimen 201 was prepared by coating various layers of the undermentioned compositions on a subbed cellulose triacetate film support.

Composition of Light-sensitive Layer

The coated amount of silver halide and colloidal silver are represented in terms of amount of silver ($g/m^2$). The coated amount of coupler, additive, and gelatin are represented by $g/m^2$. The coated amount of sensitizing dye is represented by molar number per mol of silver halide in the same layer.

| | |
|---|---|
| 1st layer (antihalation layer) | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| 2nd layer (intermediate layer) | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| 3rd layer (low sensitivity red-sensitive emulsion layer) | |
| Silver bromoiodide emulsion (AgI content: 4 mol %; uniform AgI type; diameter in terms of sphere: 0.5 μm; coefficient of fluctuation in diameter in terms of sphere: 20%; tabular particle; diameter/thickness ratio: 3.0) | 1.2 |
| Silver bromoiodide emulsion AgI content: 3 mol %; uniform AgI type; diameter in terms of sphere: 0.3 μm; coefficient of fluctuation in diameter in terms of sphere: 15%; spherical particle; | 0.6 |

-continued

| | |
|---|---|
| diameter/thickness ratio: 1.0) | |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| 4th layer (high sensitivitv red-sensitive emulsion layer) | |
| Silver bromoiodide emulsion (AgI content: 6 mol %; high internal AgI type having a core/shell ratio of 1:1; diameter in terms of sphere: 0.7 μm; coefficient of fluctuation in diameter in terms of sphere: 15%; tabular particle; diameter/thickness: 5.0) | 0.7 |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| 5th layer (intermediate layer) | |
| Gelatin | 0.5 |
| Cpd-1 | 0.1 |
| Solv-1 | 0.05 |
| 6th layer (low sensitivity green-sensitive emulsion layer) | |
| Silver bromoiodide emulsion (AgI content: 4 mol %; high surface AgI type having a core/shell ratio of 1:1; diameter in terms of sphere: 0.5 μm; coefficient of fluctuation in diameter in terms of sphere: 15%; tabular particle; diameter/thickness ratio: 4.0) | 0.35 |
| Silver bromoiodide emulsion (AgI content: 3 mol %; uniform AgI type; diameter in terms of sphere: 0.3 μm; coefficient of fluctuation in diameter in terms of sphere: 25%; spherical particle; diameter/thickness ratio: 1.0) | 0.20 |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| 7th layer (high sensitivity green-sensitive emulsion layer) | |
| Silver bromoiodide emulsion (AgI content: 4 mol %; high internal AgI type having a core/shell ratio of 1:3; diameter in terms of sphere: 0.7 μm; coefficient of fluctuation in diameter in terms of sphere: 20%; tabular sphere: diameter/thickness: 5.0) | 0.8 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| SOlv-4 | 0.01 |
| 8th layer (intermediate layer) | |
| Gelatin | 0.5 |
| Cpd-1 | 0.05 |
| Solv-1 | 0.02 |
| 9th layer (donor layer having interimage effect against red-sensitive layer) | |
| Silver bromoiodide emulsion (AgI content: 2 mol %; high internal AgI type having a core/shell ratio of 2:1; diameter in terms of sphere: 1.0 μm; coefficient of fluctuation in diameter in terms of sphere: 15%; tabular particle; diameter/thickness ratio: 6.0) | 0.35 |
| Silver bromoiodide emulsion (AgI content: 2 mol %; high internal AgI type having a core/shell ratio of 1:1; diameter in terms of sphere: 0.4 μm; coefficient of fluctuation in diameter in terms of sphere: 20%; tabular particle; diameter/thickness ratio: 6.0) | 0.20 |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| 10th layer (Yellow filter layer) | |
| Yellow colloidal silver | 0.05 |
| Gelatin | 0.5 |
| Cpd-2 | 0.13 |
| Cpd-1 | 0.10 |
| 11th layer (low sensitivity blue-sensitive emulsion layer) | |
| Silver bromoiodide emulsion (AgI content: 4.5 mol %; uniform AgI type; diameter in terms of sphere: 0.7 μm; coefficient of fluctuation in diameter in terms of sphere: 15%; tabular particle; diameter/thickness ratio: 7.0) | 0.3 |
| Silver bromoiodide emulsion (AgI content: 3 mol %; uniform AgI type; diameter in terms of sphere: 0.3 μm; coefficient of fluctuation in diameter in terms of sphere: 25%; tabular particle; diameter/thickness ratio: 7.0) | 0.15 |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExY-17 | 1.0 |
| Solv-1 | 0.20 |
| 12th layer (high sensitivity blue-sensitive emulsion layer) | |
| Silver bromoiodide emulsion (AgI content: 10 mol %; high internal AgI type; diameter in terms of sphere: 1.0 μm; coefficient of fluctuation in diameter in terms of sphere: 25%; polyhedron twinning tabular particle; diameter/thickness ratio: 2.0) | 0.5 |
| Gelatin | 0.5 |
| ExS-6 | $1 \times 10^{-4}$ |
| ExY-15 | 0.20 |
| ExY-13 | 0.01 |
| Solv-1 | 0.10 |
| 13th layer (1st protective layer) | |
| Gelatin | 0.8 |
| UV-4 | 0.1 |
| UV-5 | 0.15 |
| Solv-1 | 0.01 |
| Solv-2 | 0.01 |
| 14th layer (2nd protective layer) | |
| Emulsion of finely divided silver bromoidodide particles (AgI content: 2 mol %; uniform AgI type; diameter in terms of sphere: 0.07 μm) | 0.5 |
| Gelatin | 0.45 |
| Particulate polymethyl methacrylate (diameter: 1.5 μm) | 0.2 |
| H-1 | 0.4 |
| Cpd-3 | 0.5 |
| Cpd-4 | 0.5 |

Besides the above described components, an emulsion stabilizer Cpd-3 and a surface active agent Cpd-4 as a coating aid were added to each layer in amounts of 0.04 g/m$^2$ and 0.02 g/m$^2$, respectively. Furthermore, the undermentioned compounds Cpd-5 and Cpd-6 were added to each layer in amounts of 0.5 g/m$^2$ and 0.5 g/m$^2$, respectively.

Preparation of Specimen 202

Specimen 202 was prepared in the same manner as in Specimen 201 except that Comparative Compound A was incorporated in the 4th layer in an amount of 0.25 mol per mol of silver.

Preparation of Specimens 203 to 205

Specimens 203 to 205 were prepared in the same manner as in Specimen 202 except in that Compound A was replaced by the present compound in an equimolecular amount of the present compound (Compound (22) for Specimens 203 and 204 and Compound (19) for Specimen 205.)

Compound HQ-1 was further incorporated in Specimens 204 and 205 in equimolecular amounts.

These specimens thus prepared were exposed to light through an MTF chart and a green filter, and then subjected to processings as described below. These specimens were further stored at a temperature of 45° C. and a relative humidity of 80% for 3 days. These specimens thus aged were then measured for MTF.

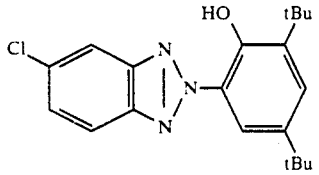

UV-1

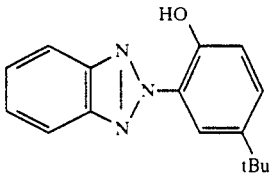

UV-2

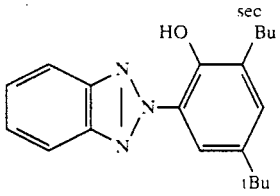

UV-3

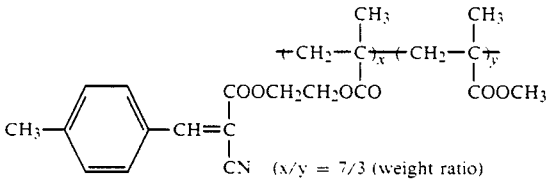

UV-4

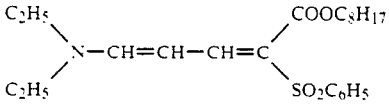

UV-5

Tricresyl phosphate — Solv-1

Dibutyl phthalate — Solv-2

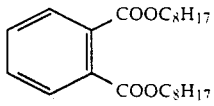

Solv-3

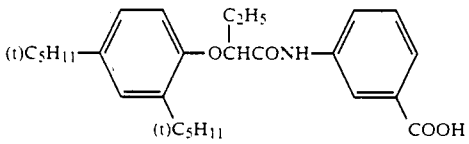

Solv-4

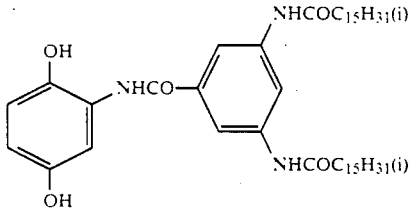

Cpd-1

-continued
Cpd-2
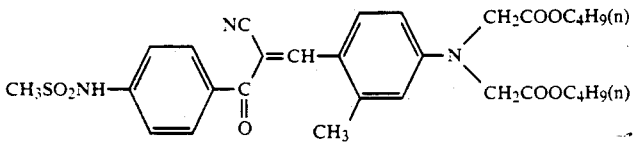
Cpd-3
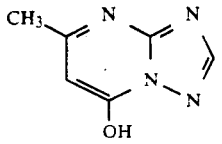
Cpd-4
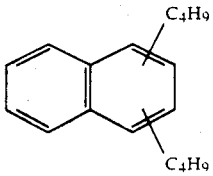
Cpd-5
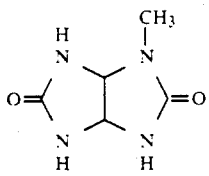
Cpd-6
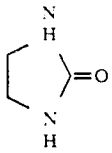
ExC-1
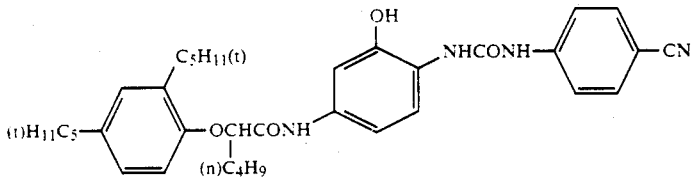
ExC-2
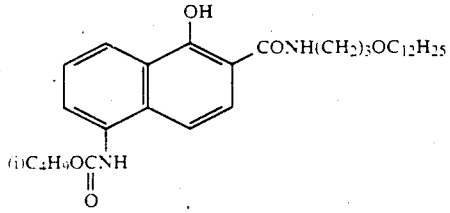

-continued
ExC-3
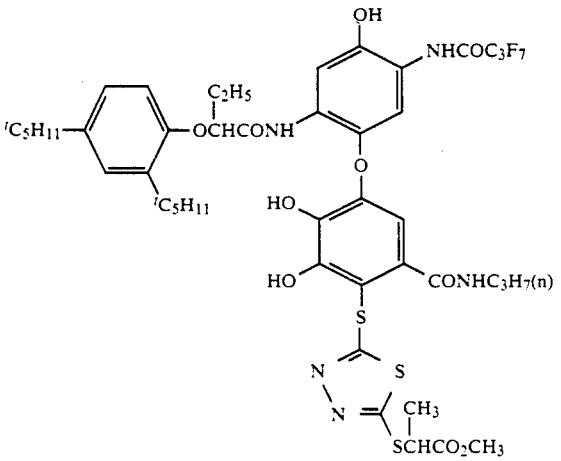
ExC-4
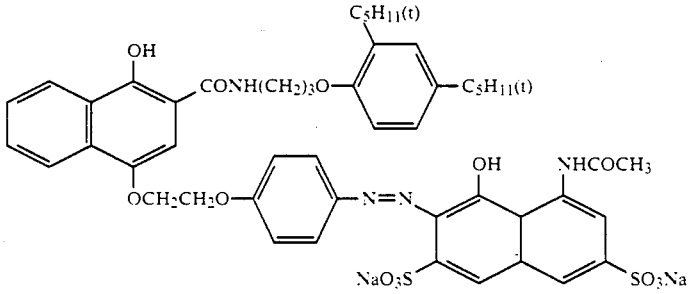
ExC-5
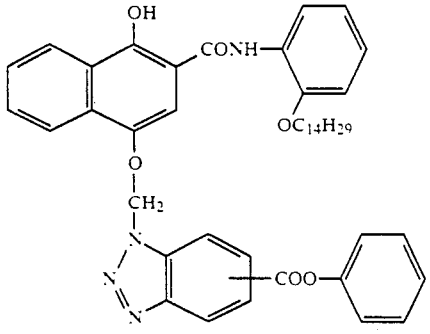
ExC-6
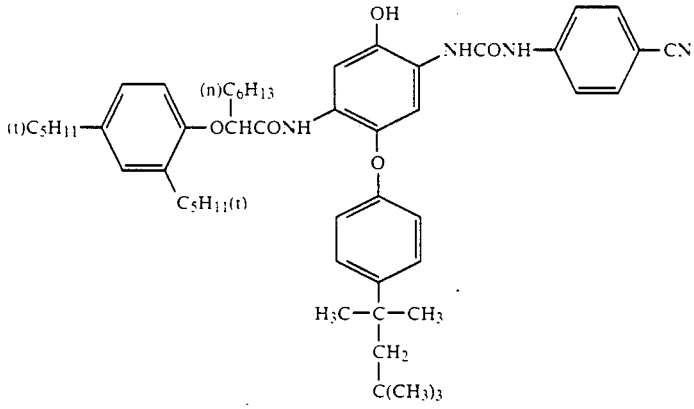
ExC-7
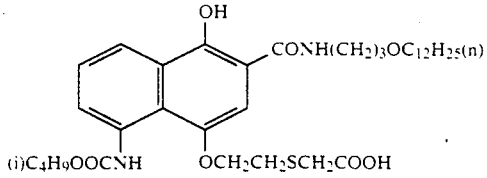

-continued
ExM-8
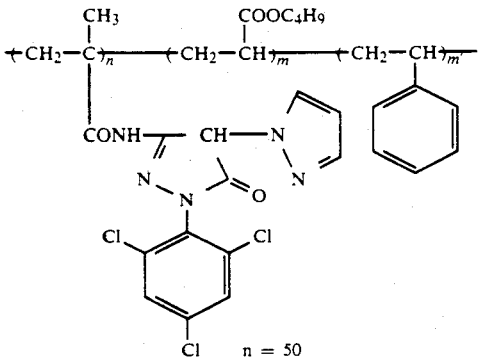
n = 50
m = 25
m' = 25
mol. wt. about 20,000
ExM-9
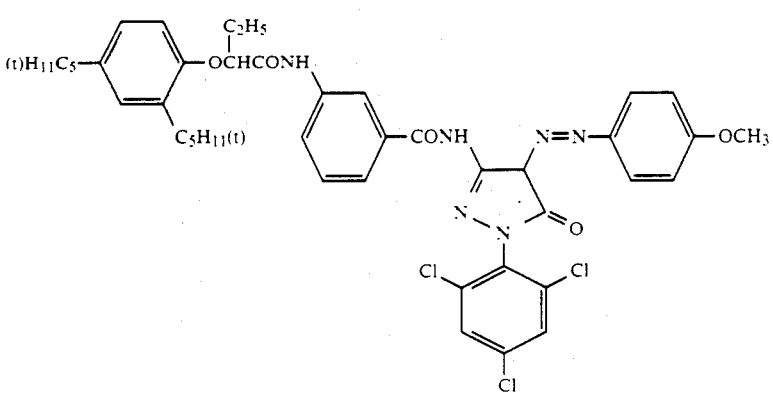
ExM-10
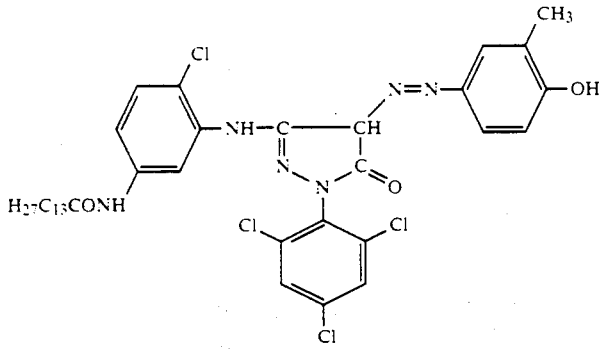
ExY-11
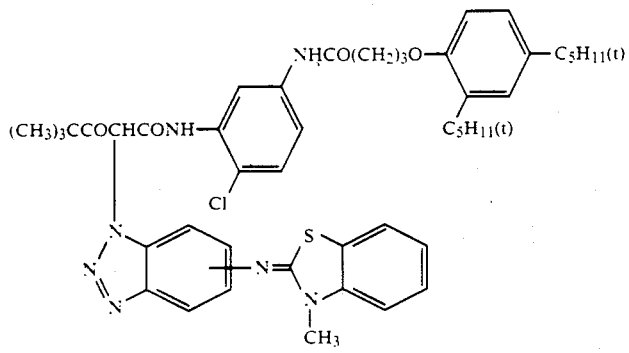

-continued
ExM-12
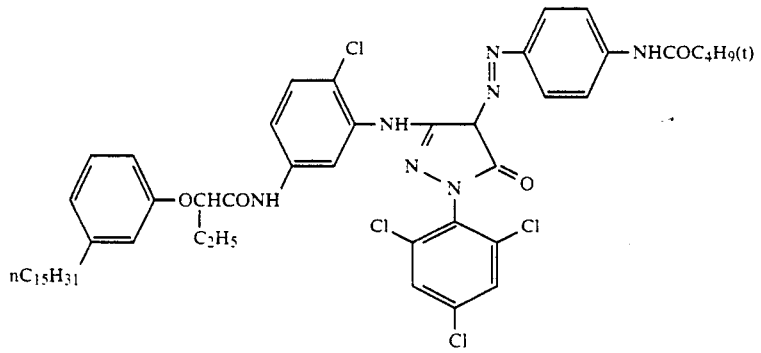
ExY-13
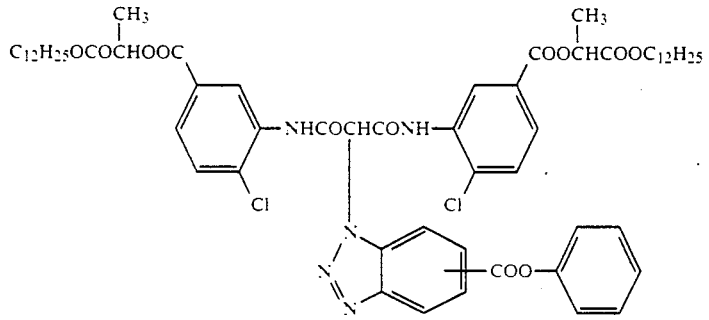
ExM-14
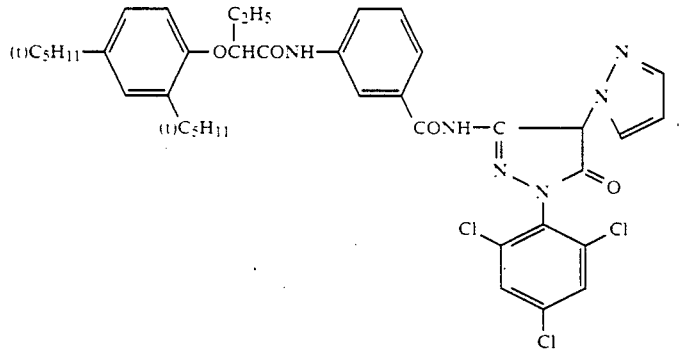
ExY-15
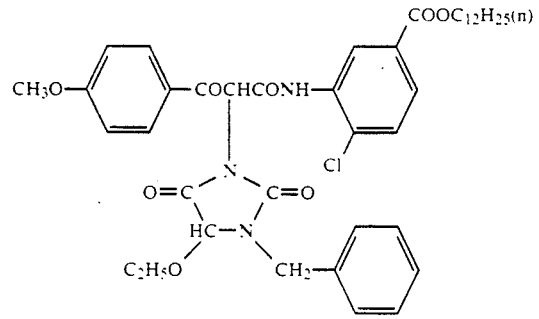

-continued
ExC-16
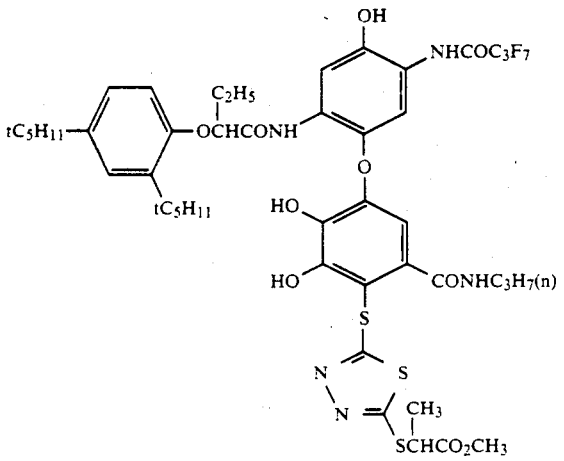
ExY-17
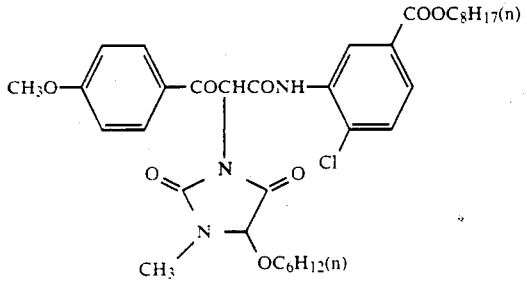
ExS-1
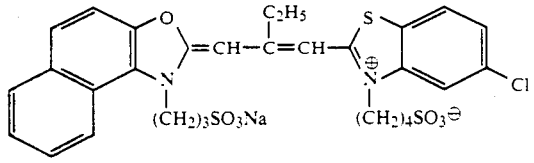
ExS-2
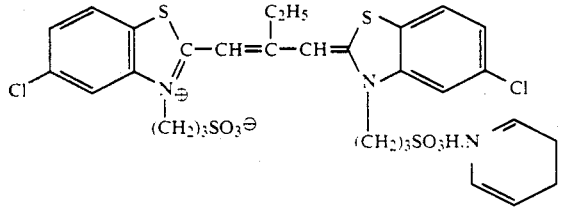
ExS-3
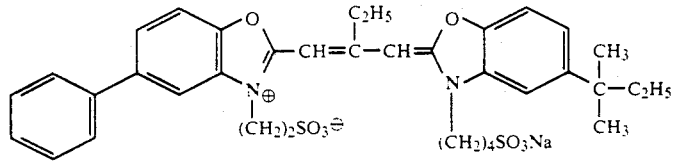
ExS-4
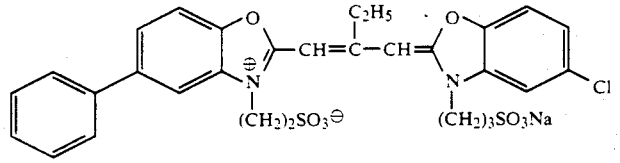
ExS-5
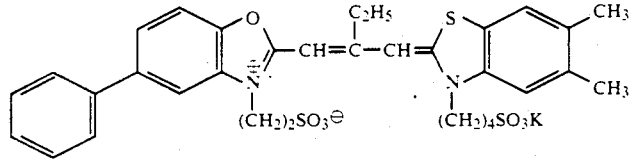

-continued

ExS-6

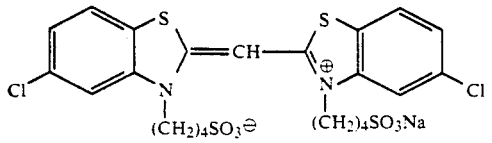

H-1

$CH_2{=}CH{-}SO_2{-}CH_2{-}CONH{-}CH_2$
$CH_2{=}CH{-}SO_2{-}CH_2{-}CONH{-}CH_2$

ExF-1

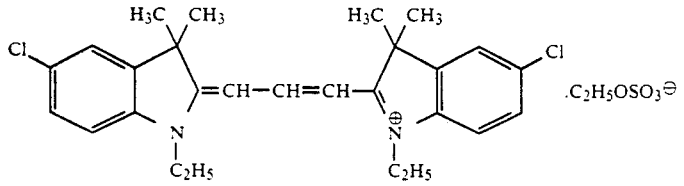

Comparative Compound A

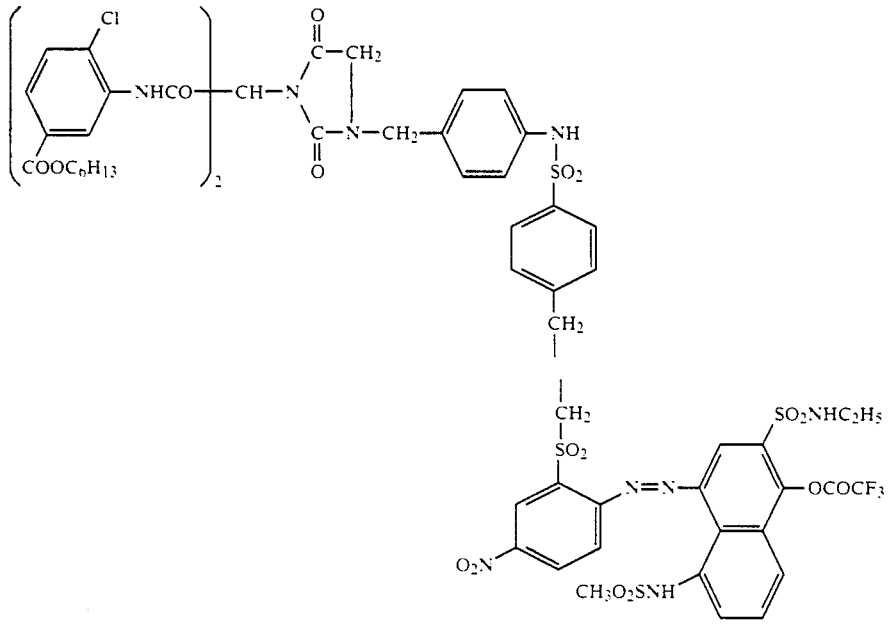

Compound described in Japanese Patent Application (OPI) No. 35,355/87

HQ-1

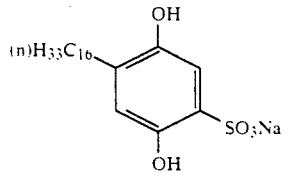

Processing

| Processing step | Processing time | Processing temperature |
|---|---|---|
| Color development | 3 min. 15 sec. | 38° C. |
| Bleaching | 1 min. 00 sec. | 38° C. |
| Blix | 3 min. 15 sec. | 38° C. |
| Rinse (1) | 40 sec. | 35° C. |
| Rinse (2) | 1 min. 00 sec. | 35° C. |
| Stabilizing | 40 sec. | 38° C. |
| Drying | 1 min. 15 sec. | 55° C. |

The composition of the processing solutions used will be described hereinafter.

Color developing solution

| | (unit: g) |
|---|---|
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino-2-methylaniline sulfate | 4.5 |
| Water to make | 1.0 l |
| pH | 10.05 |

Bleaching solution

| | (unit: g) |
|---|---|
| $NH_4[Fe(III)(EDTA)]$ (dihydrate) | 120.0 |
| EDTA.2Na | 10.0 |
| Ammonium bromide | 100.0 |
| Ammonium sulfate | 10.0 |
| Bleach accelerator | 0.005 mol |

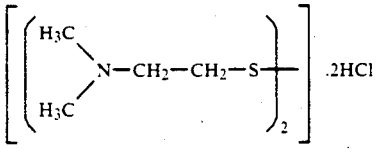

| | |
|---|---|
| Ammonia water (27%) | 15.0 ml |
| Water to make | 1.0 l |
| pH | 6.3 |

Blix solution

| | (unit: g) |
|---|---|
| $NH_4[Fe(III)(EDTA)]$ (dihydrate) | 50.0 |
| EDTA.2Na | 5.0 |
| Sodium sulfite | 12.0 |
| Aqueous solution of ammonium thiosulfate (70%) | 240.0 ml |
| Ammonia water (27%) | 6.0 ml |
| Water to make | 1.0 l |
| pH | 7.2 |

Rinsing solution

Tap water was allowed to pass through a mixed bed column filled with a strongly acidic H-type cationic exchange resin (Rohm & Haas Co.,; Amberlite® IR-120B) and an OH-type anionic exchange resin (Amberlite® IR-400) so that the content of calcium and magnesium ions were reduced to 3 mg/l or less. Sodium dichlorinated isocyanurate and sodium sulfate were added to the water in amounts of 20 mg/l and 150 mg/l, respectively.

The pH of the rinsing solution thus prepared was between 6.5 and 7.5

Stabilizing solution

| | (unit: g) |
|---|---|
| Formalin (37%) | 2.0 ml |
| Polyoxyethylene-p-monononylphenylether (average polymerization degree: 10) | 0.3 |
| EDTA.2Na | 0.05 |
| Water to make | 1.0 l |
| pH | 5.0-8.0 |

The results show that the use of the compound of the present invention can provide a significantly excellent sharpness as compared with the conventional process using Compound A. It is also found that the use of the compound of the present invention provides an excellent sharpness even after storage at a high temperature and humidity.

EXAMPLE 3

Preparation of Specimen 301

Specimen 301 was prepared in the same manner as in Specimen 302 except that Comparative Compound B was incorporated in the 6th layer in an amount of 0.25 mol per mol of silver.

Preparation of Specimens 302 to 304

Specimens 302 to 304 were prepared in the same manner as in Specimen 301 except that Compound B was replaced by an equimolar amount of the present compound (Compound (3) for Specimens 302 and 303 and Compound (12) for Specimen 304).

Compound HQ-1 was further incorporated in Specimens 303 and 304 in equimolecular amounts.

These specimens thus prepared were exposed to light through an MTF chart and a green filter, and then subjected to the same processing as in Example 2. These specimens were further stored at a temperature of 45° C. and a relative humidity of 80% for 3 days. These specimens thus aged were then measured for MTF.

The results show that the use of the compound of the present invention provides a sufficient improvement in MTF even after storage at a high temperature and humidity.

Comparative Compound B

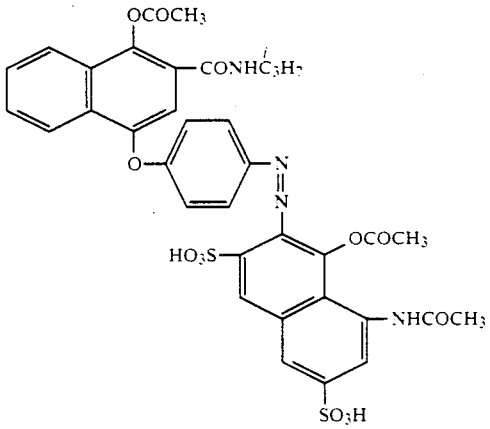

EXAMPLE 4

A specimen was prepared in the same manner as in Example 2 except that DIR couplers ExC-3, ExC-5, ExY-11, ExY-13, and ExC-16 were not used. The specimen was then subjected to the same experiment as in Example 2. As a result, similar properties were obtained.

EXAMPLE 5

A wholly-sensitive emulsion was prepared by changing the halogen composition of the emulsion used in the light-sensitive emulsion layer in Example 2 to AgBrCl (Br: 60%; Cl: 40%). Specimens were prepared by using this emulsion and excluding the DIR couplers as described in Example 4. These specimens were evaluated in the same manner as in the foregoing examples. As a result, it was found that the specimens comprising the present compound provide a higher MTF value than the specimens free of the present compound.

While the invention has been described in detail and with reference to specific embodiments thereof, it will be apparent to one skilled in the art that various changes and modifications can be made therein without departing from the spirit and scope thereof.

What is claimed is:

1. A color light-sensitive material, which comprises a support having thereon at least a light-sensitive silver halide, an image-forming coupler, and a compound represented by formula (II):

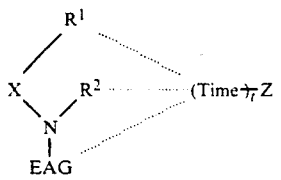

(II)

wherein X represents an oxygen atom, a sulfur atom or a nitrogen-containing group of formula —N($R_3$)—; $R_1$, $R_2$ and $R_3$ each represents a mere bond or a group other than a hydrogen atom; EAG represents an electron accepting group; or $R_1$, $R_2$, $R_3$ and EAG are connected to each other to form a ring; Time represents a group capable of releasing Z upon cleavage of the N—X bond through a reaction subsequent to the release from the rest of the compound in the form of $(Time)_tZ$; the dotted lines represent possible bonds, provided that at least one dotted line is a bond; t represents an integer of 0 or 1; and Z represents a group which becomes a slightly mobile dye or a precursor thereof for forming an unsharp mask after being released from $(Time)_tZ$ wherein said dye released from the compound represented by formula (II) has a maximum absorption wavelength of the same series color as the dye formed by said color coupler.

2. The color light-sensitive material as claimed in claim 1, wherein the compound represented by formula (II) is represented by formula (III):

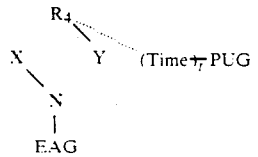

(III)

wherein Y represents a divalent linking group; $R_4$ represents an atom group forming a 5- to 8- membered nitrogen-containing monocyclic or condensed heterocyclic ring together with X and Y; PUG represents a photographically useful group; X, t, EAG, Time, and the dotted lines are as defined in claim 1.

3. The color light-sensitive material as claimed in claim 1, wherein the compound represented by formula (II) contains a cyan dye as Z which has been temporarily shifted to a shorter wavelength and is used in combination with a cyan coupler.

4. The color light-sensitive material as claimed in claim 1, wherein the compound represented by formula (II) contains a magenta dye as Z which has been temporarily shifted to a shorter wavelength and is used in combination with a magenta coupler.

5. The color light-sensitive material as claimed in claim 1, wherein the compound represented by formula (II) contains a yellow dye as Z which has been temporarily shifted to a shorter wavelength and is used in combination with a yellow coupler.

6. The color light-sensitive material as claimed in claim 1, wherein Z in formula (II) is a colored coupler for forming an azomethine dye which does not substantially form a color or is eluted into a developing solution, upon reaction with an oxidation product of a developing agent after being cleaved.

7. The color light-sensitive material as claimed in claim 1, wherein said image-forming coupler is a non-diffusible coupler.

8. The color light-sensitive material as claimed in claim 1, wherein said image-forming coupler is an acylacetamide type coupler or a malondiamide type coupler.

9. The color light-sensitive material as claimed in claim 1, wherein said image-forming coupler is a 5-pyrazolone type coupler, pyrazoloimidazole type coupler, or a pyrazolotriazole type coupler.

10. The color light-sensitive material as claimed in claim 1, wherein said image-forming coupler is a phenol type coupler or a naphthol type coupler.

11. The color light-sensitive material as claimed in claim 1, wherein the compound represented by formula (II) is used in an amount of from $1\times10^{-7}$ to $1\times10^{-1}$ mol/m$^2$.

12. The color light-sensitive material as claimed in claim 9, wherein the compound represented by formula (II) is used in an amount of from $1\times10^{-8}$ to $1\times10^{-3}$ mol/m$^2$.

13. The color light-sensitive material as claimed in claim 1, further comprising a reducing substance represented by formula (C):

$$Q_1—V_n—Q_2 \qquad (C)$$

wherein $Q_1$ and $Q_2$ each represent —O—Sub,

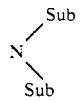

or —S—Sub in which each Sub which may be the same or different represents a mere bond ($\pi$ bond), hydrogen atom or substituent, wherein the Sub's may be connected to each other to form a 3- to 8- membered saturated or unsaturated carbon ring or heterocycle; and n represents an integer of 0 to 8 and when n is 0, formula (C) is $Q_1$-$Q_2$, and $V_1$ to $V_8$ represent $—\alpha_1—\beta_1—$, $—\alpha_1—\beta_1)(\alpha_2—\beta_2—$, $—\alpha_1—\beta_1)(\alpha_2—\beta_2)(\alpha_3—\beta_3—$, $—\alpha_1—\beta_1)(\alpha_2—\beta_2)(\alpha_3—\beta_3)(\alpha_4—\beta_4—$, $—\alpha_1—\beta_1)(\alpha_2—\beta_2)(\alpha_3—\beta_3)(\alpha_4—\beta_4)(\alpha_5—\beta_5—$, $—\alpha_1—\beta_1)(\alpha_2—\beta_2)(\alpha_3—\beta_3)(\alpha_4—\beta_4)(\alpha_5—\beta_5)(\alpha_6—\beta_6—$, $—\alpha_1—\beta_1)(\alpha_2—\beta_2)(\alpha_3—\beta_3)(\alpha_4—\beta_4)(\alpha_5—\beta_5)(\alpha_6—\beta_6)(\alpha_7—\beta_7—$, and $—\alpha_1—\beta_1)(\alpha_2—\beta_2)(\alpha_3—\beta_3)(\alpha_4—\beta_4)(\alpha_5—\beta_5)(\alpha_6—\beta_6)(\alpha_7—\beta_7)(\alpha_8—\beta_8—$, respectively, in which $\alpha_1$ to $\alpha_8$ and $\beta_1$ to $\beta_8$ each represents

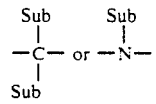

wherein Sub has the same meaning as defined above in formula (C), and wherein $Q_1$, $Q_2$ and $V_n$ may be connected to each other to form a heterocyclic group.

14. The color light-sensitive material as claimed in claim 13, wherein the reducing substance represented by formula (C) contains a ballast group.

* * * * *